US007891894B2

(12) United States Patent
Kimura et al.

(10) Patent No.: US 7,891,894 B2
(45) Date of Patent: Feb. 22, 2011

(54) PRINTER

(75) Inventors: Satoshi Kimura, Ome (JP); Yoshiaki Mochizuki, Mizuho-machi (JP)

(73) Assignee: Casio Computer Co., Ltd., Tokyo (JP)

( * ) Notice: Subject to any disclaimer, the term of this patent is extended or adjusted under 35 U.S.C. 154(b) by 1181 days.

(21) Appl. No.: 11/541,307

(22) Filed: Sep. 29, 2006

(65) Prior Publication Data

US 2007/0070432 A1 Mar. 29, 2007

(30) Foreign Application Priority Data

Sep. 29, 2005 (JP) ..... 2005-284793
Sep. 29, 2005 (JP) ..... 2005-284795

(51) Int. Cl.
*B41J 11/70* (2006.01)
*B41J 29/00* (2006.01)
*B41J 3/407* (2006.01)

(52) U.S. Cl. ..... 400/621; 400/693

(58) Field of Classification Search ..... 400/621, 400/693; 83/DIG. 1
See application file for complete search history.

(56) References Cited

U.S. PATENT DOCUMENTS 5,542,768 A 8/1996 Rother et al.
5,839,840 A 11/1998 Kawano
6,148,722 A 11/2000 Hagstrom
6,249,303 B1 6/2001 Mochizuki et al.
6,302,601 B1 10/2001 Hagstrom et al.
6,580,444 B1 6/2003 Drynkin et al.
6,709,175 B1 3/2004 Drynkin et al.
6,857,797 B2 2/2005 Weast
7,252,447 B2 8/2007 Kimura et al.
7,513,706 B2 4/2009 Kimura et al.
7,654,760 B2 * 2/2010 Sakano et al. ..... 400/621
2002/0006303 A1 1/2002 Yamaguchi et al.
2002/0090243 A1 7/2002 Hosokawa et al.
2003/0142199 A1 7/2003 McFarland et al.
2004/0265032 A1 12/2004 Furihata et al.
2005/0045010 A1 * 3/2005 Kovacic et al. ..... 83/478

(Continued)

FOREIGN PATENT DOCUMENTS

EP 644055 A2 * 3/1995

(Continued)

OTHER PUBLICATIONS

Extended European Search Report dated Aug. 14, 2008 issued in counterpart European Appln. No. 06020627.3.

(Continued)

*Primary Examiner*—Daniel J Colilla
(74) *Attorney, Agent, or Firm*—Holtz, Holtz, Goodman & Chick, PC

(57) ABSTRACT

A printer in which when an optical disk is inserted into a conveyance path in a printer body, an inlet cover is moved to a position where the inlet cover opens an inlet in a cover provided on the printer body. This causes a cutter button that operates a cutter for a tape-like printing medium to be locked by the inlet cover. Thus, when the optical disk is printed, the cutter is rendered inoperable. Accordingly, the printer can prevent a trouble such as inadvertently operates the cutter, thereby damaging the disk or the cutter itself.

20 Claims, 35 Drawing Sheets

U.S. PATENT DOCUMENTS

| | | | |
|---|---|---|---|
| 2006/0078364 | A1 | 4/2006 | Kimura et al. |

FOREIGN PATENT DOCUMENTS

| | | | | |
|---|---|---|---|---|
| EP | 0 832 753 | A1 | | 4/1998 |
| EP | 1 332 884 | A2 | | 8/2003 |
| EP | 1 468 835 | A1 | | 10/2004 |
| EP | 1 647 408 | A2 | | 4/2006 |
| JP | 06191103 | A | * | 7/1994 |
| JP | 06199332 | A | | 7/1994 |
| JP | 06328796 | A | * | 11/1994 |
| JP | 7-314747 | A | | 12/1995 |
| JP | 10309859 | A | | 11/1998 |
| JP | 2000155867 | A | | 6/2000 |
| JP | 2003-07215 | A | | 3/2003 |
| JP | 2003-072173 | A | | 3/2003 |
| JP | 2003266876 | A | | 9/2003 |
| WO | WO 00/63020 | A1 | | 10/2000 |

OTHER PUBLICATIONS

Extended European Search Report dated Dec. 6, 2006, issued in a counterpart European application to U.S. Appl. No. 11/249,101.
Machine translation of JP 10309859 to Isobe from Japanese Patent Office website.
Machine translation of JP 2000155867 to Kosuda et al. from Japanese Patent Office website.

* cited by examiner

PRINTER

BACKGROUND OF THE INVENTION

1. Field of the Invention

The present invention relates to printers and more particularly such printer that prints on a selected one of a rigid medium such as an optical disk and a printing tape inserted into the printer body.

2. Description of the Related Art

In the past, printers that print characters, composing a title for data recorded on an optical disk (or recording medium) such as a CD-R (Compact Disk-Recordable), on the same are known, for example, as disclosed in Published Unexamined Japanese Patent Application No. 2003-72175. This printer comprises a tray that supports an optical disk and a printer mechanism that prints on the optical disk. The tray is movable between outside of the printer body and an predetermined position within the printer body. The printer mechanism comprises a carriage reciprocal over the tray when the same is disposed at the predetermined position within the printer body. The carriage supports a reciprocal thermal head and unloadably receives an ink ribbon cassette containing an ink ribbon thereon. In this printer, the thermal head performs thermal transfer printing with the ink ribbon on the optical disk supported on the tray.

Also, printers have been widely used that print on a printing tape and cuts a printed part of the tape, thereby forming a label. In this printer, a tape cassette that contains a printing tape and an ink ribbon is set on a cassette receiving section of the printer body in the form of a cavity. Then, the printing tape is conveyed along a conveyance path and a thermal head is driven to perform thermal transfer printing on the printing tape with the ink ribbon. A printed part of the tape is then discharged out of a discharge port provided at an end of the conveyance path and cut by a cutter provided in the vicinity of the discharge port, thereby forming a label, as disclosed, for example, in Published Unexamined Japanese Patent Application No. 7-314747.

For managing purposes, a character string composing a title for the content of an electronic data recorded on the optical disk is printed on a label face of the optical disk using the printer for the optical disk. Then, the same character string as printed on the optical disk is printed on a tape using the tape printer, thereby forming a label, which is then pasted on a case for the optical disk. However, in this case, the two different printers for the optical disk and the tape must be used separately. In addition to printing on both the optical disk and its case, a character string can be often required to be printed only on the label face of the optical disk or only on a label tape. Also in such a case, the two different printers must be prepared.

In terms of this situation, the inventors have developed a printer with a single printing means that can print on any selected one of an optical disk and a tape for a label. This printer has a cutter mechanism for a printed tape part because the printer has the functions of printing on the tape and then creating a label. Thus, the same printing means prints on a soft recording medium such as a tape to be cut and a rigid recording medium such as an optical disk which should not be cut. However, if the cutter mechanism operates wrongly in printing on the optical disk, the optical disk would be broken. Furthermore, if the cutter mechanism, which is designed so as to cut a thin printing tape, acts on the optical disk, the cutter mechanism itself would be damaged. Especially, with a printer in which the cutter mechanism is operated manually, the user could advertently touch his or her hand on an operation member appearing on the printer, thereby operating the cutter mechanism, when the character string is printed on the optical disk.

This printer takes the form of a small flat box where the height dimension is small compared to the width and depth dimensions. An upstanding optical disk is printed while being conveyed along a conveyance path for the printing tape formed within the printer body. In this printer the height of the printer body is small compared to the diameter of the upstanding optical disk. Thus, in order that a character string can be printed on the upstanding optical disk while being conveyed within the printer body, a cover that has a slit-like inlet therein through which the optical disk is inserted into the printer body is provided above the conveyance path for the optical disk so as to cover the cassette receiving section closably. When the cover covers the cassette receiving section, the slit-like inlet in the cover aligns with the conveyance path. In this printer, after the cover is opened, a ribbon cassette is set into the cassette receiving section. Then, the cover is closed and an upstanding optical disk is set in place within the conveyance path through the inlet in the cover. In this state, the optical disk has its upstanding medium part received within the inlet in the cover, its upper half appearing outside the printer body and its lower half received within the printer body. When the printing means starts to operate, the upstanding optical disk and the ink ribbon are held between the thermal head and the platen roller, and then conveyed in a predetermined direction along the conveyance path by the rotating platen roller. Thus, an ink on the ink ribbon is transferred by heat produced by the thermal head to the label face of the optical disk conveyed in the upstanding state within the inlet in the cover.

When it is found in this printer that a ribbon cassette is not set after the optical disk is set on the printer body or when a set ribbon cassette is desired to be replaced with a different color one, the cover is opened and then the ribbon cassette will be set or replaced. However, when the cover is inadvertently opened with the optical disk set in the printer body, the edge of the inlet in the cover may hit on the label face of the optical disk, thereby damaging the same.

SUMMARY OF THE INVENTION

It is therefore an object of the present invention to provide a printer that when a rigid recording medium such as an optical disk is set in the printer body, prohibits the operation of the cutter means by the user, thereby preventing the rigid recording medium from being damaged and preventing the cutter means from being malfunctioning. It is another object of the prevent invention to provide a printer which prevents the operator from operating the cutter means to cut/damage the rigid recording medium or from causing the cutter means itself to be damaged, and prevents the user from inadvertently opening the cover closed against the printer body to exchange print expendables in a state in which the rigid recording medium is inserted into the inlet in the cover, thereby damaging the rigid recording medium.

In order to achieve the above object, in one aspect the present invention provides a printer that prints information on a printing medium or rigid medium, the printer comprising: a conveyance path along which the printing medium is conveyed; printing means for printing the information either on the printing medium inserted into a printer body and conveyed along the conveyance path or on the rigid medium disposed in the conveyance path; cutting means disposed over the conveyance path and connected to an operation member operable manually from outside the printer body for causing the cutting means to cut that part of the printing medium on which the information is printed by the printing means; and prohibiting means for prohibiting the cutting means from being manually operated via the operation member when the rigid recording medium is inserted into the conveyance path.

According to this arrangement, the prohibiting means prohibits the user from operating the cutting means when the rigid recording medium is received in the conveyance path. Thus, the operator cannot operate the cutting means, and damage to the rigid recording medium by the cutting means and damage to the cutting means due to its operation on the rigid recording medium are prevented.

In the printer, the prohibiting means may comprise operation preventing means, responsive to the rigid medium being inserted into the conveyance path, for preventing the cutting means from being manually operated via the operation member.

In the printer, the operation preventing means may comprise lock means, responsive to the rigid medium being inserted into the conveyance path, for locking the cutting means so as not to operate.

In the printer, the operation preventing means may comprise covering means, responsive to the rigid medium being inserted into the conveyance path, for covering the operation member that causes the cutting means to manually operate so as not to be manually operated.

In the printer, the operation preventing means may comprise interrupting means, responsive to the rigid medium being inserted into the conveyance path, for interrupting transmission of the manual operation of the operation member to a cutting blade of the cutting means.

In the printer, the printer body may have an inlet therein through which the rigid medium is inserted into the conveyance path therein, and further comprising: an inlet cover provided on the printer body for covering the inlet in the printer body, the inlet cover being operated manually when the rigid medium is inserted into the conveyance path through the inlet in the printer body; and wherein: the prohibiting means may comprise operation preventing means, responsive to the inlet cover being opened, for preventing the operation member from being manually operated.

In the printer, the operation preventing means may comprise lock means, responsive to the inlet cover being opened, for locking the cutting means in an inoperable state.

In the printer, the operation preventing means may comprise covering means, responsive to the rigid medium being inserted into the conveyance path, for covering the operation member so as not to be manually operated.

In the printer, the operation preventing means may comprise interrupting means, responsive to the inlet cover being opened, for interrupting transmission of the manual operation of the operation member to a cutting blade of the cutting means.

In the printer, the prohibiting means may comprise: detecting means for detecting that the rigid medium is inserted into the conveyance path; and operation preventing means, responsive to the detecting means detecting that the rigid medium being inserted into the conveyance path, for being driven by a drive source to prevent the cutting means from being manually operated.

In the printer, the operation preventing means may comprise lock means driven by the drive source for locking the cutting means in an inoperable state.

In the printer, the operation preventing means may comprises covering means, driven by the drive source, for covering the operation member that manually operates the cutting means so as not to be operated.

In the printer, the operation preventing means may comprise interrupting means, driven by the drive source, for interrupting transmission of the manual operation of the operation member to a cutting blade of the cutting means.

In order to achieve the above object, in a second aspect the present invention provides a printer that prints information on either a printing medium or a rigid medium, the printer comprising: a conveyance path along which the printing medium is conveyed; printing means for printing the information either on the recording medium inserted into a printer body and conveyed along the conveyance path or on the rigid medium disposed in the conveyance path; a cassette receiving section for receiving print expendables exchangeably; a cover provided openably over the printer body so as to cover the cassette receiving section, the cover having an inlet therein through which the rigid medium is inserted into the printer body such that a part of the rigid medium appears outside the printer body; cutting means disposed over the conveyance path and having an operation member operable manually from outside the printer body for causing the cutting means to cut that part of the soft printing medium on which the information is printed by the printing means; and prohibiting means for prohibiting the cutting means and the cover from being manually operated and opened, respectively, when the rigid recording medium is inserted into the conveyance path.

According to this arrangement, when the rigid recording medium is received within the conveyance path, the prohibiting means prohibits the operation of the cutting means by the user and the opening of the cover. Thus, the recording medium is protected from being damaged and/or the cutting means from being damaged due to the user's operation of the cutting means. In addition, the recording medium is protected from being damaged due to the user's inadvertent opening of the cover in a state where the rigid medium is received in the inlet in the cover.

The printer may further comprise: an inlet cover provided over the printer body for covering the inlet in the first-mentioned cover opened manually when the rigid medium is inserted into the conveyance path; and wherein: the prohibiting means may comprise operation preventing means, responsive to the inlet cover being opened manually, for preventing the cutting means and the first-mentioned cover from being manually operated and opened, respectively.

In the last-mentioned printer, the operation preventing means may comprise one of means for locking the cutting means so as not to be operated; means for covering the operation member of the cutting means so as not to be operated and means for interrupting transmission of the manual operation of the operation member of the cutting means to a cutter blade of the cutting means, and one of means for locking the first-mentioned cover to the printer body so as not to be operated, means for covering an operation member of disengaging means for disengaging the first-mentioned cover from the printer body, and means for interrupting transmission of the manual operation of the operation member of the disengaging means to the disengaging means.

In the printer, the prohibiting means may comprise operation preventing means, responsive to the rigid medium being inserted into the conveyance path, for preventing the cutting means and the first-mentioned cover from being manually operated and opened, respectively.

In the last-mentioned printer, the operation preventing means may comprise one of means for locking the cutting means so as not to be operated; means for covering the operation member of the cutting means so as not to be operated and means for interrupting transmission of the manual operation of the operation member of the cutting means to a cutter blade of the cutting means, and one of means for locking the first-mentioned cover to the printer body so as not to be operated, means for covering an operation member of disengaging means for disengaging the first-mentioned cover from the printer body, and means for interrupting transmission of the manual operation of the operation member of the disengaging means to the disengaging means.

In the printer, the prohibiting means may comprise: detecting means for detecting that the rigid medium is inserted into the conveyance path; and operation preventing means, responsive to the detecting means detecting that the rigid medium being inserted into the conveyance path, for being driven by a drive source to prevent the cutting means and the first-mentioned cover from being manually operated and opened, respectively.

In the last-mentioned printer, the operation preventing means may comprise one of means for locking the cutting means so as not to be operated; means for covering the operation member of the cutting means so as not to be operated and means for interrupting transmission of the manual operation of the operation member of the cutting means to a cutter blade of the cutting means, and one of means for locking the first-mentioned cover to the printer body so as not to be operated, means for covering an operation member of disengaging means for disengaging the first-mentioned cover from the printer body, and means for interrupting transmission of the manual operation of the operation member of the disengaging means to the disengaging means.

The above and other objects, features and advantages of the present invention will become apparent in the following detailed description of the present embodiments and modifications thereof when read in conjunction with the accompanying drawings wherein the same reference numerals denote like or similar parts throughout the several views.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Figure 1:
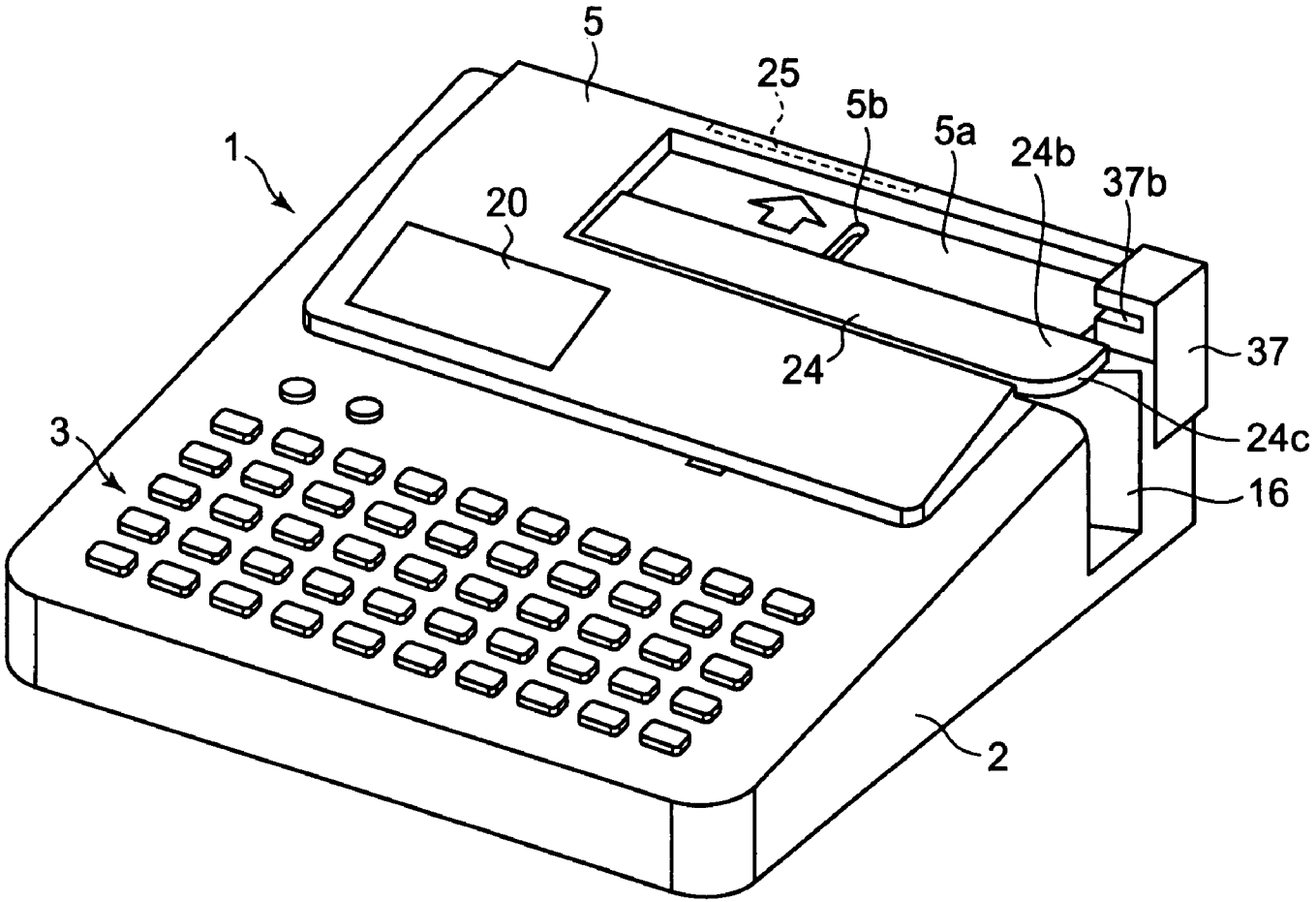
FIG. 1 is a perspective view of a whole printer according to a first embodiment of the present invention.
Figure 2:
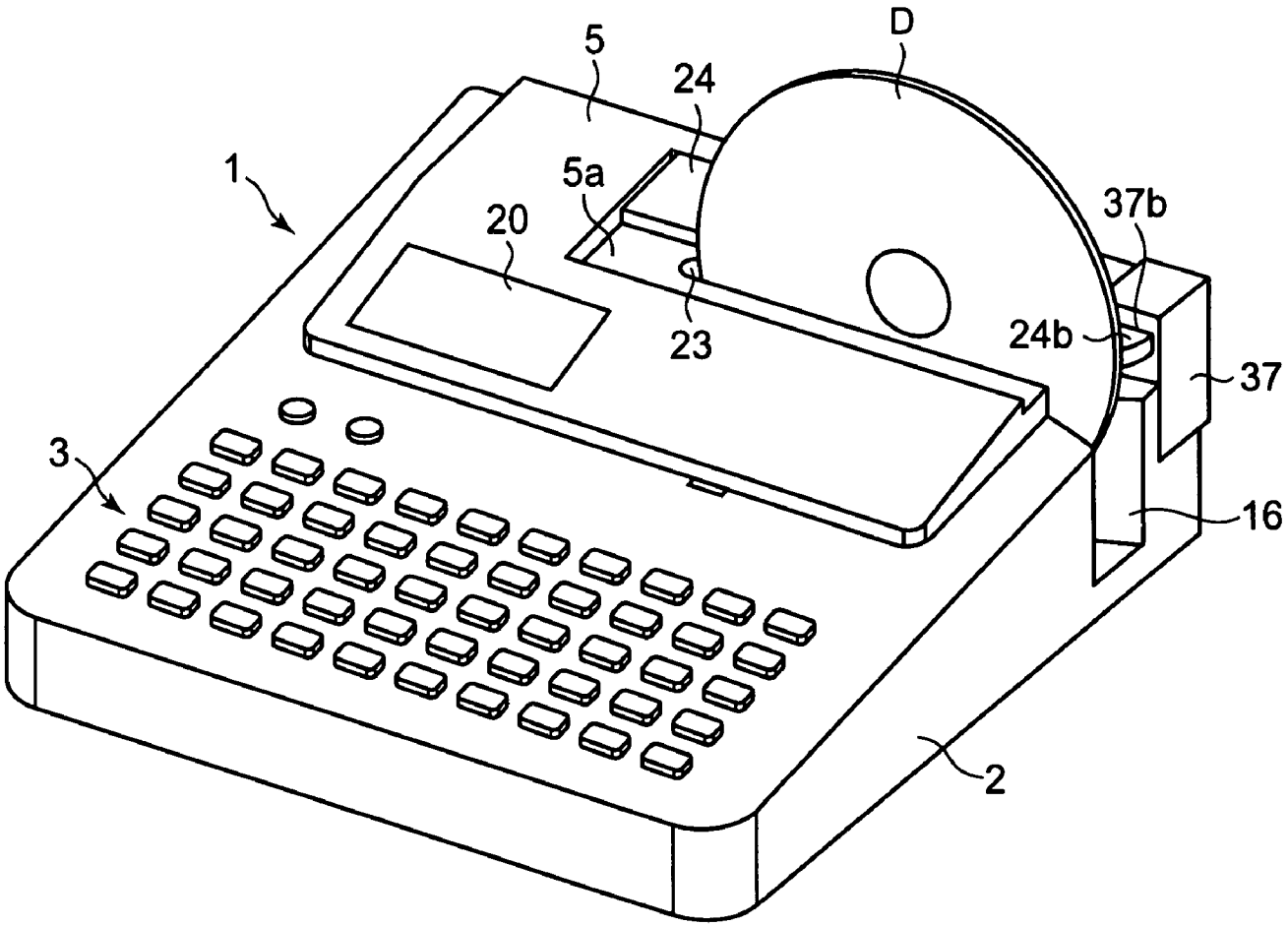
FIG. 2 is a perspective view of the FIG. 1 printer with an optical disk set in the printer.
Figure 3:
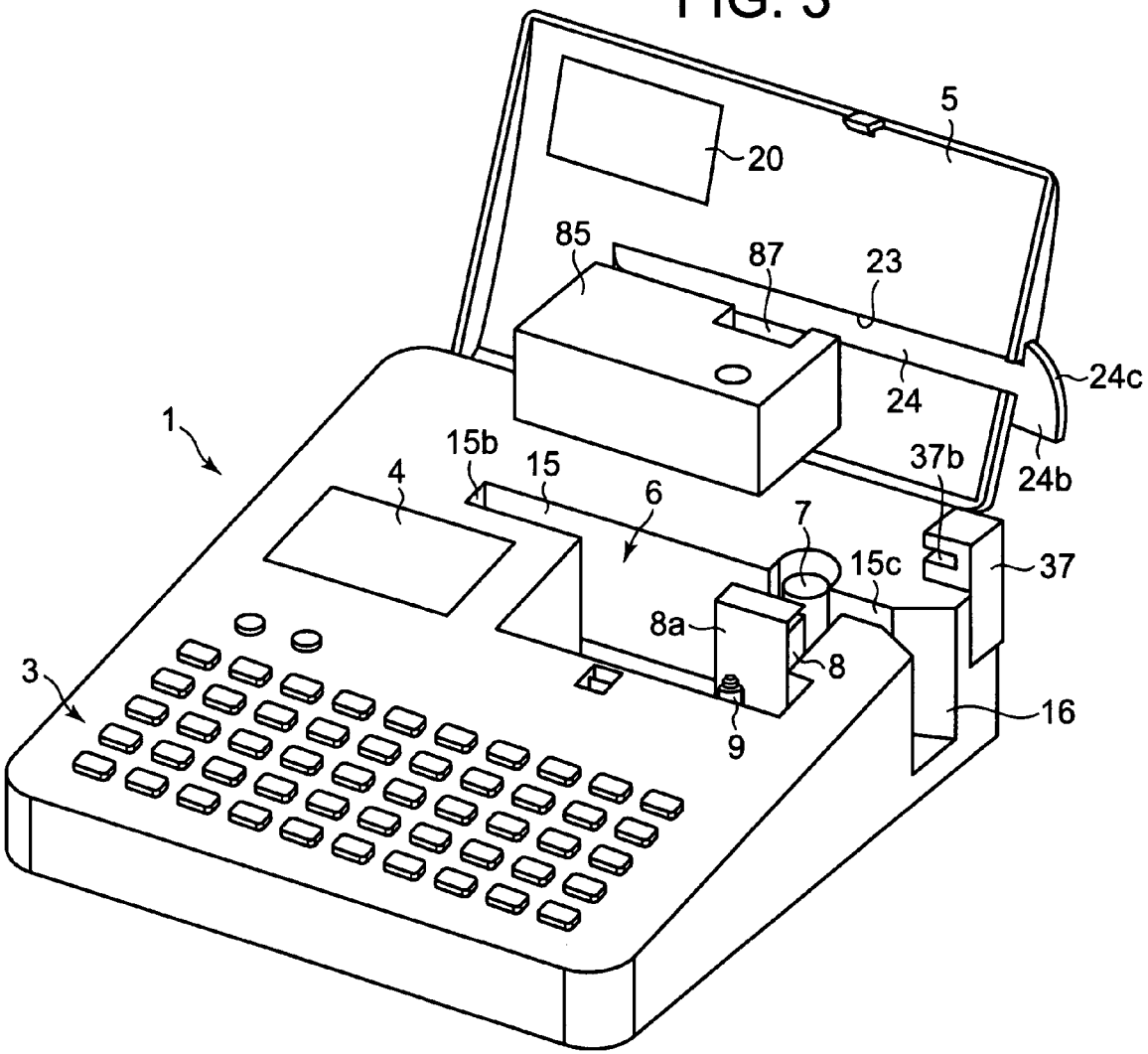
FIG. 3 is a perspective view of the printer with a cover open.
Figure 4:
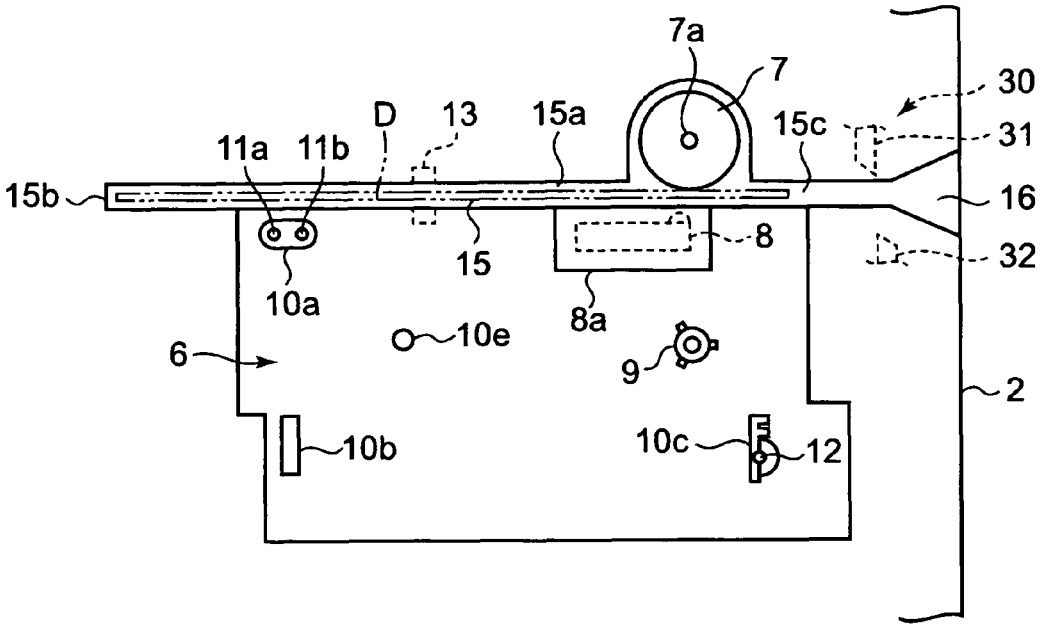
FIG. 4 is a plan view of a disk cassette receiving section of the printer.

Embodiments and modifications of the present invention will be described with reference to the accompanying drawings. FIG. 1 is a perspective view of a printer according to a first embodiment of the present invention. FIG. 2 is a perspective view of the FIG. 1 printer with an optical disk set in the printer. FIG. 3 is a perspective view of the printer with a cover open. FIG. 4 is a plan view indicative of an internal structure of the printer.

The printer should print directly on a label (or printing) face of a disk-like rigid recording medium (or optical disk) such as a data recordable CD-R (Compact Disk-recordable) or a DVD-R (Digital Versatile Disk-Recordable) and also print on a soft tape-like printing medium (or printing tape).

The printer comprises a printer body 1 having a body case 2 and a cover 5. A key-in unit 3 and a display 4 provided on an upper surface of the body case 2. The key-in unit 3 comprises character keys for inputting character string data to be printed, a print key for giving a print start command, a cursor key for moving a cursor on the display screen of the display 4, and other various control keys necessary for editing and printing the inputted characters and performing various setting processes. The display 4 is a liquid crystal display device on which required information such as inputted data and processed data are displayed.

Figure 5A:
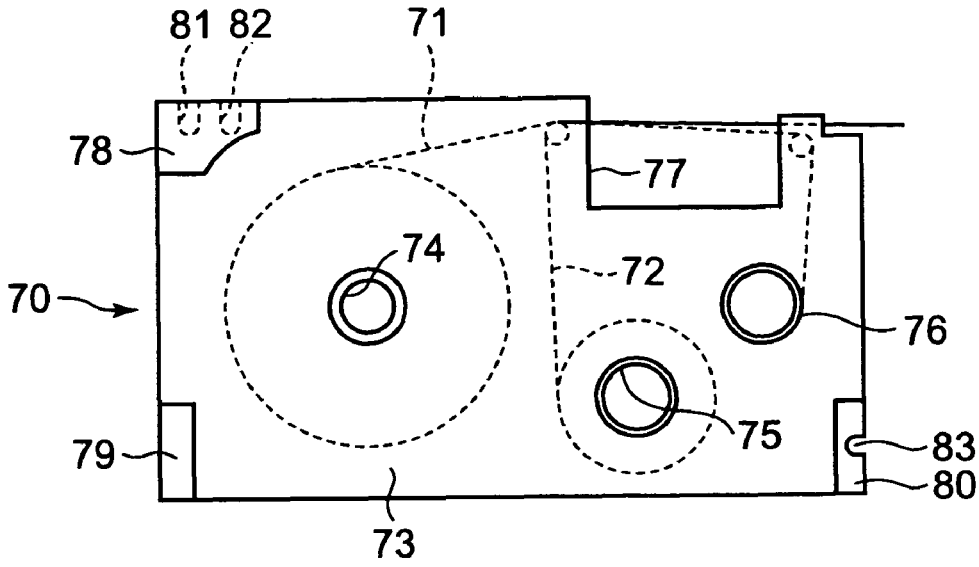
FIGS. 5A and 5B are a plan view and a perspective view, respectively, of a tape cassette to be used in the printer.
Figure 5B:
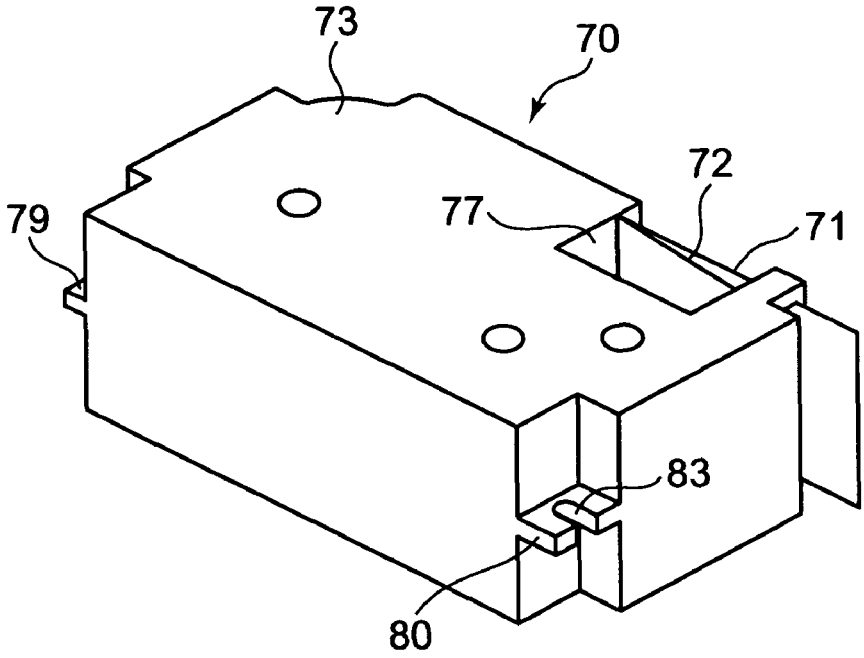
Figure 6A:
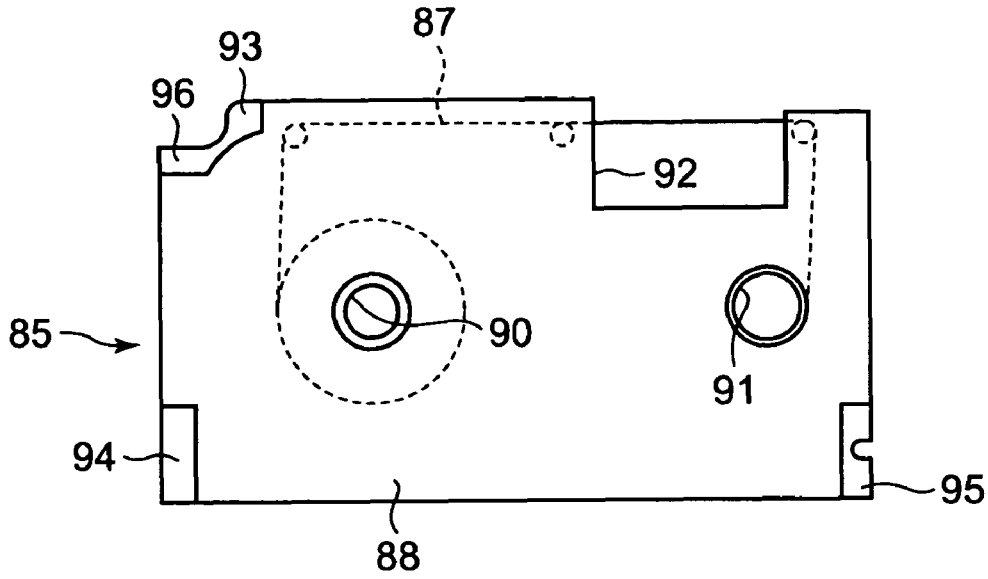
FIGS. 6A and 6B are a plan view and a perspective view, respectively, of a ribbon cassette to be used in the printer.
Figure 6B:
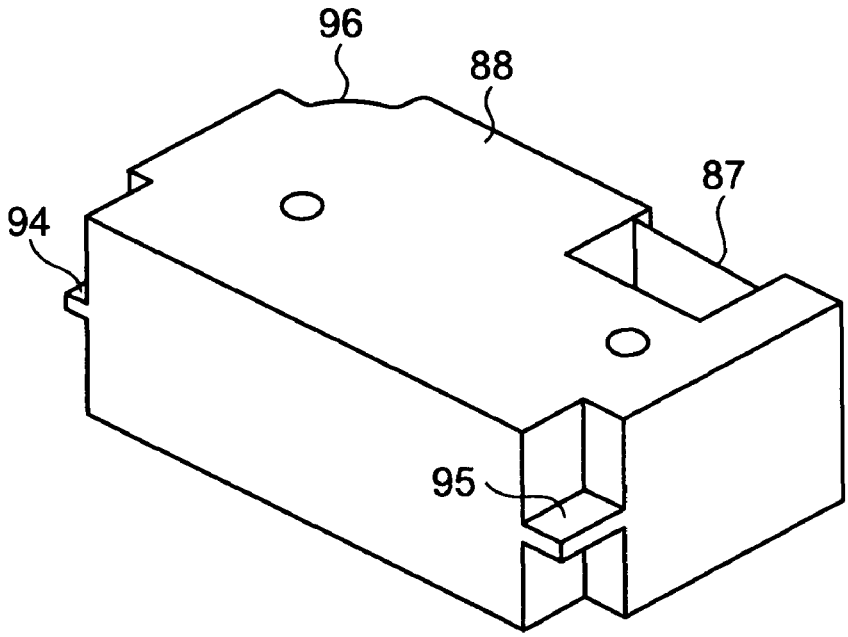

The body case 2 has a cassette receiving section in the form a cavity 6 in which a tape cassette 70 of FIGS. 5A and 5B and a ribbon cassette 85 of FIGS. 6A and 6B can be selectively set or loaded. An openable cover 5 is provided so as to cover the cassette receiving section 6. The tape cassette 70 holds a printing tape 71 and an ink ribbon 72 within a case 73 thereof. The ribbon cassette 85 holds an ink ribbon 87 within a case 88 thereof.

Figure 7:
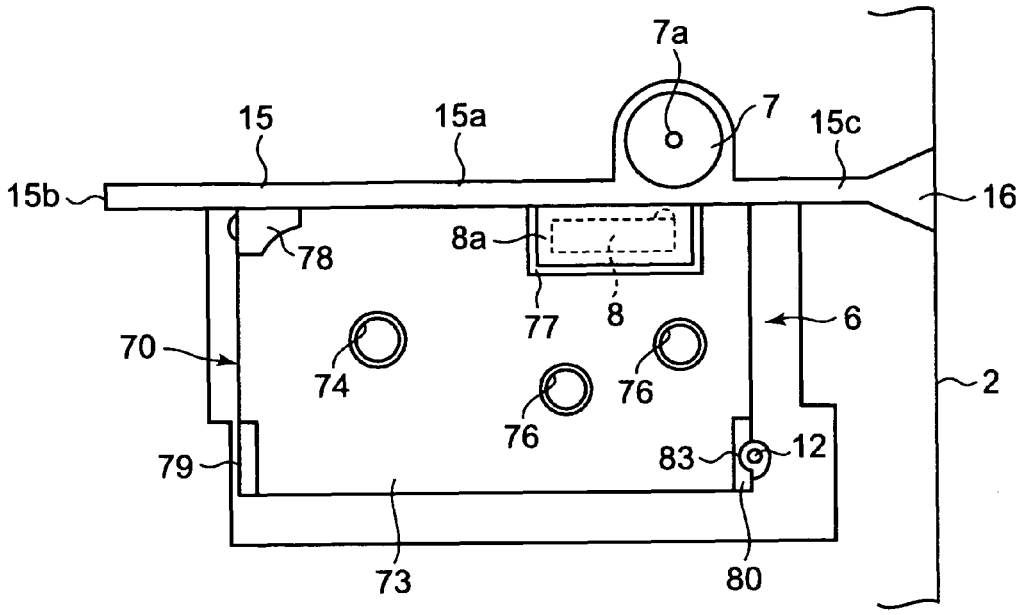
FIG. 7 is a plan view of the printer with a tape cassette set in the cassette receiving section.
Figure 8:
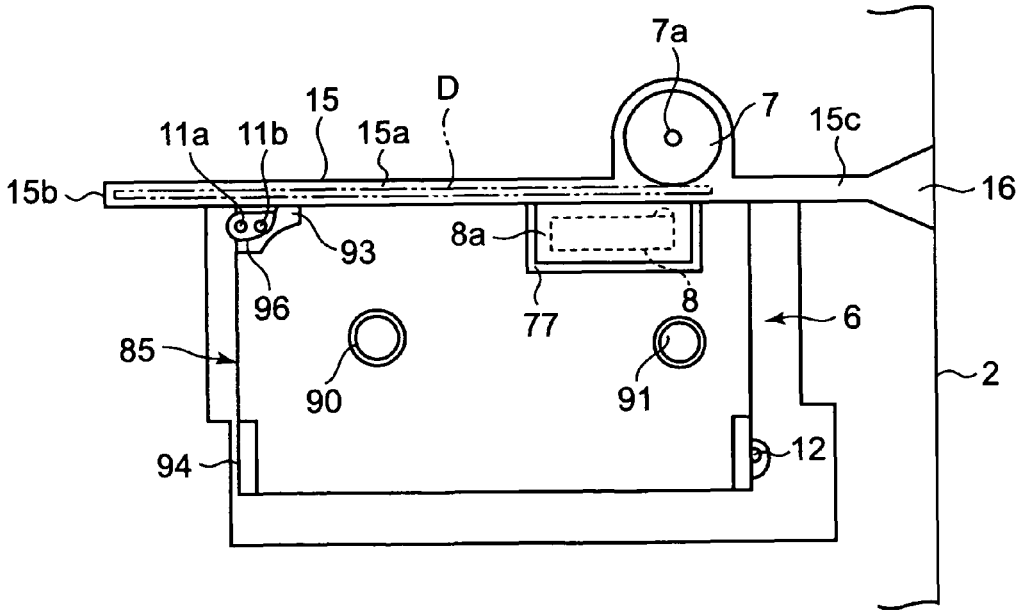
FIG. 8 is a plan view of the printer with a ribbon cassette set in the cassette receiving section.

When a character string is printed on the printing tape 71, a tape cassette 71 is set in the cassette receiving section 6 as shown in FIG. 7. When a character string is printed on the label face of an optical disk D, a ribbon cassette 85 and the optical disk D are set in the cassette receiving section 6, as shown in FIG. 8. The tape cassette 70 and the ribbon cassette 85 have substantially the same form. When the optical disk D is loaded in the cassette receiving section 6, the optical disk D is inserted upstanding into the printer body 1, as shown in FIG. 2.

As shown in FIGS. 3 and 4, a platen roller 7 is provided opposite to a printing or thermal head 8 at a print position within the cassette receiving section 6 such that a straight conveyance path 15 extends widthwise between the platen roller 7 and the thermal head 8. A ribbon winding shaft 9 is also provided in the cassette receiving section 6. When the tape cassette 70 is loaded in the cassette receiving section 6, the platen roller 7 functions as conveying means such that the platen roller 7 rotates around a rotational shaft 7*a*, thereby conveying the printing tape 71 and the ink ribbon 72 of the tape cassette 70 rightward in an superimposed manner between the platen roller 7 and the thermal head 8 in the conveyance path 15 toward the right-hand downstream end of the printer body 1. When a ribbon cassette 85 and an optical disk D are loaded in the cassette receiving section 6, the platen roller 7 will convey the ink ribbon 87 and the optical disk D rightward in the conveyance path in an superimposed manner. The thermal head 8 is provided rotatable within a head cover 8*a*. When the tape cassette 70 is loaded in the cassette receiving section 6, the thermal head 8 prints on the printing tape 71 with the ink ribbon 72. When a ribbon cassette 85 is loaded in the cassette receiving section 6, the thermal head 8 function as printing means that prints on the optical disk D with the ink ribbon 87.

The ribbon winding shaft 9 rewinds parts of the ink ribbons 72 and 87 of the tape and ribbon cassettes 70 and 85, respectively, used for printing into their cassette cases 73 and 88 for collecting purposes. Provided in the cassette receiving section 6 are a plurality of supports 10*a*, 10*b* and 10*c* and an engaging element 10*e* that engages with the tape cassette 70 and ribbon cassette 85 to support them in position. Also, provided on the cassette receiving section 6 are a plurality of (for example, two) cassette detection switches 11*a* and 11*b* that find the presence and type of a tape cassette 70, a ribbon cassette detection switch 12 that detects the presence of a ribbon cassette 85, and a disk sensor 13 that an optical disk D is set in position within the printer body 1 (body case 2).

The widthwise extending straight conveyance path 15 is provided along a rear edge of the cassette receiving section 6 such that it starts at a position spaced somewhat leftward or upstream from the left-hand end point of the rear edge of the cassette receiving section 6 and ends at a downstream right-hand disk-discharge port 15*c* merging into an open end 16 of the printer body 1 (body case 2). The conveyance path 15 is in the form of a groove with a bottom guide 15*a* along which the optical disk D held between the platen roller 7 and the thermal head 8 is guided with the lower edge of the disk in contact with the bottom guide.

Manual cutting means (or cutter) 30 is provided on the body case 2 in the vicinity of the downstream open end 16 to cut a printed part of the printing tape 71, thereby forming a label.

The upstream end of the conveyance path 15 in the printer body 1 functions as a positioning end 15*b* that receives and positions the optical disk D inserted into the printer body 1 through the open end 16. The disk sensor 13 is a transmission type optical sensor, comprising a light emission element and a photodetector, which detects the lowest edge of the upstanding optical disk D at a predetermined position in the conveyance path 15, thereby detecting that the optical disk D is set in position in the cassette receiving section 6.

The cover 5 provided above the body case 2 is hinged at 25 to a rear edge of the top of the printer case 2. A transparent window 20 is provided at a position in the cover 5 where the display 4 can be seen through the window 20 when the cover 5 is closed. The cover 5 has a slit-like inlet 23 through which the optical disk D is inserted into the printer body 1, as shown in FIGS. 2 and 3. The slit-like inlet 23 extends widthwise of the printer body 1 from an upstream position spaced somewhat leftward from the center thereof to a downstream position on the right-hand side thereof where the inlet 23 is open to the outside. The slit-like inlet 23 substantially coincides in position and length with the conveyance path 15 provided in the cassette receiving section 6 on the body case 2 when the cover 5 is closed. The inlet 23 also is open at its downstream end to the outside.

When the optical disk D is inserted upstanding through the open end 16 of the printer body 1 in a state where the cover 5 is closed, the optical disk D moves along the inlet 23 in the cover 5 and the conveyance path 15 and then arrives at the set position in the cassette receiving section 6. At this time, substantially the upper half part of the optical disk D appears above the printer body 1. In printing, the optical disk D is conveyed through the conveyance path 15 from its upstream end toward its downstream end in a state in which the optical disk D is inserted into the inlet 23 during which conveyance the optical disk D is printed. Then, the optical disk D is conveyed to the discharge port 15*c* where the printing operation ends.

FIG. 9 shows the structure of the cutter 30 that cuts away the printed part of the printing tape 71. The cutter 30 comprises a fixed blade 31 and a movable blade 32 which are each provided on a respective one of both sides of the conveyance path 15. The fixed blade 31 is fixed to the body case 2 so as to be upstanding and the movable blade 32 takes the form of an L which is pivoted at 33 in the vicinity of its corner with one branch of the L acting as a support arm 32*a* and with the other arm acting as a cutting blade arm 32*b*. Thus, the L-like movable blade 32 will turn clockwise around the pivot 33 to cooperate with the fixed blade 31, thereby cutting the printed part of the tape 71.

Figure 9A:
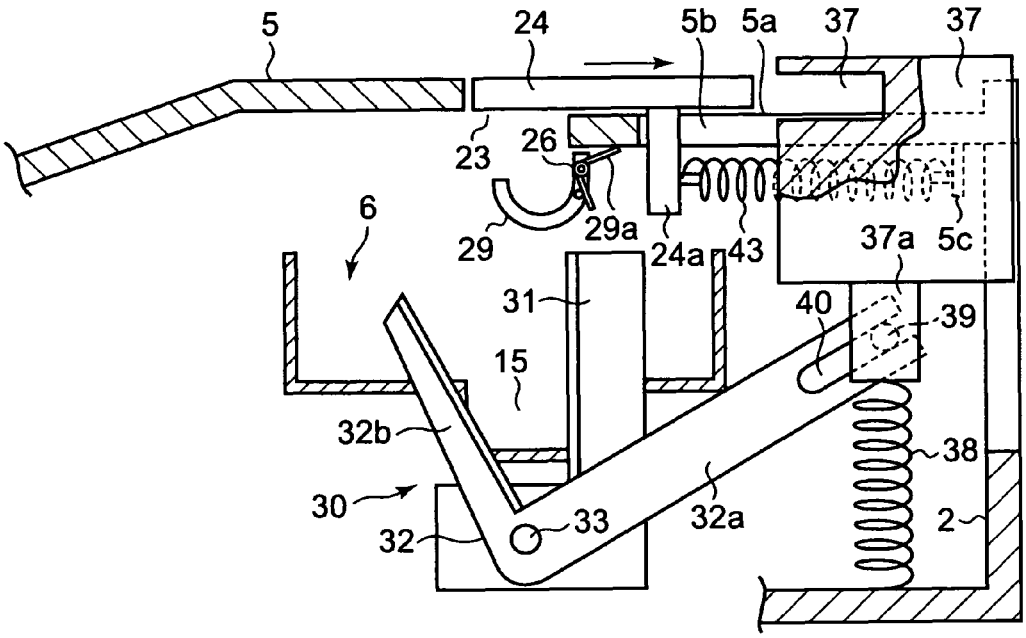
FIGS. 9A and 9B are different fragmentary partly cross-sectional views of the printer involving the cutting means and its surrounding where no optical disk and an optical disk, respectively, are inserted into the printer body.
Figure 9B:
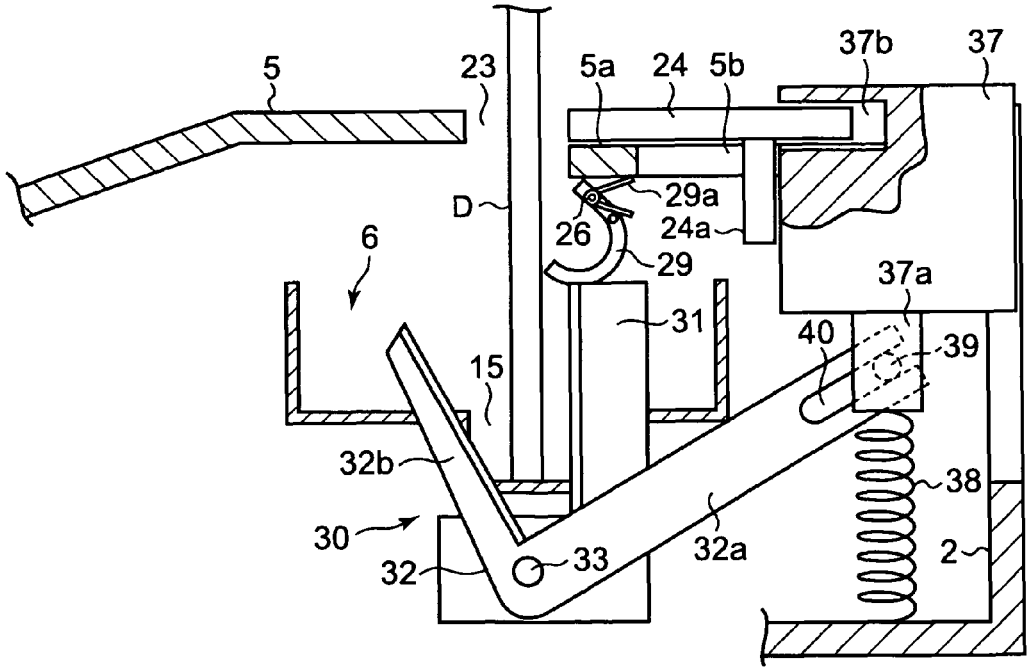

As shown in FIGS. 1-3, in order to operate the movable blade 32, a manually vertically operable operation member (or button) 37 is provided at the rear right-hand corner of the upper surface of the body case 2. As shown in FIGS. 9A-9B, the cutter button 37 has a downward protrusion 37*a* integral with a lower end thereof with a compression spring 38 extending between the downward protrusion 37*a* and the bottom of the body case 2 such that the cutter button 37 normally appears somewhat above the body case 2. The support arm 32*a* of the movable blade 32 has an axial slot 40 at the right-hand end thereof that loosely receives a pin 39 provided on a side of the downward protrusion 37*a* such that the pin 37 can slide along the slot 40. When the cutter button 37 is pushed down, the movable blade 32 turns clockwise around the pivot 33 so as to approach the fixed blade 31, thereby cutting the printed part of the printing tape 71.

A strip-like insertion inlet cover 24 is provided over the cover 5 so as to cover the inlet 23 in the cover 5 and fitted slidably within a recess 5*a* formed on the upper surface of the cover 5. When the inlet cover 24 slides back and forth within the recess 5*a*, the inlet 23 in the cover 5 is opened and closed, respectively.

A compression spring 43 is provided between a downward support 5*c* provided on the lower surface of the cover 5 and a downward protrusion 24*a* provided on the lower surface of the inlet cover 24. The downward protrusion 24*a* extends through a back and forth long slot 5*b* formed in the bottom of the recess 5*a* and extending back and forth in the printer body 1 such that the inlet cover 24 is elastically biased forward on the printer body 1, thereby causing the inlet cover 24 to close the inlet 23 in the cover usually.

As described above, the cutter button 37 of the cutter 30 is disposed adjacent to the rear right-hand corner of the cover 5. The right-hand end portion of the inlet cover 24, provided over the cover 5, extends somewhat rightward beyond the right-hand edge of the cover 5 in the vicinity of the open end 16 so as to form an integral engaging end portion 24*b* with an inclined edge 24*c* that connects the right-hand end of a front shorter side of the inlet cover 24, which is on the right-hand edge of the cover 5, and the right-hand end of a rear longer side of the inlet cover 24 that extends somewhat rightward beyond the right-hand edge of the cover 5. When the inlet cover 24 covers the inlet 23 in the cover 5, the right-hand engaging end 24*b* of the inlet cover 24 is at a position where it can enter a slit-like groove 37*b* provided on an upper part of an adjacent side of the cutter button 37.

When the optical disk D is inserted upstanding into the conveyance path 15 from the open end 16 of the printer body 1, the leading edge of the optical disk D hits the inclined edge 24*c* of the inlet cover 24, thereby moving the inlet cover 24 backward against the resiliency of the spring 4. This causes the engaging end 24*b* to move into the engaging slot 37*b* in the cutter button 37, thereby locking the cutter button 37.

The cover 5 has a J-shaped cross-sectional disk insertion prevention member 29 therebelow that prevents the optical disk D from being inserted wrongly into the inlet 23 in the cover 5 from above. The J-shaped member 29 is supported pivotally around a shaft 26 parallel to the extending inlet 23 in the cover 5 and attached to the cover 5. The J-shaped member 29 is also biased clockwise by a spring 29*a* such that the member 29 usually looks up at the inlet 23 in the cover 5.

The insertion preventing member 29 extends parallel to the extending direction of the inlet 23 in the cover 5 and has a right-hand end with an edge inclined such that the length of the J-shaped member 29 decreases forward, as viewed from above. When the optical disk D is inserted upstanding into the printer body from the open end 16 of the printer body 1 along the conveyance path 15 so as to come into contact with the bottom of the conveyance path 15, the optical disk D hits at its leading edge on the inclined edge of the insertion prevention member 29. This causes the insertion prevention member 29 to turn counterclockwise against the resiliency of the spring 29*a* around the pivot 26, thereby moving away from and opening the space below the slit-like inlet 23 in the cover 5. Hence the optical disk D is allowed to be inserted into the cassette receiving section 6.

When the inlet cover 24 is manually slid backward on the printer body 1, thereby opening the inlet 23 in the cover 5, and then the optical disk D is wrongly tried to be inserted into the inlet 23 from above the printer body 1, the optical disk D hits the insertion prevention member 29. Thus, the insertion prevention member 29 stops the optical disk D, thereby preventing the optical disk D from being further inserted into the printer body 1.

As described above, in the printer the platen roller 7 and the thermal head 8 are provided in the cassette receiving section 6 such that the conveyance path 15 extends between the platen roller 7 and the thermal head 8. When an optical disk D is printed, the ink ribbon 87 of the ink ribbon cassette 85 loaded in the cassette receiving section 6 is conveyed upstanding from the upstream side to the downstream side in the conveyance path.

When the optical disk D is inserted upstanding into the printer body 1 from its open end 16 along the conveyance path 15, there is no possibility that the optical disk D will catch the ink ribbon 87 because the ink side of the ink ribbon 87 faces the label (or printing) face of the optical disk D and the conveying or feeding direction of the ink ribbon 87 is parallel to the inserting direction of the optical disk D. In other words, the optical disk D is inserted smoothly into the printer body 1 in parallel to the feeding direction of the ink ribbon 87 and hence the ink ribbon 87 is neither twisted nor damaged.

In contrast, when the optical disk D is inadvertently inserted upstanding into the printer body 1 from above through the inlet 23 in the cover 5, the ink side of the ink ribbon 87 faces the label side of the optical disk D and the conveying or feeding direction of the ink ribbon 87 becomes perpendicular to the inserting direction of the optical disk D. In this case, the optical disk D can catch the ink ribbon 87 unless the insertion prevention member 29 is provided. In the inventive printer 1, the insertion prevention member 29 is provided opposite to the inlet 23 in the cover 5, thereby preventing the optical disk D from being inserted in the direction perpendicular to the conveying or feeding direction of the ink ribbon 87 through the inlet 23.

Referring to FIGS. 5 and 6, the tape cassette 70 and the ribbon cassette 85 to be loaded into the cassette receiving section 6 will be described furthermore. As shown in FIGS. 5A and 5B, the tape cassette 70 comprises a cassette case 73 which contains a roll of printing tape 71 with a core 74, a roll of unused ink ribbon 72 with a core 75, and a hollow ribbon winding core 76 to rewind a used ink ribbon therearound. The cassette case 73 has a concavity 77 formed on a side thereof into which the thermal head 8 will be inserted. When the printing tape 71 and the ink ribbon 72 are fed from the cassette case 73 into the concavity 77, the ink ribbon 72 used for printing is rewound by the hollow winding core 76 and then returns into the cassette case 73.

The cassette case 73 has supported corners 78, 79 and 80 that will be supported by corresponding supports 10*a*, 10*b* and 10*c* provided within the cassette receiving section 6. In order to detect the type of tape cassette case loaded, in this example the supported corner 78 has therein two cutouts 81 and 82, shown by broken lines in FIG. 5A, the number of which depends on the type of cassette to be used, thereby receiving therein and failing to turn on tape cassette detection switches 11*a* and 11*b* provided on the cassette receiving section 6. Thus, the type of the cassette case is known. Herein, four different types of supported corners are used, i.e., one with a cutout 81, one with a cutout 82, one with both of those cutouts, and one with none of them. For example, if a tape cassette case having a supported corner 78 with the cutout 81 is loaded into the cassette receiving section 6, the switch 11*a* provided within the receiving section 6 is received within the cutout 81 and is not turned on. However, if the supported corner 78 has no cutout to receive the switch 11*b*, the supported corner 78 will hit and turn on the switch 11*b*. This implies that the type of tape cassette case loaded can be determined depending on which switches are switched on and off, respectively. The supported part 80 has a cutout 83 corresponding to the ribbon cassette detection switch 12.

As shown in FIGS. 6A and 6B, the ink cassette 85 has a cassette case 88 which contains a roll of unused ink ribbon 87 with a core 90, and a hollow ribbon winding core 91 around which a used ink ribbon part 87 should be wound. The cassette case 88 has a concavity 92 provided on a relevant side thereof into which the thermal head 8 will be inserted. The ink ribbon 87 is fed from the cassette case 88 into the concavity 92 and a used ink ribbon part is then wound by the winding core 91 within the cassette case 88 while returning into the case 88.

The ink cassette case 88 has supported corners 93, 94 and 95 corresponding to the supports 10*a*, 10*b* and 10*c*, respectively. The supported corner 93 has a cutout 96 corresponding to tape cassette detection switches 11*a* and 11*b* to maintain these switches in an off state. A supported part 95 corresponding to the ribbon cassette detection switch 12 has no cutout, thereby turning on the switch 12.

When a tape cassette 70 is loaded into the cassette receiving section 6 within the printer, the thermal head 8 is disposed in the concavity 77 in the cassette case 73. Simultaneously, the ribbon winding shaft 9 is fitted into the hollow ribbon-winding core 76. When the ribbon cassette 85 is loaded into the cassette receiving section 6 within the printer body 1, the thermal head 8 is disposed within the concavity 92 in the cassette case 88, and the hollow ribbon-winding shaft 9 is inserted into the ribbon winding core 91.

When information such as a title is printed on the label face of an optical disk D in this printer, the cover 5 is opened and a ribbon cassette 85 is loaded in the cassette receiving section 6, and then the cover 5 is closed, as shown in FIG. 3. Then, as shown in FIGS. 2 and 8, the optical disk D is inserted upstanding with its label side facing this side into the printer body 1 through its open end 16, and then is moved along the conveyance path 15 with the lower end of the optical disk D received within the conveyance path 15 and the middle portion of the optical disk D received within the inlet 23 in the cover 5. Thus, the optical disk D is finally received in place within the conveyance path 15. When the optical disk D is inserted into the inlet 23 in the cover 5, the inlet cover 24 is pushed by the optical disk D, thereby moving on the printer body 1 against the resiliency of the spring 43 backward and the engaging end 24*b* of the inlet cover 24 moves into and is locked in the slot 37*b* in the cutter button 37. This disables the cutter button 37 and hence the cutter 30.

When the optical disk D is printed and then taken out of the printer body 1, and more particularly, the open end 16, the inlet cover 24 is moved forward on the printer body 1 by the resiliency of the spring 43, which causes the engaging end 24*b* of the inlet cover 24 to move away from the slot 37*b* in the cutter button 37, thereby unlocking the cutter button 37 and causing the inlet cover 24 to return to its original position where the inlet cover 24 closes the inlet 23 in the cover 5.

When a printing tape 71 of the tape cassette 70 loaded in the cassette receiving section 6 is printed, the inlet cover 24 need not be opened because the whole tape cassette 70 is received within the cassette receiving section 6 unlike the printing of the optical disk D. Thus, the inlet cover 24 is held at a position where the inlet cover closes the inlet 23 by the resiliency of the spring 43. Thus, the cutter button 37 is operable, in which state the printing tape 71 of the tape cassette 70 is printed. Then, when the printed part of the tape 71 is discharged out of the open end 16 of the printer body 1 and then stopped, the cutter button 37 can be manually pushed down against the resiliency of the spring 38 to turn the movable blade 37, thereby cutting the printed part of the tape 71 with the aid of the fixed blade 31, thereby forming a label.

As described above, according to the printer of the first embodiment, when the optical disk D is inserted into the printer body 1 through the open end 23 in the printer body 1 and then disposed in the conveyance path 15, this operation causes the inlet cover 24 and the inlet 23 to be moved and opened, respectively. In this case, the cutter button 37 is locked by the engaging end 24*b* of the inlet cover 24, thereby disabling the cutter 30. Thus, even if the cutter button 37 is inadvertently pressed down when the optical disk D is inserted into the printer body 1 for printing purposes, the movable blade 32 does not operate, thereby damaging no optical disk D.

Figure 10:
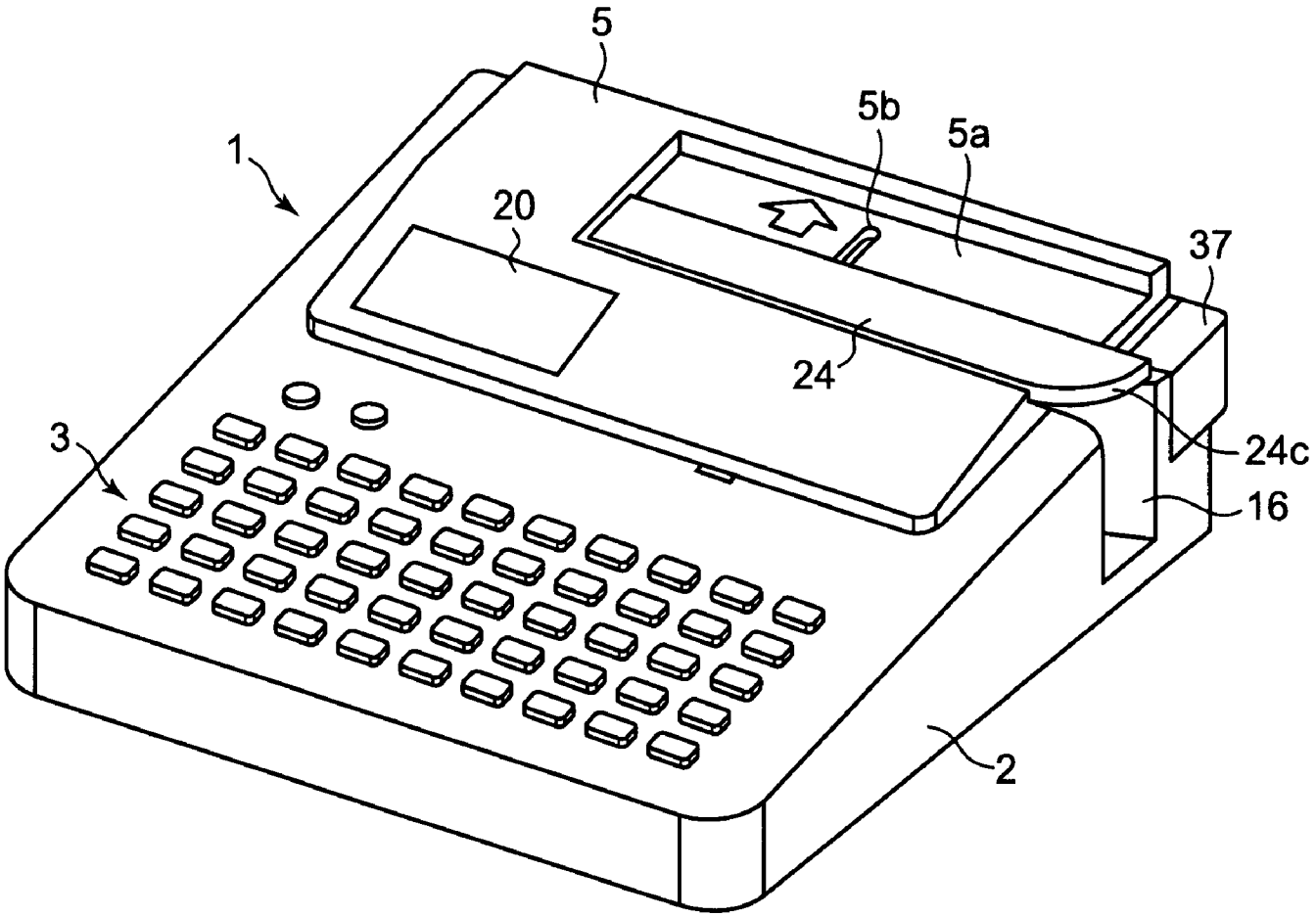
FIG. 10 is a perspective view of a whole printer according to a second embodiment.
Figure 11:
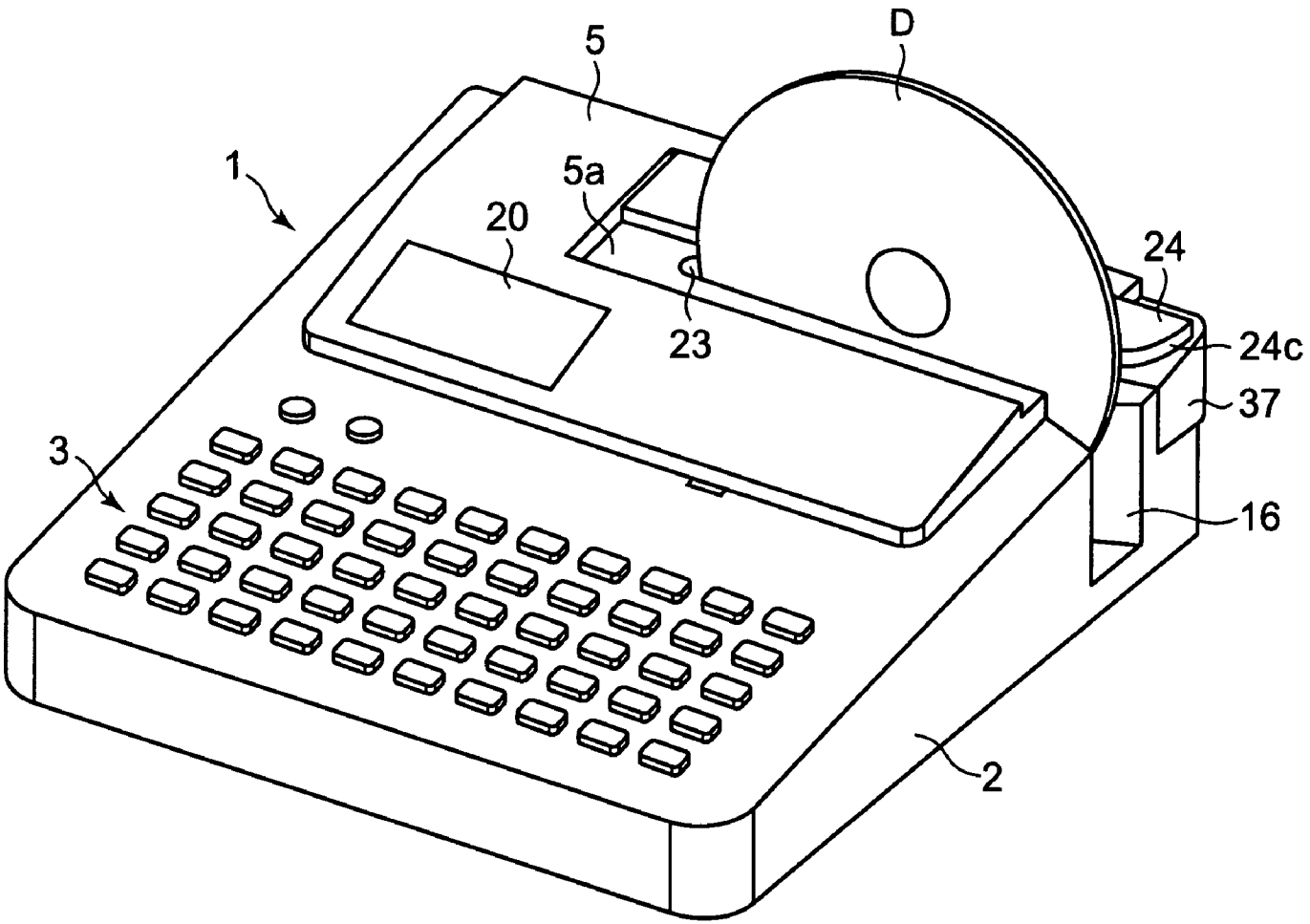
FIG. 11 is a perspective view of the FIG. 10 printer with an optical disk set in the printer.
Figure 12A:
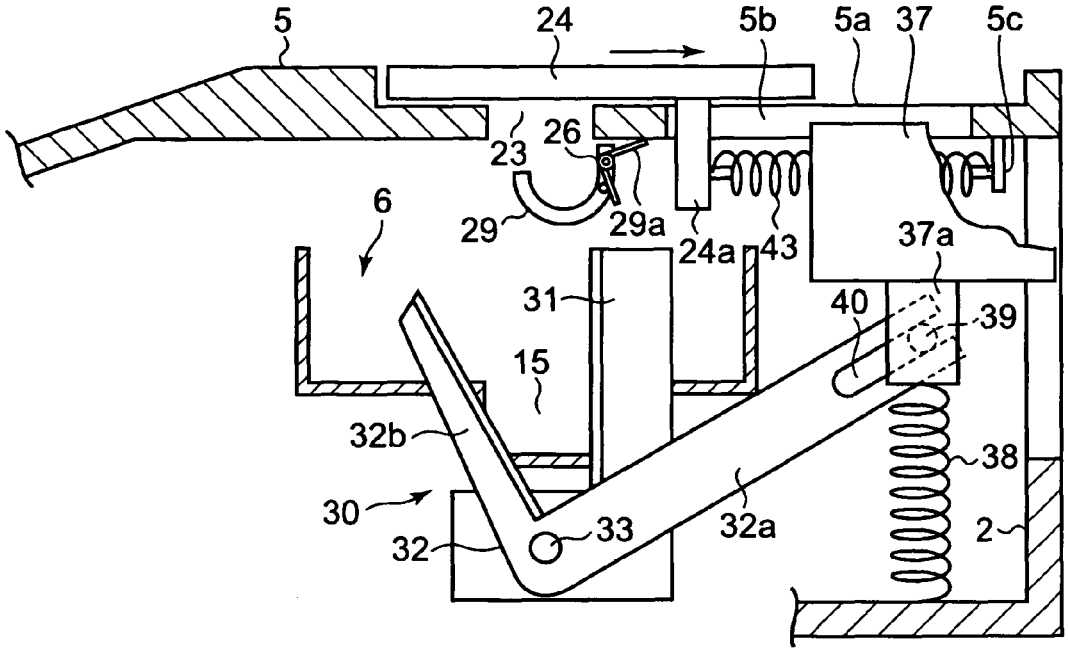
FIGS. 12A and 12B are different fragmentary partly cross-sectional views of the printer involving the cutting means and its surrounding where no optical disk and an optical disk, respectively, are inserted into the printer body.

FIGS. 10-12 show a second embodiment of the printer according to the present invention. As in the first embodiment, the cutter button 37 of the cutter 30 of this embodiment is movable vertically relative to the body case 2 and biased upward by the resiliency of the compression spring 38. In this second embodiment, the cutter button 37 is normally kept substantially flush with the body case 2. When the cutter button 37 is manually pressed down, the movable blade 37 is turned so as to approach the fixed blade 31. Normally, as shown in FIGS. 10 and 12A, the inlet cover 24 is biased forward on the printer body 1 by the resiliency of the compression spring 43, thereby being held at a position where the cover 24 closes the inlet 23.

Figure 12B:
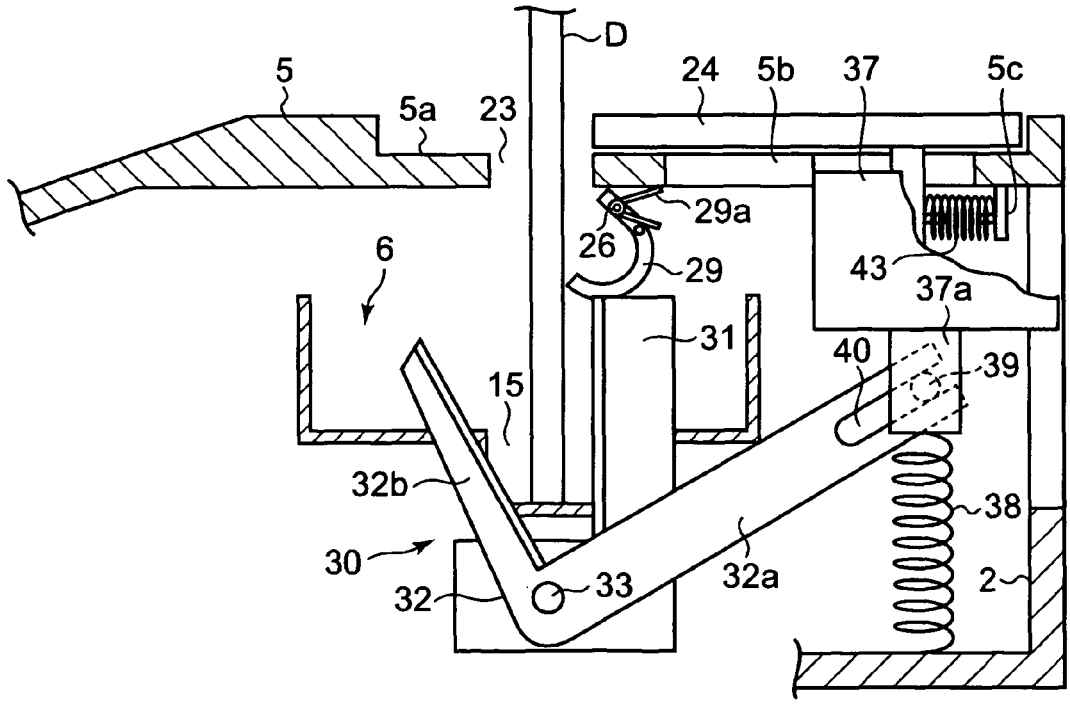

In this second embodiment, as shown in FIG. 11, when the optical disk D is inserted upstanding into the printer body 1 from its open end 16, the optical disk D hits the inclined edge 24*c* of the inlet cover 24, which moves the inlet cover 24 against the resiliency of the spring 43 backward on the printer body 1 to a position where the inlet cover 24 overlaps at its right-hand end with the upper end of the cutter button 37, thereby covering the cutter button 37, as shown in FIGS. 11 and 12B. Thus, the user cannot manually press the cutter button 37 down and hence operate the cutter 30.

When the optical disk D is printed and then taken out of the printer body 1, and more particularly, the open end 23, the inlet cover 24 is moved forward on the printer body 1 by the resiliency of the spring 43, which causes the engaging end 24*b* of the inlet cover 24 to move away from above the cutter button 37, thereby exposing the top of the cutter button 37 and causing the inlet cover 24 to return to its original position where the inlet cover 24 closes the inlet 23 in the cover 5.

When a printing tape 71 of the tape cassette 70 loaded in the cassette receiving section 6 is printed, the inlet cover 24 need not be opened because the whole tape cassette 70 is received within the cassette receiving section 6 unlike the printing of the optical disk D. Thus, the inlet cover 24 is held at a position where the inlet cover closes the inlet 23 by the resiliency of the spring 43. Thus, the cutter button 37 is operable, in which state the printing tape 71 of the tape cassette 70 is printed. Then, when the printed part of the tape 71 is discharged out of the open end 16 of the printer body 1 and then stopped, the cutter button 37 can be manually pushed down against the resiliency of the spring 38 to turn the movable blade 37, thereby cutting the printed part of the tape 71 with the aid of the fixed blade 31, thereby forming a label.

As described above, also with the printer of the second embodiment, when the optical disk D is inserted through the open end 23 of the printer body 1 into the conveyance path 15 within the printer body 1 for printing purposes, the inlet cover 24 is moved so as to open the inlet 23 in the cover 5 and the cutter button 37 is covered with the end of the inlet cover 24. Thus, the cutter 30 becomes inoperable, thereby causing no trouble such as operates the cutter button 37 inadvertently and hence damages the optical disk D.

Figure 13:
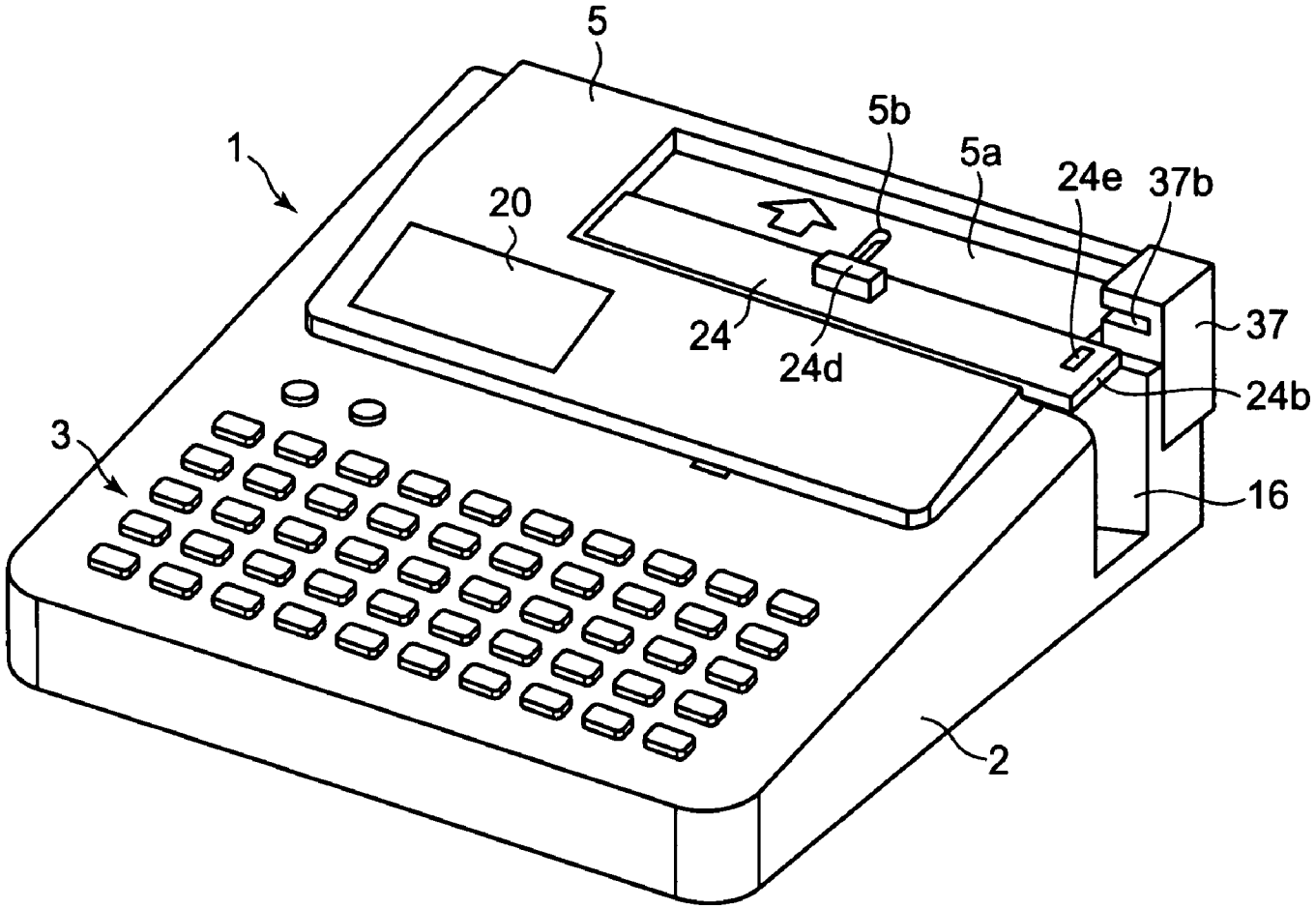
FIG. 13 is a perspective view of a printer according to a third embodiment.
Figure 14:
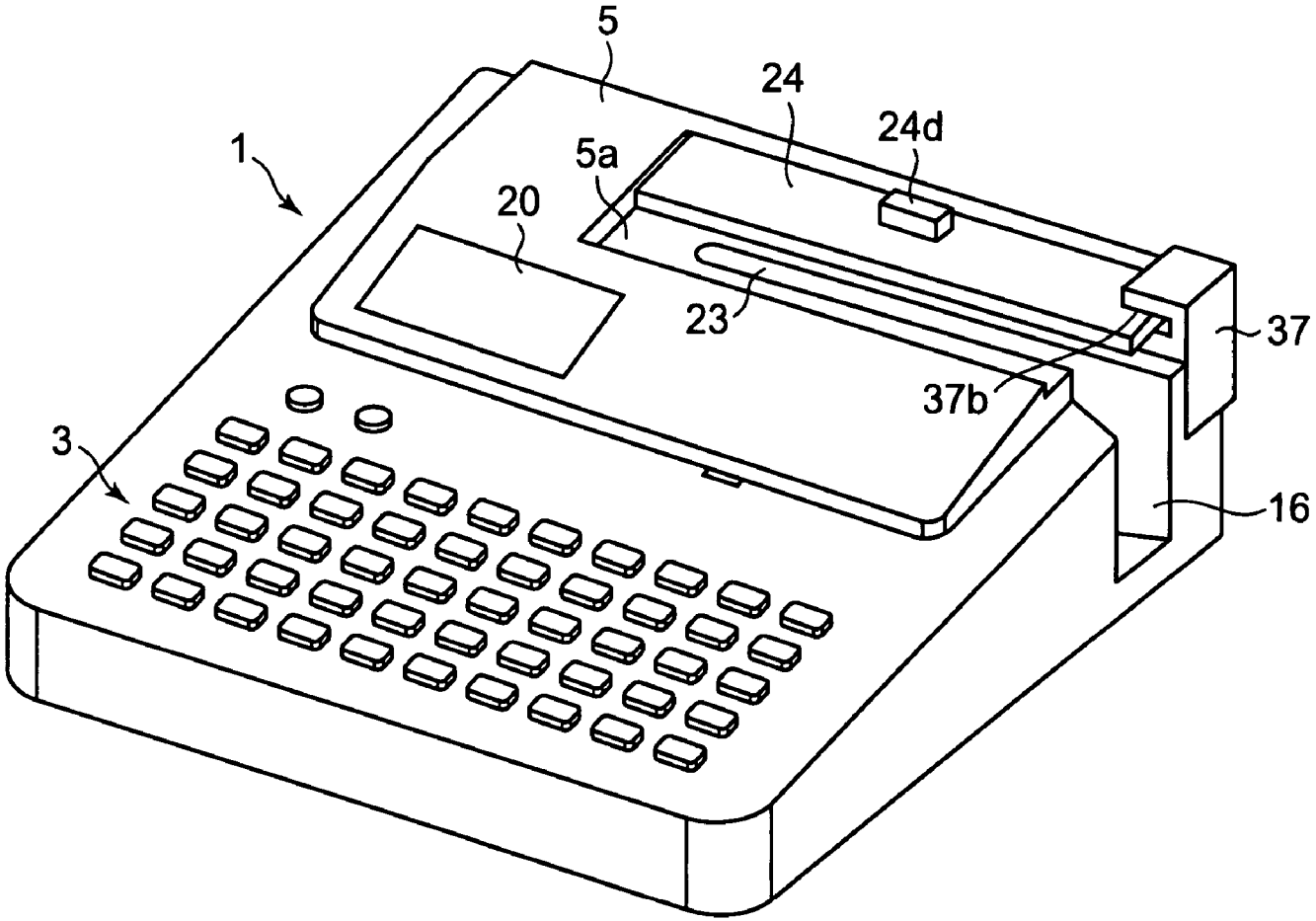
FIG. 14 is a perspective view of the printer with its inlet cover moved backward.

FIGS. 13-15 show a third embodiment in which as in the first embodiment the cutter button 37 is movable vertically relative to the body case 2. The cutter button 37 is elastically pushed upward by a compression spring 38 such that the cutter button 37 extends a given height above the body case 2. The cutter button 37 has a slit-like slot 37*b* on a side of an upper portion thereof so as to receive the end 24*b* of the inlet cover 24. In the third embodiment the inlet cover 24 is received manually sidable back and forth within a recess 5*a* of the cover 5 on the printer body 1. A manual knob 24*d* is provided at the midpoint of the length of the inlet cover 24 to move the same. A raise 24*e* is formed on the top of the engaging end 24*b* of the inlet cover 24 to lightly push the inner upper surface of the slot 37*b*, thereby positioning the inlet cover 24, when the engaging end 24*b* moves into the slot 37*b* in the cutter button 37.

Figure 15A:
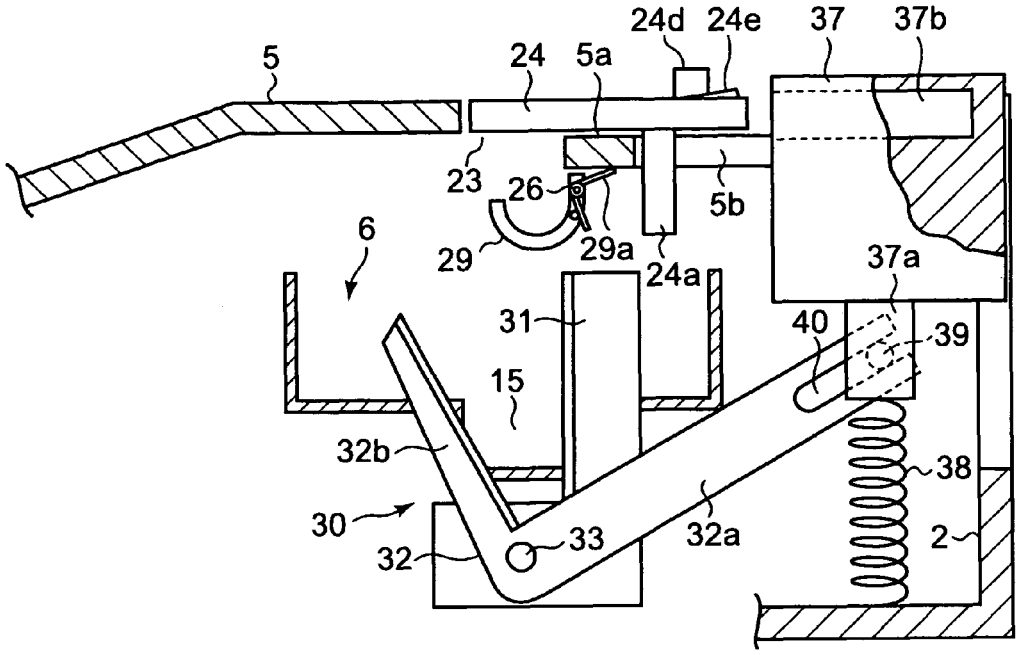
FIGS. 15A and 15B are views of the printer according to the third embodiment similar to FIGS. 12A and 12B, respectively.
Figure 15B:
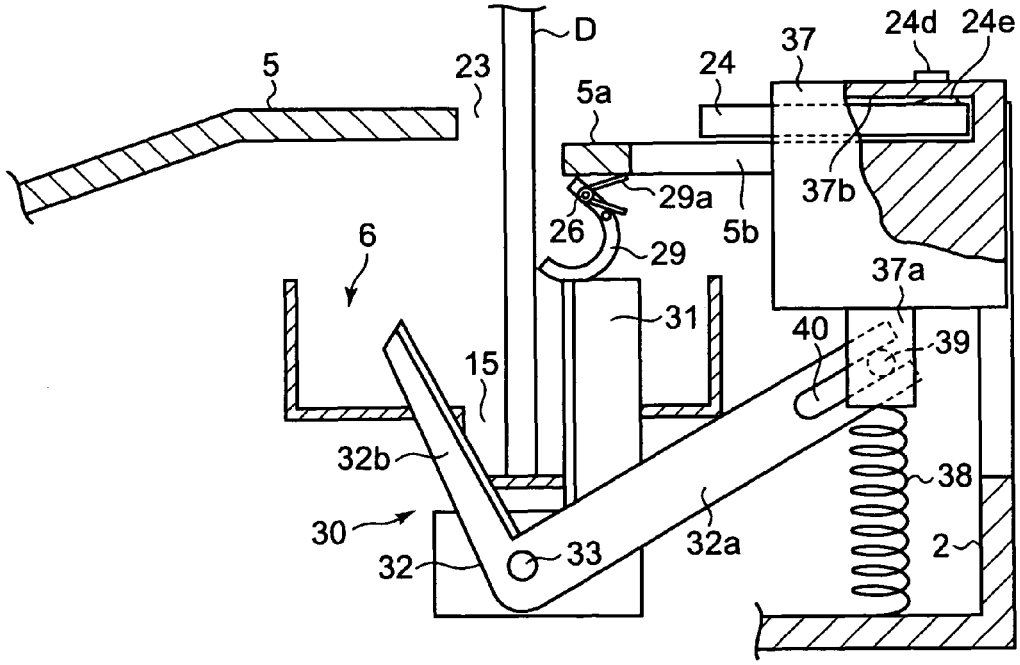

As shown in FIGS. 13 and 15A, usually, the inlet cover 24 is held at a position where it closes the inlet 23 in the cover 5. When an optical disk D is printed, the inlet cover 24 is slid backward on the printer body 1 by moving the knob 24*d* manually, thereby opening the inlet 23, as shown in FIGS. 14 and 15B. At this time, the engaging end 24*b* of the inlet cover 24 is engaged in the slot 37*b* in the cutter button 37, thereby locking or disabling the cutter button 37 and hence the cutter 30. At this time, the raise 24*a* on the inlet cover 24 lightly presses the inner upper surface of the slot 37*b*, thereby positioning the inlet cover 24 there.

When the optical disk D is printed and then taken out of the printer body 1, the inlet cover 24 is moved forward on the printer body 1, which causes the engaging end 24*b* of the inlet cover 24 to move away from the slot 37*b* in the cutter button 37, thereby unlocking the cutter button 37 and causing the inlet cover 24 to return to its original position where the inlet cover 24 closes the inlet 23 in the cover 5.

In tape printing, the cover 5 is opened, a tape cassette 70 is loaded in the cassette receiving section 6 and then the cover 5 is closed. In this case, unlike the disk printing, the inlet cover 24 need not be opened and hence left at a position where the inlet cover 24 closes the inlet 23. In this state, the printing tape 71 of the tape cassette 70 is printed. Since in this case the inlet cover 24 is at the position where it closes the inlet 23, the cutter button 37 is operable. Thus, when the printed part of the tape 71 is discharged out of the open end of the printer body 1 and then stopped, the cutter button 37 can be manually pushed down against the resiliency of the spring 37 to turn the movable blade 32 against the fixed blade, thereby cutting the printed part away from the tape 71 as a label.

As described above, according to the printer of the third embodiment, when in disk printing the inlet cover 24 is moved manually backward on the printer body 1 to open the inlet 23, the cutter button 37 is locked by the engaging end 24*b* of the inlet cover 24, thereby disabling the cutter 30. Thus, when the optical disk D is printed in the printer body 1, the movable blade 32 does not operate, thereby damaging no optical disk even when the cutter button 37 is advertently pushed down manually.

Figure 16:
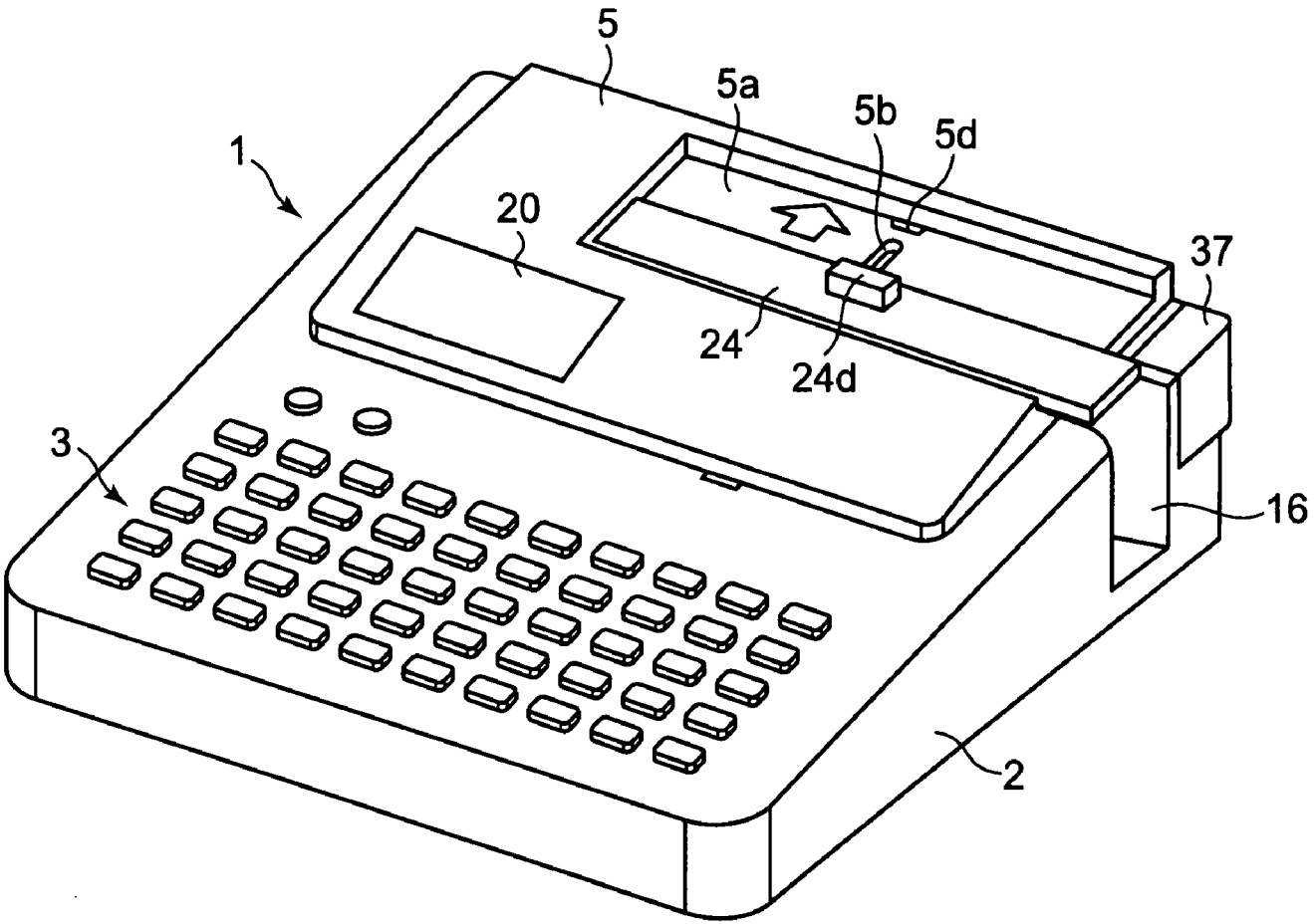
FIG. 16 is a perspective view of a printer according to a fourth embodiment.
Figure 17:
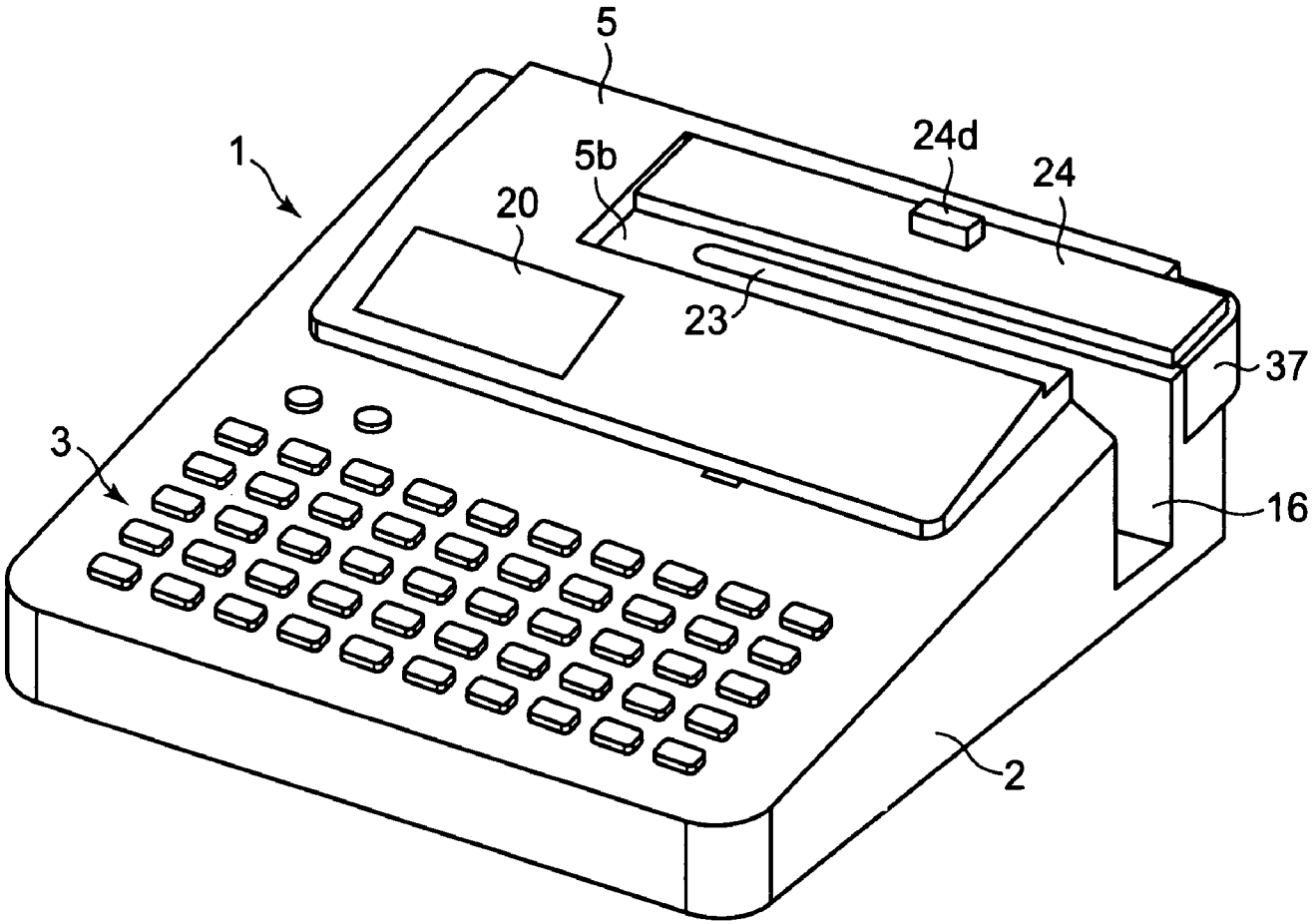
FIG. 17 is a perspective view of the printer with its slit-like inlet cover moved backward.

FIGS. 16-18 show a fourth embodiment in which as in the second embodiment the cutter button 37 is movable vertically relative to the body case 2. The cutter button 37 is elastically pushed upward by a compression spring 38 such that the cutter button 37 is flush with the body case 2. As in the third embodiment the inlet cover 24 is received manually slidable back and forth within a recess 5*a* of the cover 5 on the printer body 1. A manual knob 24*d* is provided at the midpoint of the length of the inlet cover 24 to move the same. An elastically changeable pawl 24*f* is provided integral with the back edge of the inlet cover 24 so as to be engageable in a recess 5*d* formed on the bottom of the recess 5*a* to which the inlet cover 24 is fitted.

Figure 18A:
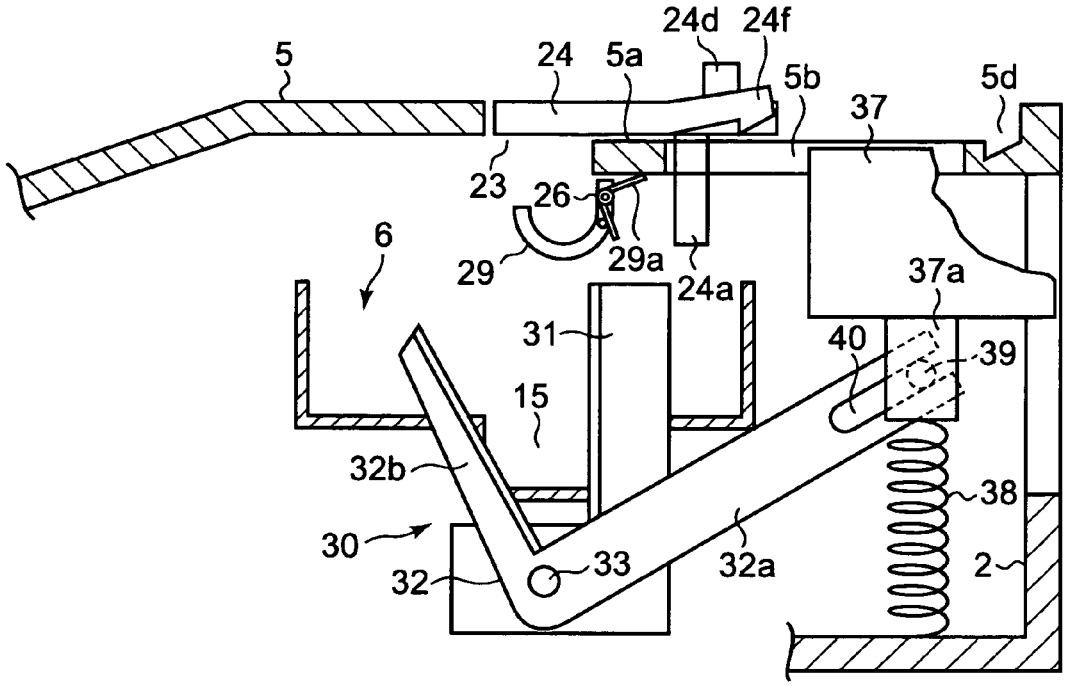
FIGS. 18A and 18B are views of the printer according to the fourth embodiment similar to FIGS. 12A and 12B, respectively.
Figure 18B:
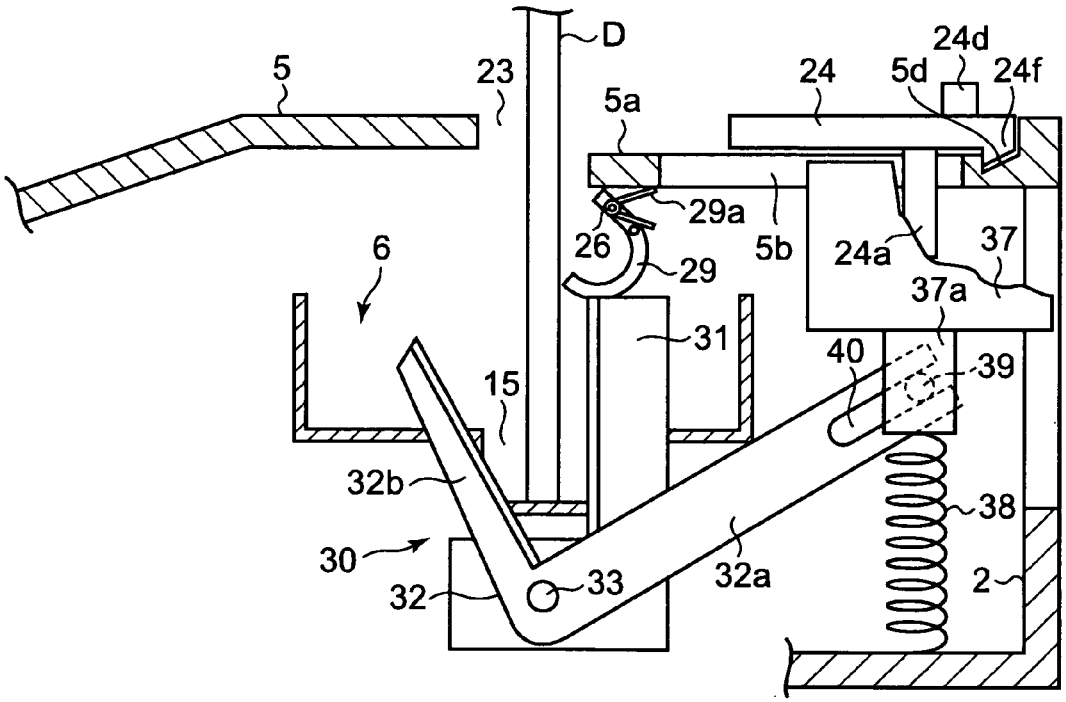

As shown in FIGS. 16 and 18A, usually, the inlet cover 24 is held at a position where it closes the inlet 23 in the cover 5. When an optical disk D is printed, the inlet cover 24 is slid backward on the printer body 1 by moving the knob 24*d* manually, thereby opening the inlet 23, as shown in FIGS. 17 and 18B. At this time, the right-hand end portion of the inlet cover 24 overlies the cutter button 37, thereby disabling the cutter button and hence the cutter 30, respectively. When the inlet cover 24 moves to the position where it covers the top of the cutter button 37, the pawl 24*f* is engaged in the recess 5*d*, thereby positioning the inlet cover 24 there.

After printing, the optical disk D is taken out of the body 1 and then the pawl 24*f* is disengaged manually from the recess 5*d*. Then, the inlet cover 24 is slid forward on the printer body 1. This causes the engaging end 24*b* of the inlet cover 24 to be moved away from the cutter button 37, thereby opening the top of the cutter button 37. This also causes the inlet cover 24 to return to its original position, thereby closing the inlet 23 in the cover 5.

In tape printing, the cover 5 is opened, a tape cassette 70 is loaded in the cassette receiving section 6 and then the cover 5 is closed. In this case, unlike the disk printing the inlet cover 24 need not be opened and hence left at a position where the inlet cover 24 closes the inlet 23. In this state, the printing tape 71 of the tape cassette 70 is printed. Since in this case the inlet cover 24 is at the position where it closes the inlet 23, the cutter button 37 is operable. Thus, when the printed part of the tape 71 is discharged out of the open end 16 of the printer body 1 and then stopped, the cutter button 37 can be manually pushed down against the resiliency of the spring 38 to turn the movable blade 32 against the fixed blade, thereby cutting the printed part away from the tape 71 as a label.

As described above, according to the printer of the fourth embodiment, when in disk D printing the inlet cover 24 is moved manually backward on the printer body 1 to open the inlet 23, the cutter button 37 is covered by the engaging end 24*b* of the inlet cover 24, thereby disabling the cutter 30. Thus, when the optical disk D is printed in the printer 1, there occurs no trouble such as wrongly operates the cutter button 37, thereby damaging the optical disk D.

Figure 19:
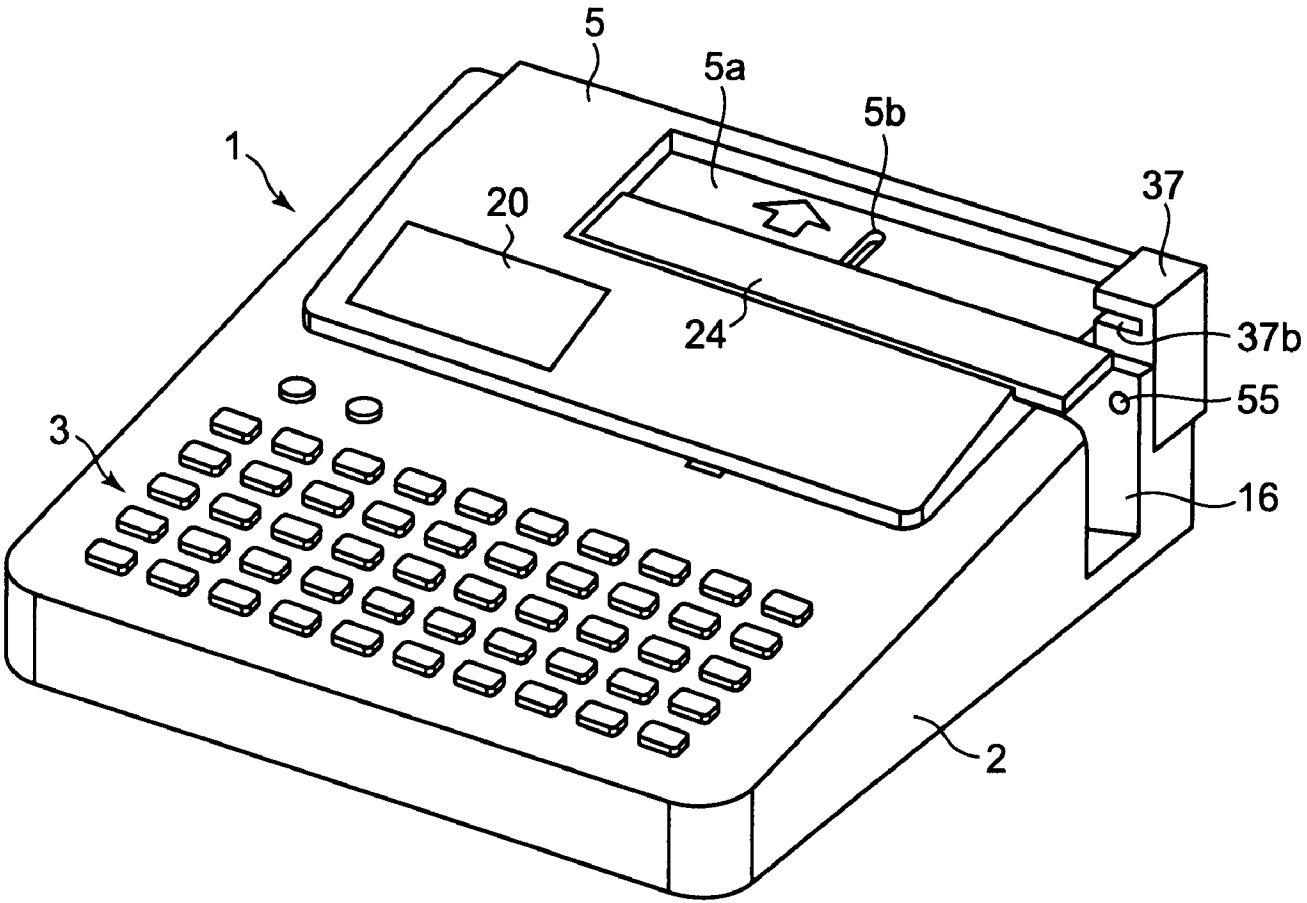
FIG. 19 is a perspective view of a printer according to a fifth embodiment of the present invention.

FIGS. 19-20 show a fifth embodiment in which as in the first and third embodiments the cutter button 37 is movable vertically relative to the body case 2. The cutter button 37 is elastically pushed upward by a compression spring 38 such that the cutter button 37 extends a given height above the body case 2. The cutter button 37 has a slit-like slot 37*b* on a side of an upper portion thereof so as to receive the end 24*b* of the inlet cover 24. The inlet cover 24 has a protrusion 24*a* provided on a lower surface thereof protruding downward through a back and forth long slot 5*b* formed in the bottom of the recess 5*a*.

In the fifth embodiment, a solenoid 50 is attached to the lower surface of the cover 5 for driving the inlet cover 24. The solenoid 50 includes a plunger 51 that can move back and forth relative to the printer body 1 and that has a back end connected to the downward protrusion 24*a* of the inlet cover 24. The plunger 51 is biased forward by the resiliency of a spring (not shown) relative to the printer body 1 so as to be placed normally at a retracted position thereof. An optical sensor 55 is provided at an upper position on a vertical side of the open end 16 of the printer body 1. The optical sensor 55 is, for example, an optical transmission type sensor that optically detects an optical disk D loaded in the cassette receiving section 16 and sends a detection signal to a controller (not shown). It is noted that the optical sensor 55 is disposed at the upper position on the vertical side of the open end 16 through which the optical disk D is inserted, where only the optical disk D is detectable, and in front of which the printed part of the tape 71 does not pass.

Figure 20A:
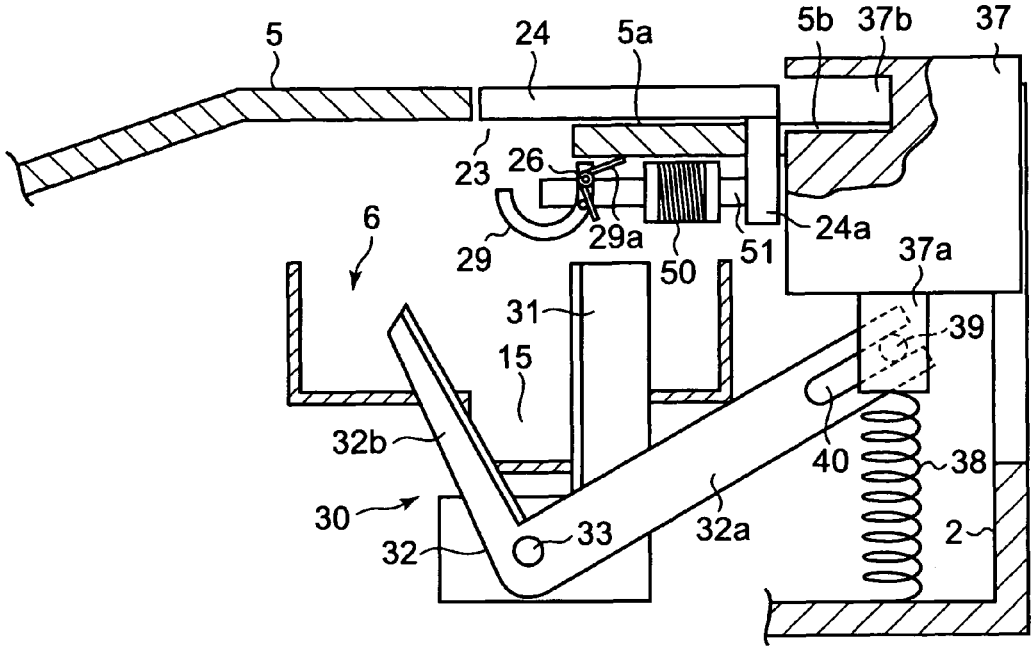
FIGS. 20A and 20B are views of the printer according to the fifth embodiment similar to FIGS. 12A and 12B, respectively.
Figure 20B:
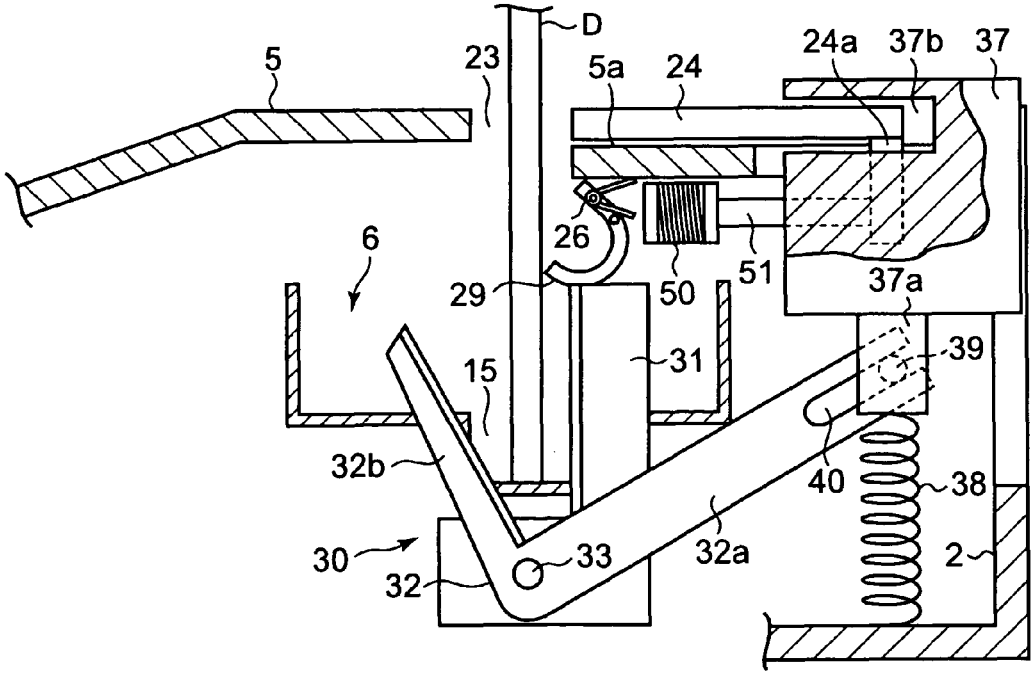

As shown in FIGS. 19 and 20A, the inlet cover 24 connected to the plunger 51 of the solenoid 50 is normally held at a position where the inlet cover 24 closes the inlet 23 in the cover 5. When an optical disk D is loaded in the cassette receiving section 16 for printing purposes, the optical sensor 55 senses the optical disk D and sends a detection signal to the controller, which energizes the solenoid 50 based on the signal, thereby moving the plunger 51 along with the inlet cover 24 backward on the printer body 1, as shown in FIG. 20B. This causes the inlet 23 in the cover 5 to open, thereby allowing the optical disk D to be set into the inlet 23. In addition, the engaging end 24*b* of the inlet cover 24 moves into the slot 37*b* in the cutter button 37, thereby locking or disabling the cutter button 37.

When after printing the optical disk D is taken out of the cassette receiving section 16, the optical sensor 55 detects this operation, and produces a detection signal, which causes the controller to stop the energization of the solenoid 50. Thus, the plunger 51 moves along with the inlet cover 24 forward on the printer body 1 by the resiliency of a spring (not shown). This causes the engaging end 24*b* of the inlet cover 24 to be disengaged from the slot 37*b* in the cutter button 37, thereby unlocking the cutter button 37 and returning the inlet cover 24 to its original position where the inlet cover 24 closes the inlet 23 in the cover 5.

In tape printing, the cover 5 is opened, a tape cassette 70 is loaded in the cassette receiving section 6 and then the cover 5 is closed. Thus, the optical sensor 55 on the wall of the open end 16 does not operate and the inlet cover 24 is held at the position where the inlet cover 24 closes the inlet 23. In this state, the printing tape 71 of the tape cassette 70 is printed. Since in this case the inlet cover 24 is at the position where it closes the inlet 23, the cutter button 37 is operable. Thus, when the printed part of the tape 71 is discharged out of the open end 16 of the printer body 1 and then stopped, the cutter button 37 can be manually pushed down against the resiliency of the spring 38 to turn the movable blade 32 against the fixed blade, thereby cutting the printed part away from the tape 71 as a label. Since in discharge the printed part of the tape 71 passes through the open end 16 so as to avoid the point where the optical sensor 55 is disposed, the optical sensor does not operate.

As described above, according to the printer of the fifth embodiment, when the optical disk D is inserted into the open end 16 for printing purposes, the inlet cover 24 is moved by the solenoid 50 backward on the printer body 1, thereby opening the inlet 23 and locking the cutter button 37 with the engaging end 24*b* of the inlet cover 24 and hence disabling the cutter 30. Thus, in printing, there occurs no trouble such as damages the optical disk D due to an advertent operation of the cutter button 37.

FIG. 21 shows a sixth embodiment. Like the fifth embodiment, in this embodiment an optical sensor is provided at the open end of the printer body 1 as optical disk detecting means. The inlet cover 24 is driven by the solenoid 50 that is operated based on a signal from the optical sensor. When the inlet cover 24 is moved backward on the printer body 1 by the solenoid 50, the end of the inlet cover 24 covers the top of the cutter button 37, thereby disabling the cutter button 37 as in the second and fourth embodiments.

Figure 21A:
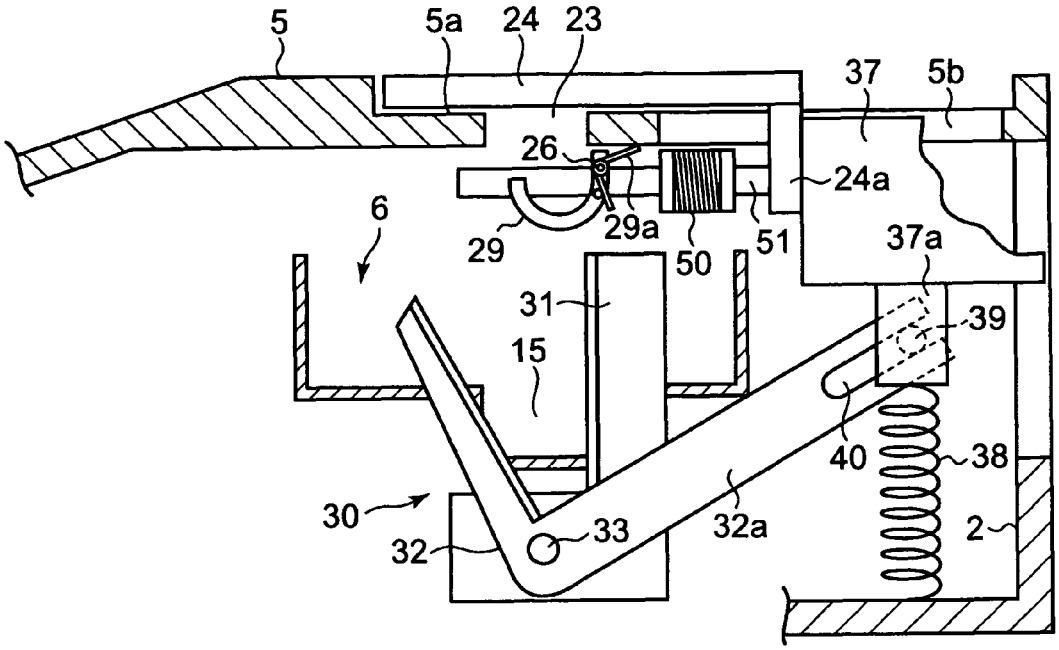
FIGS. 21A and 21B are views of a printer according to a sixth embodiment similar to FIGS. 12A and 12B, respectively.
Figure 21B:
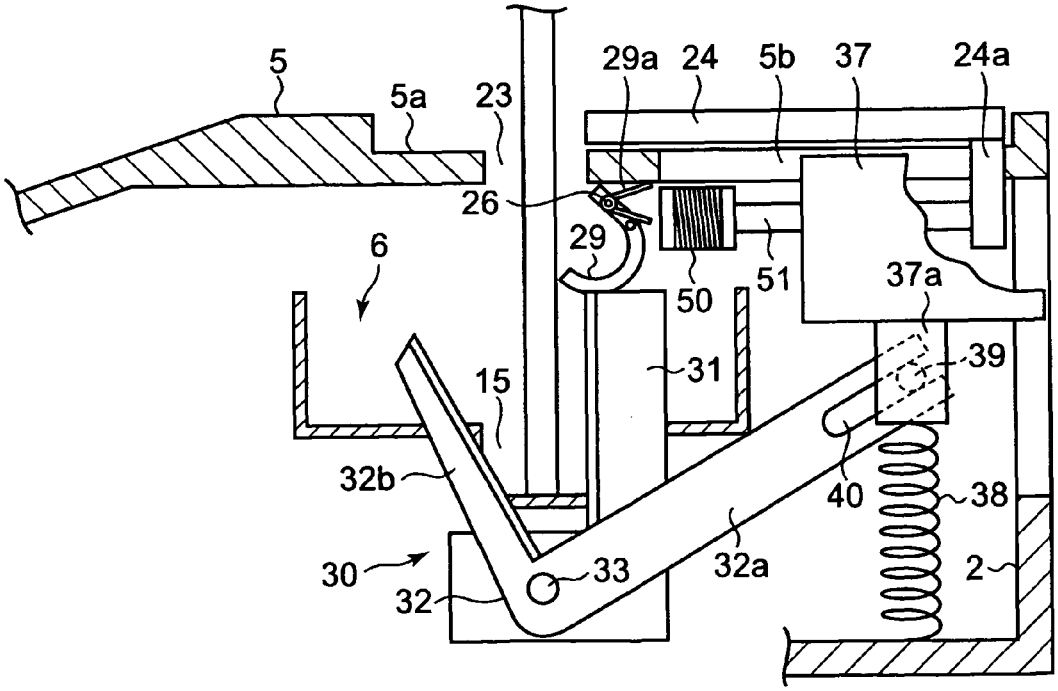

As shown in FIG. 21A, the inlet cover 24 connected to the plunger 51 of the solenoid 50 is normally held at a position where the inlet cover 24 closes the inlet 23 in the cover 5. When an optical disk D is loaded in the cassette receiving section 16 for printing purposes, the optical sensor 55 senses the optical disk D and sends a detection signal to the controller, which energizes the solenoid 50 based on the signal, thereby moving the plunger 51 along with the inlet cover 24 backward on the printer body 1, as shown in FIG. 21B. This causes the inlet 23 in the cover 5 to open, thereby allowing the optical disk D to be set into the inlet 23. In addition, the engaging end 24*b* of the inlet cover 24 covers the top of the cutter button 37, thereby disabling the cutter button. Thus, the cutter 30 cannot be operated.

When after printing the optical disk D is taken out of the cassette receiving section 16, the optical sensor 55 detects this operation, and produces a detection signal, which causes the controller to stop the energization of the solenoid 50. Thus, the plunger 51 moves along with the inlet cover 24 forward on the printer body 1 by the resiliency of a spring (not shown). This causes the inlet cover 24 to move away from the top of the cutter button 37, thereby allowing the cutter button 37 to be operated manually and returning the inlet cover 24 to its original position where the inlet cover 24 closes the inlet 23 in the cover 5.

In tape printing, the cover 5 is opened, a tape cassette 70 is loaded in the cassette receiving section 6 and then the cover 5 is closed. Thus, the optical sensor 55 on the wall of the open end 16 does not operate and the inlet cover 24 is held at the position where the inlet cover 24 closes the inlet 23. In this state, the printing tape 71 of the tape cassette 70 is printed. Since in this case the inlet cover 24 is at the position where it closes the inlet 23, the cutter button 37 is operable. Thus, when the printed part of the tape 71 is discharged out of the open end 16 of the printer body 1 and then stopped, the cutter button 37 can be manually pushed down against the resiliency of the spring 38 to turn the movable blade 32 against the fixed blade, thereby cutting the printed part away from the tape 71 as a label.

As described above, according to the printer of the sixth embodiment, when the optical disk D is inserted into the open end 16 for printing purposes, the inlet cover 24 is moved by the solenoid 50 backward on the printer body 1, thereby opening the inlet 23 and covering the cutter button 37 with the engaging end 24*b* of the inlet cover 24 and hence disabling the cutter 30. Thus, in printing, there occurs no trouble such as damages the optical disk D due to an advertent operation of the cutter button 37.

FIGS. 22 and 23 show a seventh embodiment. As in the first-fourth embodiments, in this embodiment the inlet cover 24 is elastically biased by the resiliency of the compression spring 43 forward on the printer body 1 so as to be held at a position where the cover 24 closes the inlet 23 in the cover 5. Even when the inlet cover 24 moves backward on the printer body 1, the end of the inlet cover 24 neither engages the cutter button 37 nor covers the top of the cutter button 37. The cutter button 37 is exposed normally on the printer body 1 irrespective of movement of the inlet cover 24. As in the first and second embodiments, the inlet cover 24 will move backward on the printer body 1 in conjunction with the optical disk D being inserted into the open end 16 of the printer body 1.

As described above, the cutter button 37 is provided movable vertically by the compression spring 38 relative to the body case 2. Provided between the cutter button 37 and the movable blade 32 are a transmission mechanism 60 that transmits the operation of the cutter button 37 to the movable blade 32, and an interrupter 61 that interrupts the transmitting operation of the transmission mechanism 60. The transmission mechanism 60 has a turnable lever 64 provided between the cutter button 37 and the movable blade 32. The turnable lever 64 is pivoted at an upper end by a pivot 65 to the cutter button 37. The lever 64 has an engaging pin 66 at a lower end thereof received slidable in an opening 40 provided at an end of the support arm 32*a* of the movable lever 32. Thus, when the cutter button 37 is pushed down, the movable blade 32 turns clockwise around the pivot 33 to cut the printed part of the printing tape 71 with the aid of the fixed blade 31. The lever 64 is elastically biased clockwise by a spring 68 provided between an upper end thereof and a pin 5*c* extending downward from the cutter button 37. The movable blade 32 is elastically biased counterclockwise by a spring 69 whose upper and lower ends are fixed to an upper part of the fixed blade 31 on its opposite side from its blade edge side and the midpoint of an upper edge of the support arm 32*a* of the movable lever 32. A stop 56 is provided to limit the counterclockwise turning of the movable blade 32.

Figure 22A:
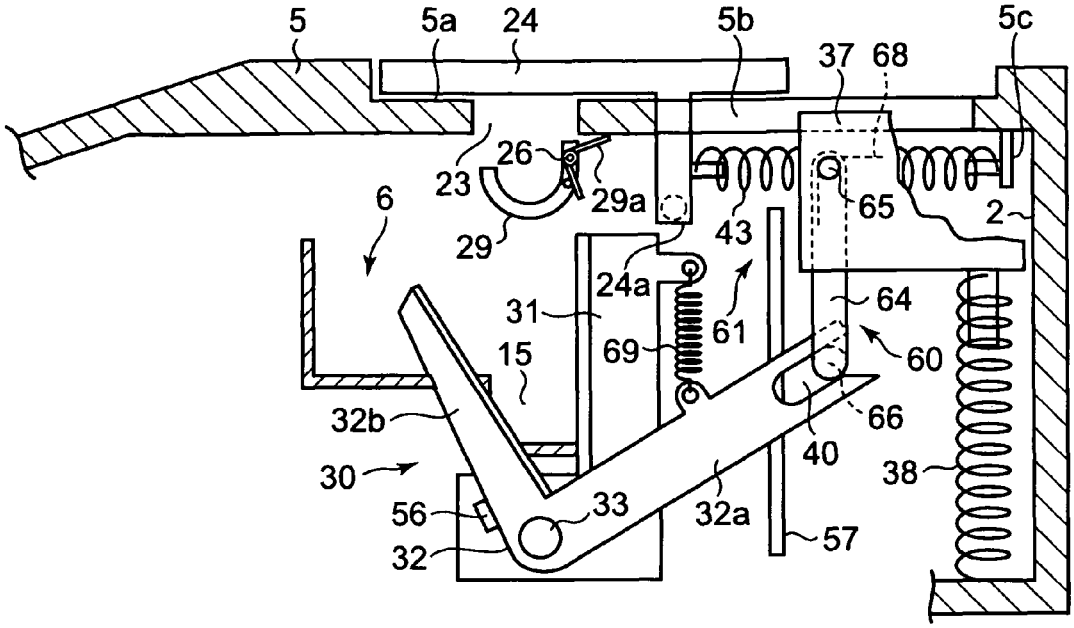
FIGS. 22A and 22B are views of a printer according to a seventh embodiment similar to FIGS. 12A and 12B, respectively.

Provided within the body case 2 is interrupting means 61 that comprises a vertical push plate 57 provided between the lower end portion of a downward protrusion 24*a* extending from the lower surface of the inlet cover 24 and the engaging pin 66 of the turnable lever 64 so as to be opposite both the lower end portion of the protrusion 24*a* and the engaging pin 66 of the lever 64 to translate back and forth relative to the printer body 1, or in the horizontal direction in FIG. 22A.

Figure 22B:
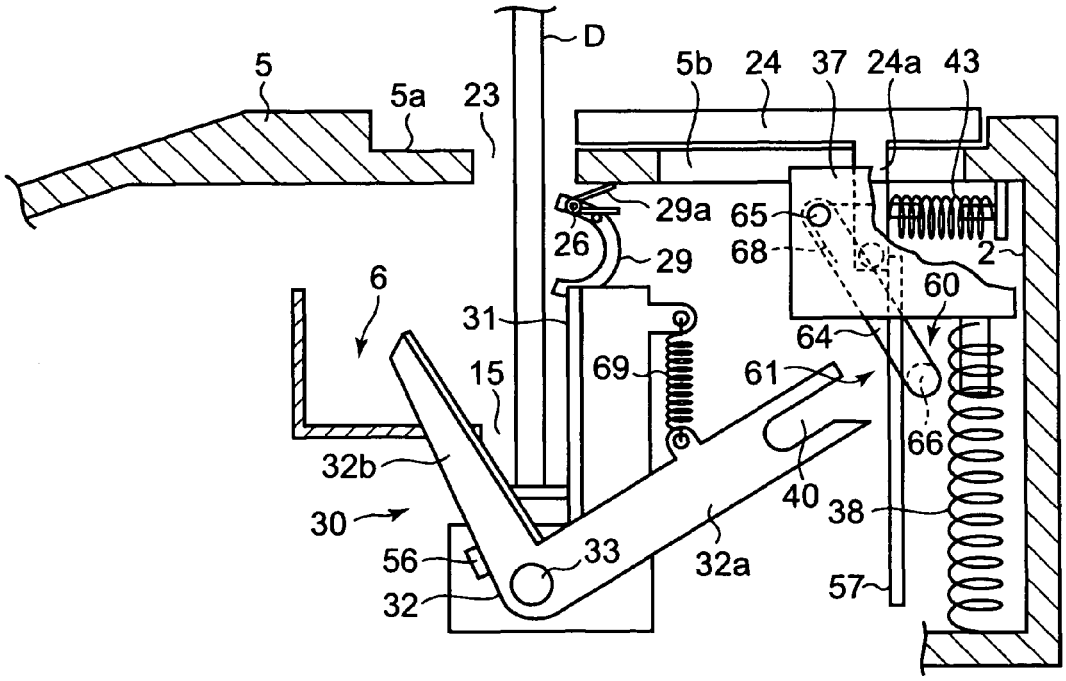

As shown in FIG. 22A, normally the inlet cover 24 is held at the position where it closes the inlet 23 in the cover 5. When an optical disk D is inserted upstanding into the printer body 1 through its open end 16, the inlet cover 24 moves against the resiliency of the spring 43 backward on the printer body 1, thereby opening the inlet 23, as shown in FIG. 22B. At this time, the downward protrusion 24*a* hits the push plate 57, which moves backward along with the inlet cover 24 relative to the printer body 1. Then, the push plate 57 abuts on the pin 66 of the lever 64, thereby turning the lever 64 counterclockwise against the resiliency of the spring 68 and then moving the pin 66 away out of the opening 40 in the movable blade 32. Thus, the transmission mechanism 60 that transmits the operation of the cutter button 37 to the movable blade 32 is interrupted.

Figure 23A:
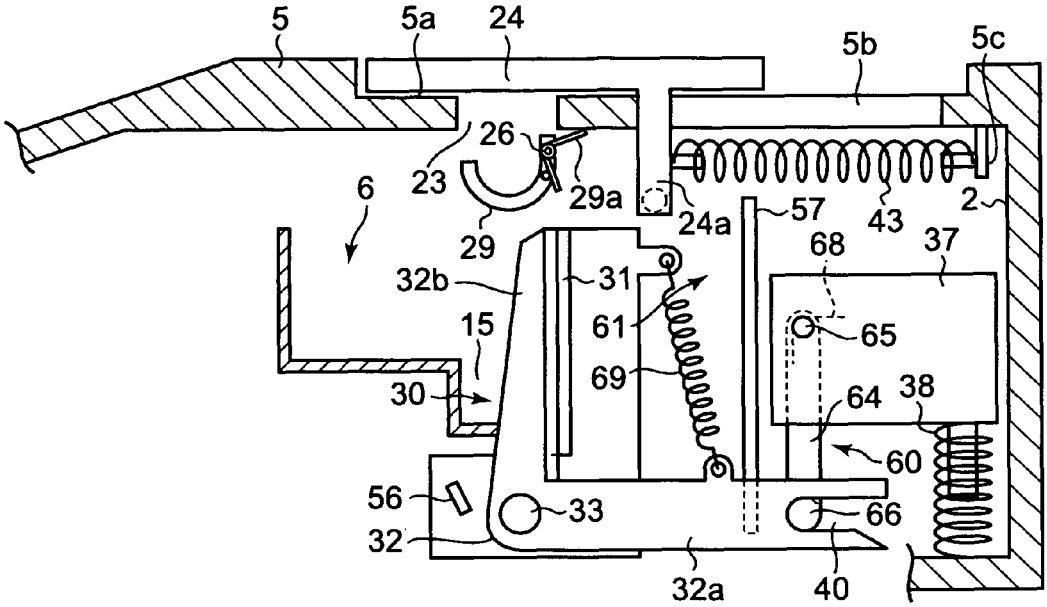
FIGS. 23A and 23B illustrate operative and inoperative states, respectively, of the cutting means of the printer of the seventh embodiment.
Figure 23B:
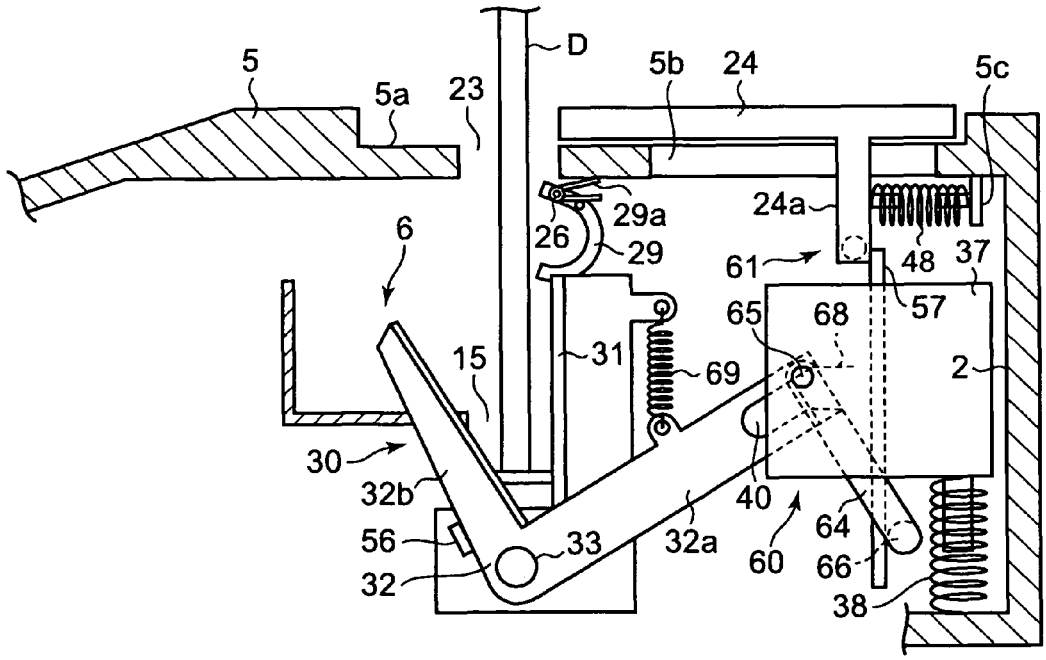

Thus, when the cutter button 37 is manually pushed down as shown in FIG. 23B in a state in which the optical disk D is inserted into the printer body 1, the cutter button 37 only moves downward and its operation is not transmitted to the movable blade 32 and hence the optical disk D is not damaged.

When after printing the optical disk D is taken out of the printer body 1, the inlet cover 24 is moved forward on the printer body 1 by the resiliency of the spring 43 because the optical disk D is removed out of the open end 23. This causes the lever 64 to rotate clockwise with the resiliency of the spring 68 and causes the push plate 57 to translate forward relative to the printer body 1 and the engaging pin 66 is received within the slot 40 in the movable blade 32, thereby allowing the cutter button 37 and the movable blade 32 to operate together.

In tape printing, it is required that the cover 5 be opened, that a tape cassette 70 be loaded in the cassette receiving section 6 and then that the cover 5 be closed. In this case, unlike the printing of the optical disk D the inlet cover 24 need not be opened and is left at a position where the inlet cover 24 closes the inlet 23 in the cover 5. In this state, the tape 71 of the tape cassette 70 is printed. Since in this case the inlet cover 24 is at the position where it closes the inlet 23, the cutter button 37 is operable to actuate the cutter 30. Thus, when the printed part 71 of the tape is discharged out of the open end 16 and then stopped, the cutter button 37 can be pushed down as shown in FIG. 23A, thereby turning the movable blade 32 to cut the printed part of the tape 71 as a label.

As described above, when even in the printer 1 of the seventh embodiment the optical disk D is disposed into the conveyance path 15 through the inlet 23 in the cover 5 within the printer body 1, this operation causes the inlet cover 24 to move so as to open the inlet 23, thereby interrupting the transmission mechanism 60 between the cutter button 37 and the cutter 30. Thus, even when the cutter button 37 is operated inadvertently, the cutter 30 does not operate, thereby damaging no optical disk D.

While in the seventh embodiment the cover 24 is illustrated as moved in conjunction with the insertion of the optical disk D into the printer body 1, the arrangement may be such that when the cover 24 is moved manually from its position where the cover closes the inlet 23 to a position where the cover 24 opens the inlet 23, the transmission mechanism 60 is interrupted, thereby preventing the operation of the cutter button 37 from being transmitted to the cutter 30 as in the third and fourth embodiments. As in the fifth and sixth embodiment, the arrangement may be such that the transmission mechanism 60 between the cutter button 37 and the cutter 30 is interrupted in response to the inlet cover 24 being moved from the position where the inlet cover 24 closes the inlet 23 to the position where the inlet cover 24 opens the inlet 23 by the solenoid 50 based on a signal from the optical sensor 55 indicative of detection of the insertion of the optical disk D, thereby preventing operation of the cutter button 37 from being transmitted to the cutter 30.

While the inventive printer is illustrated as having the function of disabling the cutter when the rigid recording medium is inserted into the printer body, the rigid recording media used in the inventive printers are not limited to the optical disks, but may include plastic cards.

Figure 24:
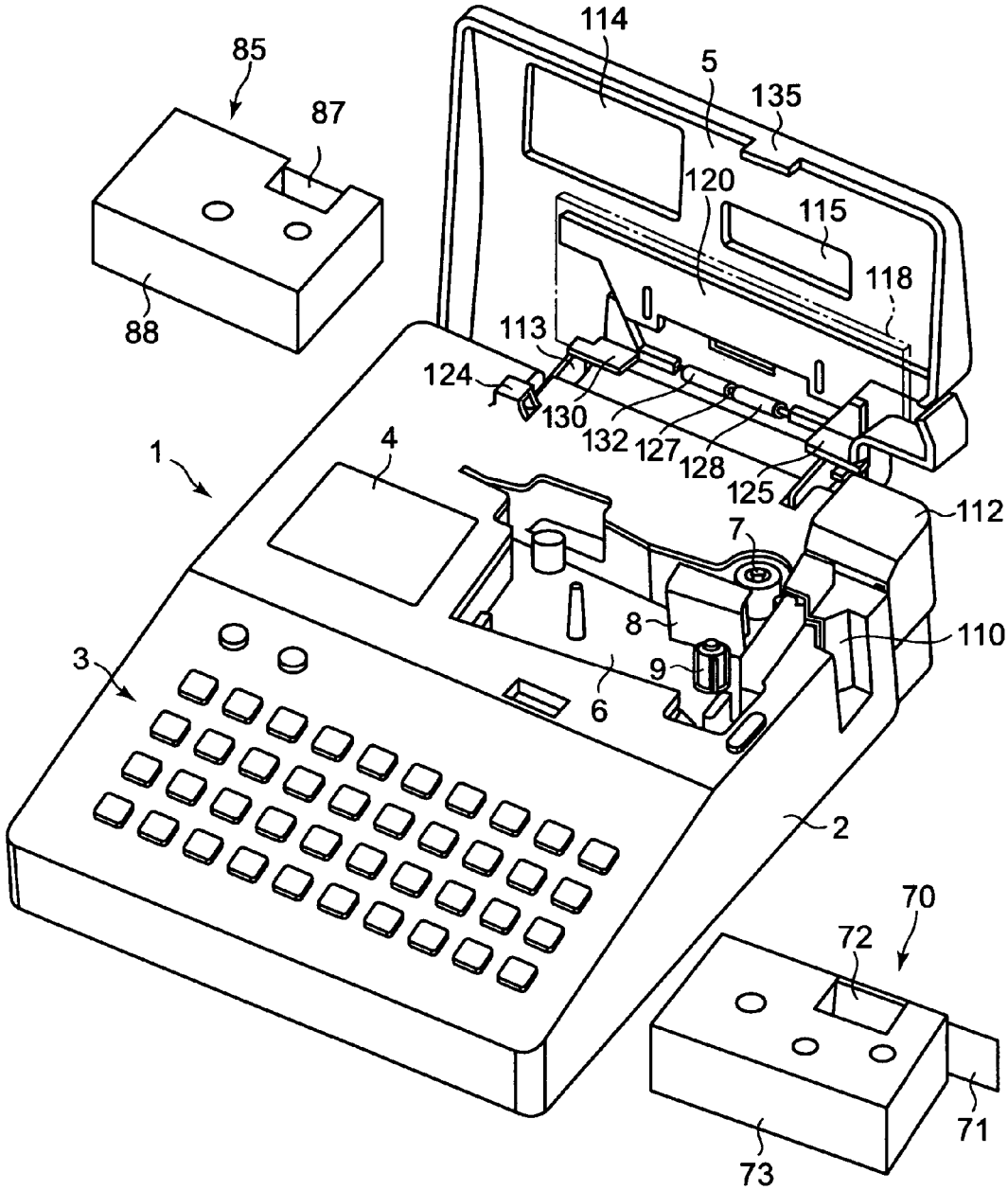
FIG. 24 is a perspective view of a printer according to an eighth embodiment along with its expendables.
Figure 25:
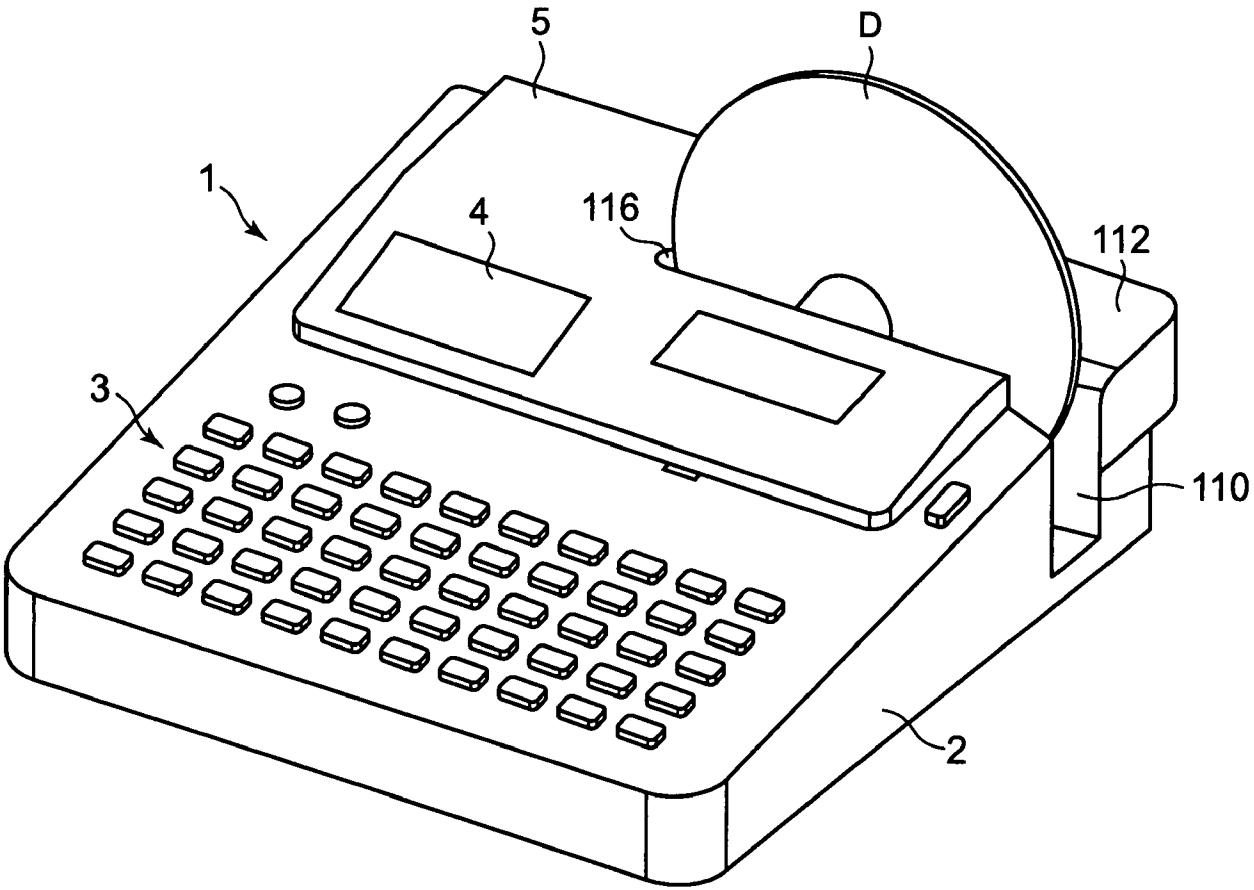
FIG. 25 is a perspective view of the printer with an object of print set.
Figure 26:
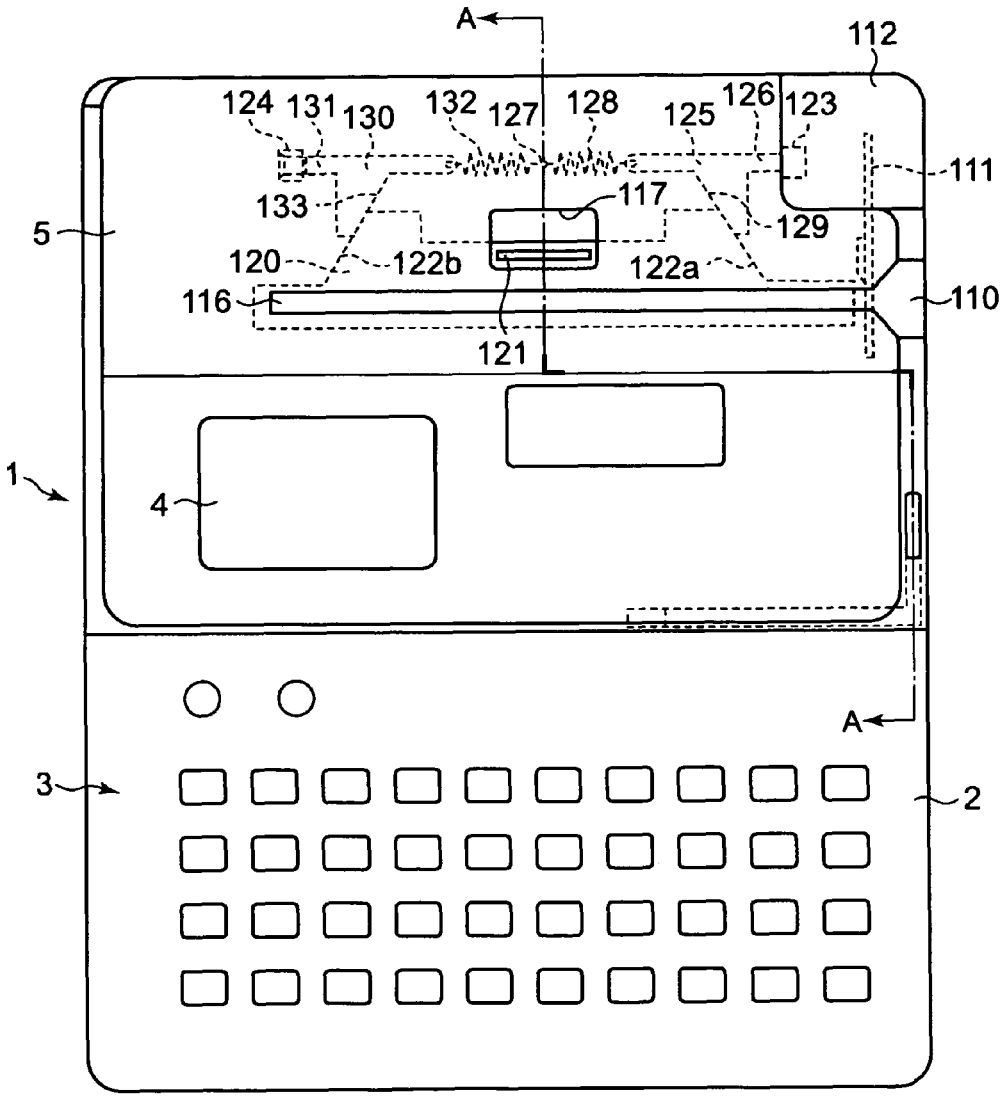
FIG. 26 is a plan view of the printer of the FIG. 25.
Figure 27A:
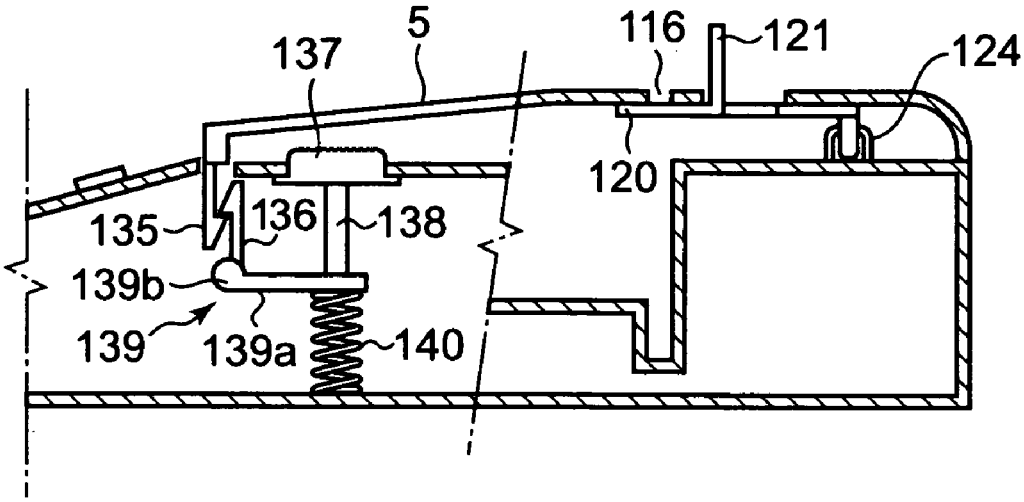
FIGS. 27A and 27B are cross-sectional views taken along a line A-A in FIG. 26, showing that the cover is locked and unlocked to and from, respectively, the printer body.
Figure 27B:
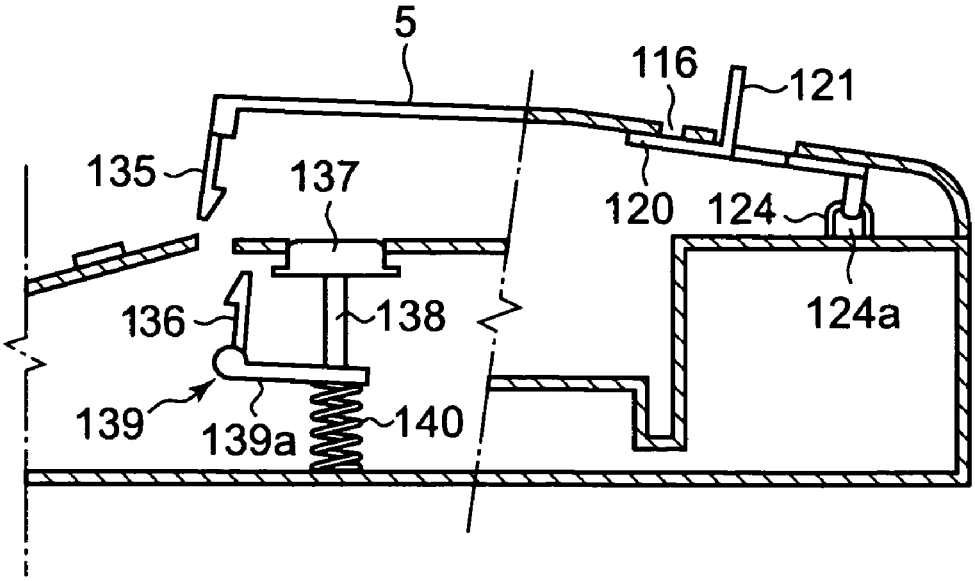
Figure 28:
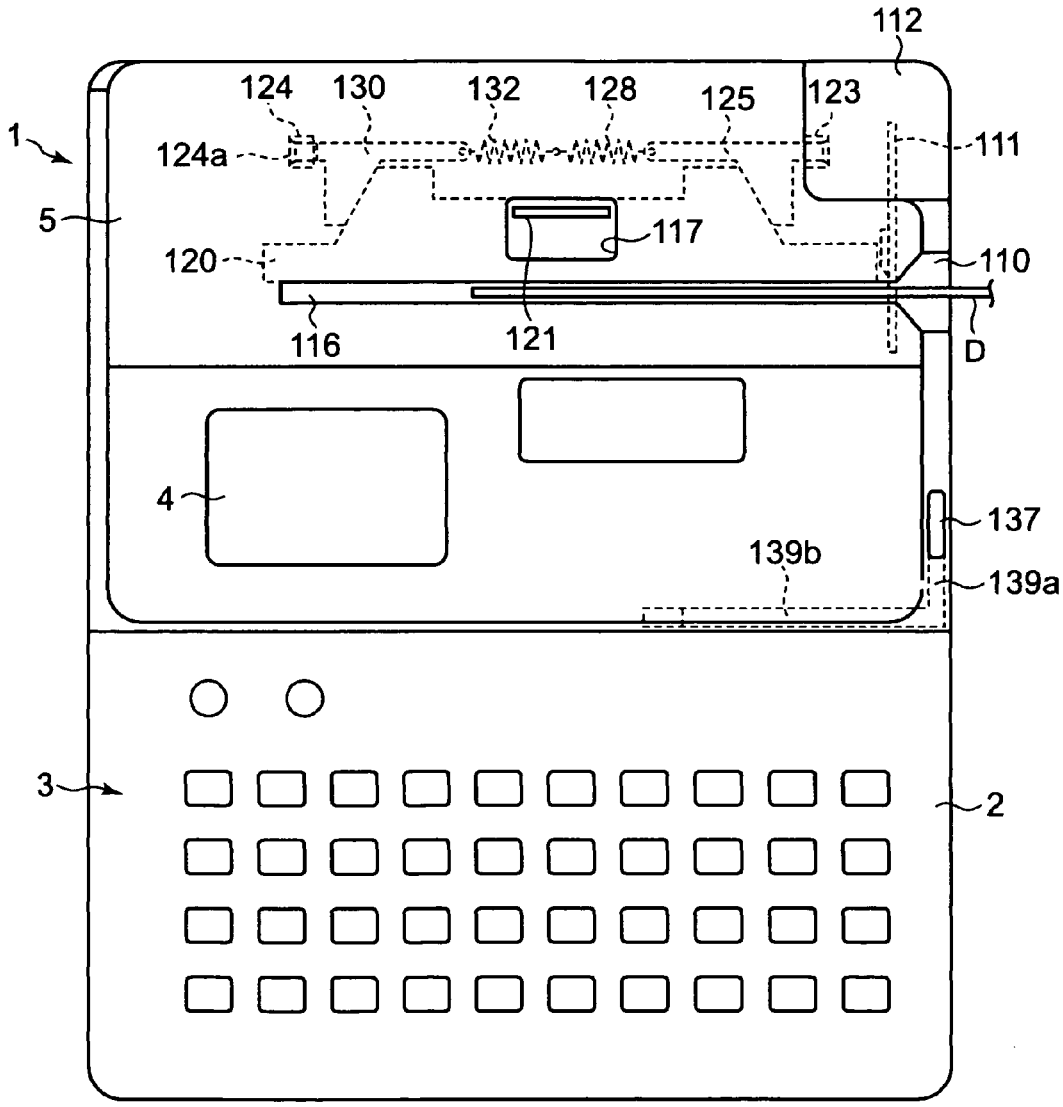
FIG. 28 is a plan view of the FIG. 25 printer with an object of print set.
Figure 29:
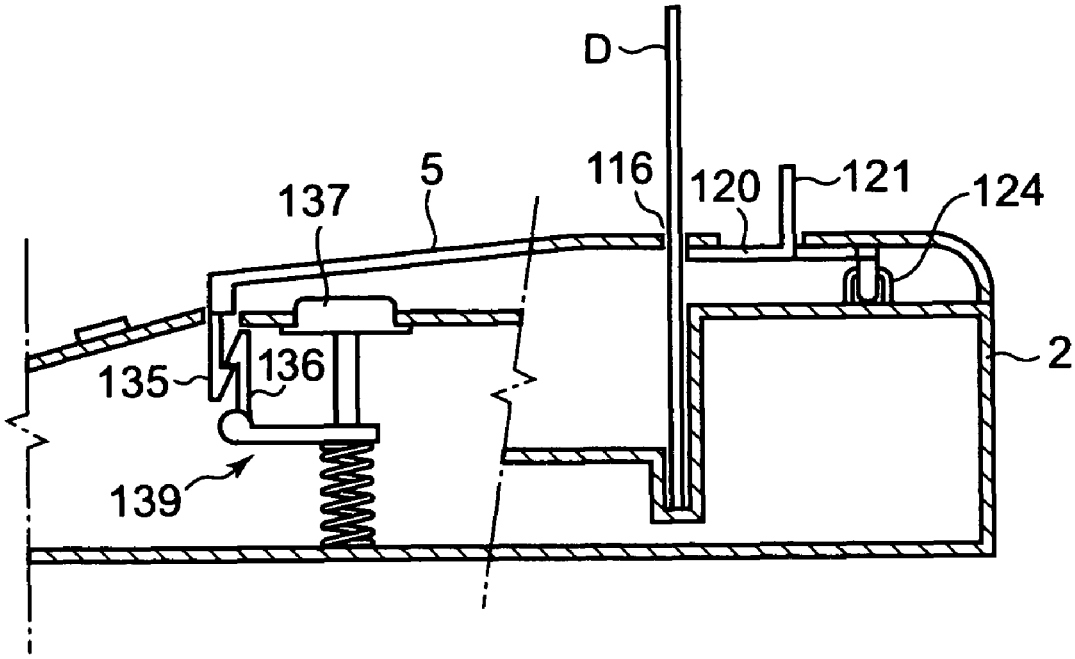
FIG. 29 is a partial cross-sectional view taken in FIG. 28.

FIGS. 24-29 show a printer of an eighth embodiment. FIG. 24 is a perspective view of the printer along with its expendables. FIG. 25 is a perspective view of the printer with an object of print loaded. FIG. 26 is plan view of the printer. FIGS. 27A and 27B are cross-sectional views taken along a line A-A in FIG. 26, showing that the cover is locked and unlocked to and from, respectively, the printer body. FIG. 28 is a plan view of the FIG. 25 printer with an object of print loaded. FIG. 29 is a partial cross-sectional view taken in FIG. 28.

In this printer, the cover 5 provided above the cassette receiving section 6 is hinged at 113 to a rear edge of the top of the printer body 1. Transparent windows 114 and 115 are provided at positions in the cover 5 where the display 4 and the cassette receiving section 6 can be seen from above through the windows 114 and 115, respectively, when the cover 5 is closed. The cover 5 has a slit-like inlet 116 extending widthwise of the printer body 1 from an upstream position spaced somewhat leftward from the center thereof to a downstream position on the right-hand side thereof where the inlet 116 is open to the outside. The slit-like inlet 116 substantially coincides in position and length with the conveyance path 15 provided in the cassette receiving section 6 on the printer body 1 when the cover 5 is closed. When an optical disk D is inserted upstanding through the open end 16 of the printer body 1 in a state where the cover 5 is closed, the optical disk D moves along the inlet 116 in the cover 5 and the conveyance path 15 and then arrives at the set position in the cassette receiving section 6. At this time, substantially the upper half part of the optical disk D appears above the printer body 1. In printing, the optical disk D is conveyed through the conveyance path 15 from its upstream end toward its downstream end in a state in which the optical disk D is inserted into the inlet 116 during which conveyance the optical disk D is printed. The printers of the eighth embodiment and ninth-twelfth embodiments to be described later are the same printing type as that of the first embodiment where the printing tape 71 or optical disk D loaded selectively into the printer body 1 is conveyed along the conveyance path 15 while being printed.

In the printer, the cutting means (or cutter) 111 provided at the end of the conveyance path 15 is for cutting a printed part of the tape 71. When an operation member (cutter button) 112 similar to the cutter button 37 of the aforementioned embodiments is pushed down inadvertently in a state in which an optical disk D is inserted into the printer body 1, the optical disk D would be damaged. When the cutter is actuated against a rigid recording medium of resin such as the optical disk D, the cutter edge would be damaged. In the printer 1, the optical disk D is inserted into the printer body 1 with an upper half thereof appearing above the printer through the inlet 116 in the cover 5. Thus, when the user inadvertently opens the cover 5 to replace the ribbon cassette 85, the edge of the inlet 116 in the cover 5 would hit the disk D, thereby damaging the same. As described above, if the cutter button 112 is operated or the cover 5 is opened in a state in which the optical disk D is inserted in the printer body 1, the optical disk D would be damaged. In order to avoid this situation, an arrangement is provided which prohibits the operation of the cutter 111 and the opening of the cover 5, which will be described next.

A support plate 118 is provided opposite the inner surface of the cover 5, and an inlet cover 120 is provided on the support plate 118 between the same and the cover 5. A cutter lock 125 and a cover lock 130 are provided in an oppositely disposed relationship at the upper ends of the opposite right and left inclined sides 122*a* and 122*b* (in FIG. 26), respectively, of an inlet cover 120 in the form of a top-recessed trapezoid with right and left outward extensions at its base so as to move in conjunction with a movement of the inlet cover 120. The inlet cover 120 is slidable only back and forth over the printer body 1 on the support plate 118 by a guide mechanism (not shown). A knob 121 is provided integrally on the inlet cover 120 appearing outside the printer body 1 through an operation window 117 provided in the cover 5. When the knob 121 is manually moved backward on the printer body 1, the inlet cover 120 is moved to a position where the inlet cover 120 closes the inlet 116 from a position where the inlet cover 120 opens the inlet 116. The cutter lock 125 is provided slidable only right and left on the printer body 1 along the support plate 118 by a guide mechanism (not shown). The cutter lock 125 has a lock pin 126 on the right-hand end thereof that can move into a hole 123 provided in the cutter button 112. A tension spring 128 is provided extending between the left-hand end of the cutter lock 125 and a pin 127 provided at the midpoint of the back of the cover 5 so as to pull the cutter lock 125 toward the pin 127. A cover lock 130 is provided slidable only right and left on the printer body 1 along the support 118 by a guide mechanism (not shown). The cover lock 130 has a lock pin 131 at the left-hand end thereof that can engage a hole 124 provided in the body case 2. A tension spring 132 is provided between the right-hand end of the cover lock 130 and the pin 127 provided at the midpoint of the back of the cover 5 so as to pull the cover lock 130 toward the pin 127 at all times.

The right and left inclined sides 122*a* and 122*b* of the inlet cover 120 which are slidable on respective outer inclined edges 129 and 133 of the oppositely disposed cutter lock 125 and cover lock 130. When the inlet cover 120 is moved backward on the printer body 1 from the position where the inlet cover 120 closes the inlet 116 to the position where the inlet cover 120 opens the inlet 116, the backward movement of the inlet cover 120 on the printer body 1 is converted to the right and left outward movements of the cutter lock 125 and the cover lock 130, respectively. This causes the lock pin 126 of the cutter lock 125 to move into the engaging slot 123 in the cutter button 112 and causes the lock pin 131 of the cover lock 130 to move into the engaging slot 124 in the body case 2. When the force applied to the inlet cover 120 is released, the cutter lock 125 and the cover lock 130 are moved inward by the resiliency of the tension springs 128 and 132 that normally pull the cutter lock 125 and the cover lock 130 and disengaged from the respective slots 123 and 124. This causes the inlet cover 120 to return to its position where it closes the inlet 116.

The cover 5 has a hook 135 on an edge thereof on the opposite side thereof from the hinges 113 to lock to the body case 2 the cover 5 that has closed the printer body 1. The body case 2 has an engagement piece 136 to engage the hook 135. A disengaging mechanism that disengages the hook 135 from the engagement piece 136 is provided on the body case 2. The disengaging mechanism comprises an manually operable disengaging button 137 disposed on the upper surface of the body case 2, an operation shaft 138 provided on the lower end of the disengaging button 137, a substantially L-shaped connection lever 139 whose one branch 139*a* abuts on a lower end of the operation shaft 138 and whose other branch 139*b* composes a rotational shaft thereof supported by the body case 2, and a return spring 140 provided between the connection lever 139 and the body case 2 for returning the disengaging button 137 and the connection lever 139 to their original positions. An engaging hook 136 is provided to the other branch 139*b* of the connection lever 139 to be engaged with the hook 135 of the cover 5. When the cover 5 is closed so as to cover the relevant part of the top of the body case 2, the hook 135 of the cover 5 is engaged with the engaging element 136 of the body case 2. When the disengaging button 137 is manually pushed down, the one branch 139*a* of the connection lever 139 is pushed by the operation shaft 138 to turn around the rotational shaft comprising the other branch 139*b* of the connection lever 139. This causes the engaging element 136 provided at the other branch 139*b* of the connection lever 139 to turn clockwise, thereby disengaging the engaging element 136 from the hook 135 and hence allowing the cover 5 to open.

In printing, the user moves the inlet cover 120 backward on the printer body 1 by moving the knob 121 manually, thereby opening the inlet 116 in the cover 5, and then the disk D is inserted into the printer body 1 through its open end 116. FIGS. 28 and 29 are a plan view and a cross-sectional side view, respectively, of the printer where the optical disk D is inserted in the printer body 1. When the inlet cover 120 is moved backward on the printer body 1 to open the inlet 116, the cutter lock 125 is moved toward the cutter button 112 against the resiliency of the tension spring 128 in conjunction with the movement of the inlet cover 120, and the lock pin 126 moves into the slot 123 in the cutter button 112, thereby disabling the cutter button 112. Simultaneously, the backward movement of the inlet cover 120 on the body case 2 causes the cover lock 130 to move toward the engaging element 124 of the body case 2 and hence cause the lock pin 131 of the cover lock 130 to move into the engaging slot 124*a* in the engaging element 124, thereby locking the cover 5 to the body case 2 and hence disabling the cover 5 from being opened. In this state, even when the disengaging button 137 is operated to disengage the engaging element 136 from the hook 135, the cover 5 cannot be opened because the cover lock 130 locks the cover 5 to the body case 2.

When after printing the optical disk D is taken out of the printer body 1 and hence from the open end 116, the cutter lock 125 and the cover lock 130 are pulled by the tension springs 128 and 132, respectively, toward the center of the cover 5 where the pin 127 is positioned. This causes the inlet cover 120 to move forward on the printer body 1, and return to the position where the inlet cover 120 closes the inlet 116 which the optical disk D has left.

Since the inlet cover 120 is moved to open the inlet 116 in the cover 5 only when the optical disk D is inserted, the inlet cover 120 is left at the position where the inlet cover 120 closes the inlet 116 when a tape cassette 70 is loaded in the cassette receiving section 6 to print on the tape 71. Since in this state the lock pin 126 of the cutter lock 125 is not engaged in the slot 123 in the cutter button 112, the cutter 111 is manually operable, thereby allowing a printed part of the printing tape 71 to be cut away by manually operating the cutter button 112. Since the cover lock 130 is not operated either at this time, the inlet cover 5 can be disengaged from the printer body 1 by operating the disengaging button 137, thereby allowing the tape cassette 70 to be exchanged freely in the cassette receiving section 6.

According to this eighth embodiment, when the inlet 116 is opened by manually operating the inlet cover 120 as the manual operating means to insert the optical disk D into the printer body 1 and dispose it in the conveyance path 15, this operation causes the cutter lock 125 to be operated, thereby disabling the cutter 111. Simultaneously, the cover lock 130 is operated to cause the cover 5 to lock to the printer body 1, thereby disabling the cover 5 from being opened. As just described, the printer comprises means responsive to operation of the manual operating means for preventing the cutting operation of the cutter 111 and the opening operation of the cover 5. Thus, troubles are eliminated, such as damage the optical disk D inserted into the printer body 1 with the actuated cutter 11 and/or open the cover 5 in a state in which the optical disk D is inserted into the inlet 116 in the cover 5, thereby causing the edge of the inlet 116 to hit the optical disk D and hence damaging the optical disk D.

Figure 30A:
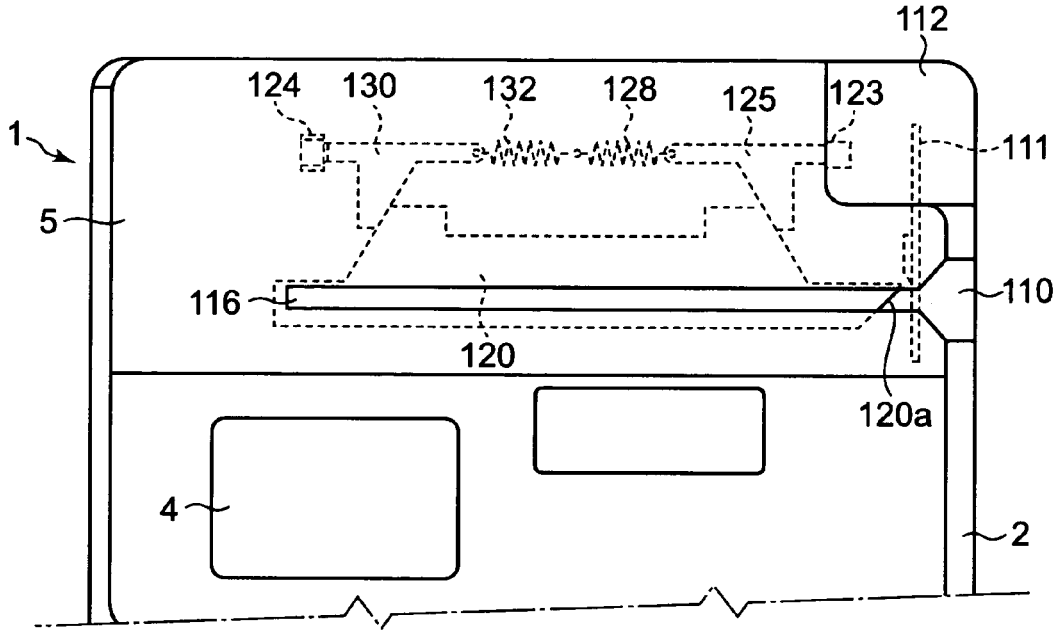
FIGS. 30A and 30B are plan views of an essential part of a printer according to a ninth embodiment in different operative states, respectively.
Figure 30B:
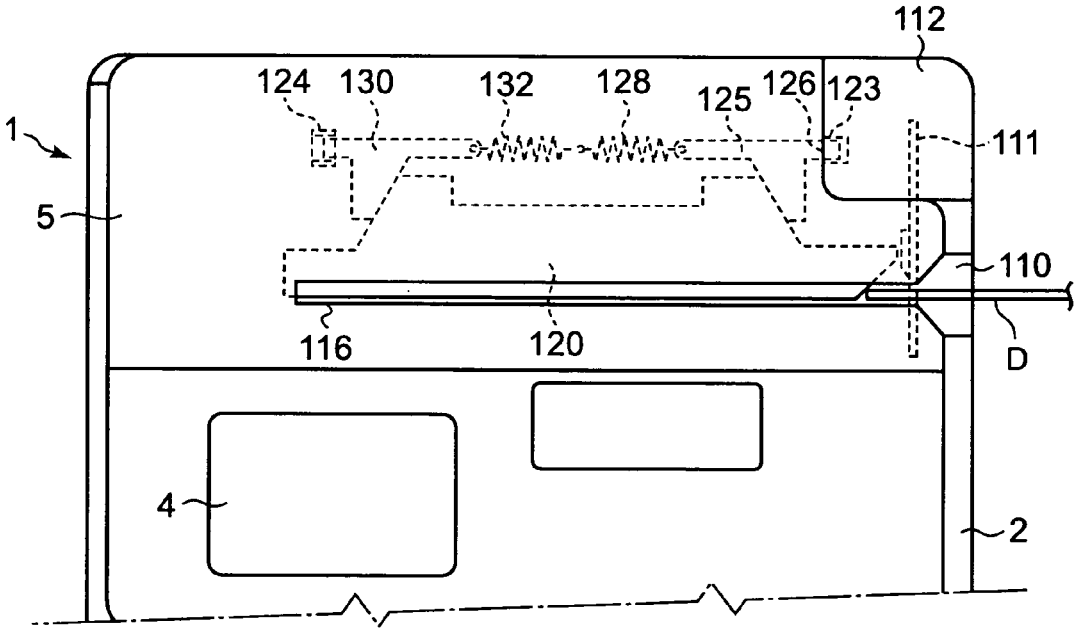

FIGS. 30A and 30B are different plan views of an essential part of the printer of a ninth embodiment where an optical disk and no optical disk are inserted, respectively. Like the printer of the eighth embodiment, the printer 1 of the ninth embodiment has the functions of locking the cutter 111 and the cover 5 which are the same as those of the eighth embodiment. While in the printer of the eighth embodiment the lock functions of the cutter 111 and the cover 5 are performed by the manual operating means (including the inlet cover 20 with the manually operable knob 121), in the printer of the ninth embodiment those two functions are effectively performed in conjunction with the insertion of the optical disk D into the printer body 1.

In the printer 1 of this embodiment the optical disk D is inserted into the printer body 1 from its end 110 open to the right-hand side of the printer body 1 along the inlet 116 whose right-hand end is open to the open end 110 of the printer body 1. The inlet cover 120 takes the form of a trapezoid having right and left outward protrusions at its base thereof with the right-hand protrusion having an end edge 120*a* inclined so as to form an acute angle between the end edge 120*a* and a rear edge of the right-hand protrusion of the inlet cover 120 in the vicinity of the open end 110 and at the right-hand end of the inlet 116 in the cover 5. Thus, when the optical disk D inserted through the open end 110 is moved along the inlet 116 within the printer body 1, the optical disk D hits the inclined end edge 120 and then moves the inlet cover 120 backward on the printer body 1. In conjunction with the backward movement of the inlet cover 120, the cutter lock 125 moves toward the cutter button 112 and then the lock pin 126 moves into the engaging slot 123 in the cutter button 112. Simultaneously, the cover lock 130 moves into the engaging slot 124 in the body case 2, thereby locking the cutter 111 and the cover 5 (FIG. 30B). When the optical disk D is taken out of the printer body 1, the inlet cover 120 is returned its original position by the resiliency of the tension springs 128 and 132, which is the same operation as in the eighth embodiment.

Thus, according to the printer of this ninth embodiment, when the optical disk D is loaded into the printer body 1 and dispose it into the conveyance path 15, this operation causes the cutter lock 125 to be operated, thereby disabling the cutter 111. Simultaneously, the cover lock 130 is operated to disable the cover 5 from being opened. Thus, troubles are eliminated, such as damage the optical disk D inserted into the printer body 1 with the actuated cutter 111 and/or open the cover 5 in a state in which the optical disk D is inserted into the inlet 116 in the cover 5, thereby causing the edge of the inlet 116 to hit the optical disk D and hence damaging the optical disk D.

Figure 31:
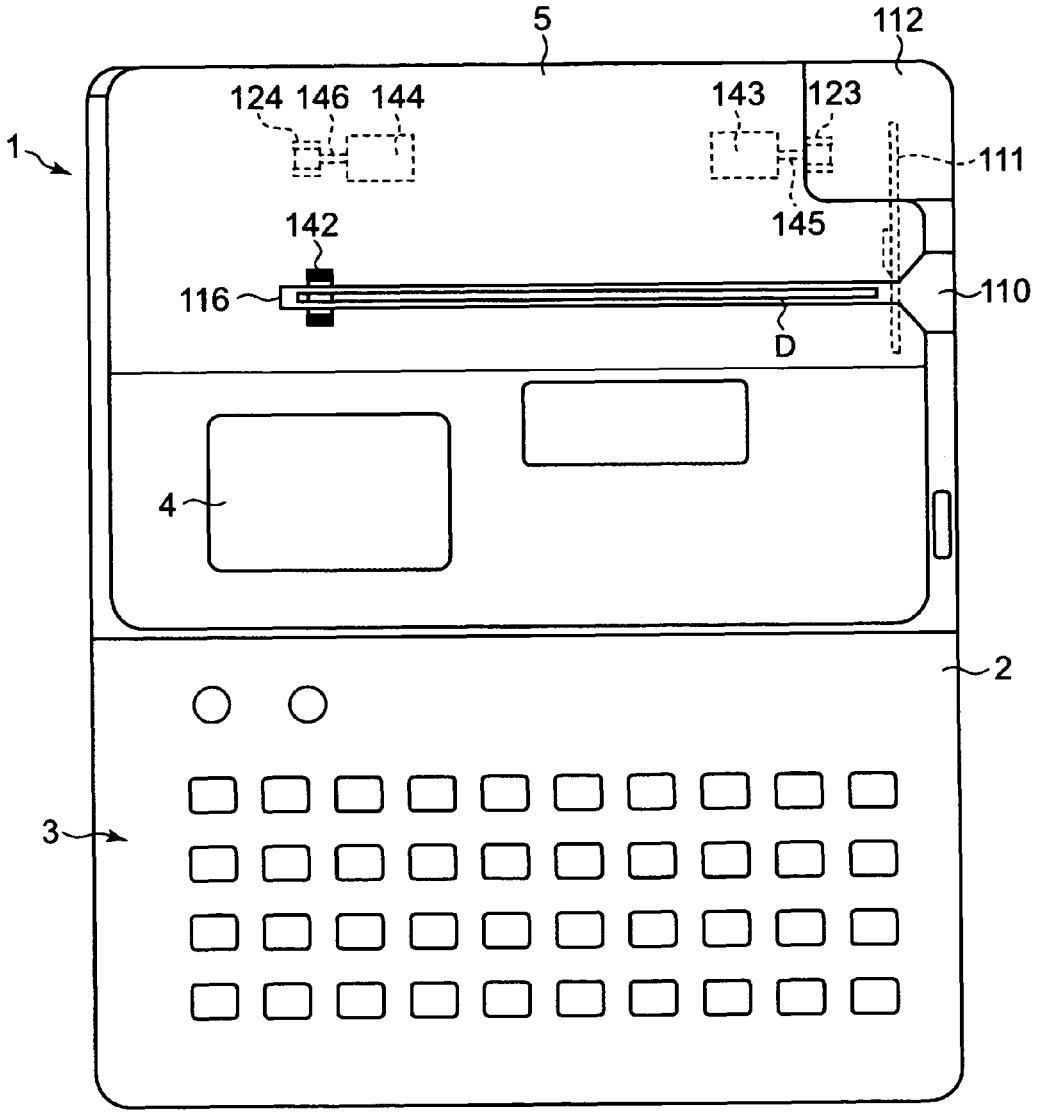
FIG. 31 is a plan view of a printer according to a tenth embodiment.

FIG. 31 is a plan view of a printer of a tenth embodiment. This printer is constituted such that when an optical disk D is inserted into the printer body 1, this fact is detected, which drives a drive source to operate a mechanism that locks the cutter button 112 and the cover 5. As shown in FIG. 31, a sensor 142 is provided in the printer body 1 or in the vicinity of the left end of the inlet 116 in the cover 5 to detect the insertion of the disk D. Two solenoids 143 and 144 are provided on the back of the cover 5 to operate lock pins 145 and 146, respectively. When the sensor 142 detects insertion of an optical disk D into the printer body 1, it produces a detection signal based on which a controller (not shown) drives the solenoids 143 and 144, which cause the lock pins 145 and 146 to move into slots 123 and 124 in the cutter button 112 and the body case 2, thereby locking the cutter 111 and the cover 5, respectively. When the sensor 142 detects that the optical disk D is taken out of the printer body 1, the energization of the solenoids 143 and 144 is stopped and hence the lock pins 145 and 146 are moved away out of their engaging slots, thereby unlocking the cutter 111 and the cover 5, respectively.

Thus, according to the printer of the tenth embodiment, when the insertion of the optical disk D into the conveyance path 15 in the printer body 1 is sensed by the sensor 142, the solenoids 143 and 144 are driven, thereby locking the cutter 111 so as to be inoperable and locking the cover 5 to the body case 2 so as to be unopenable, respectively. Thus, troubles are eliminated, such as damage the optical disk D inserted into the printer body 1 with the actuated cutter 11 and/or open the cover 5 in a state in which the optical disk D is inserted into the inlet 116 in the cover 5, thereby causing the edge of the inlet 116 to hit the optical disk D and hence damaging the optical disk D.

Figure 32A:
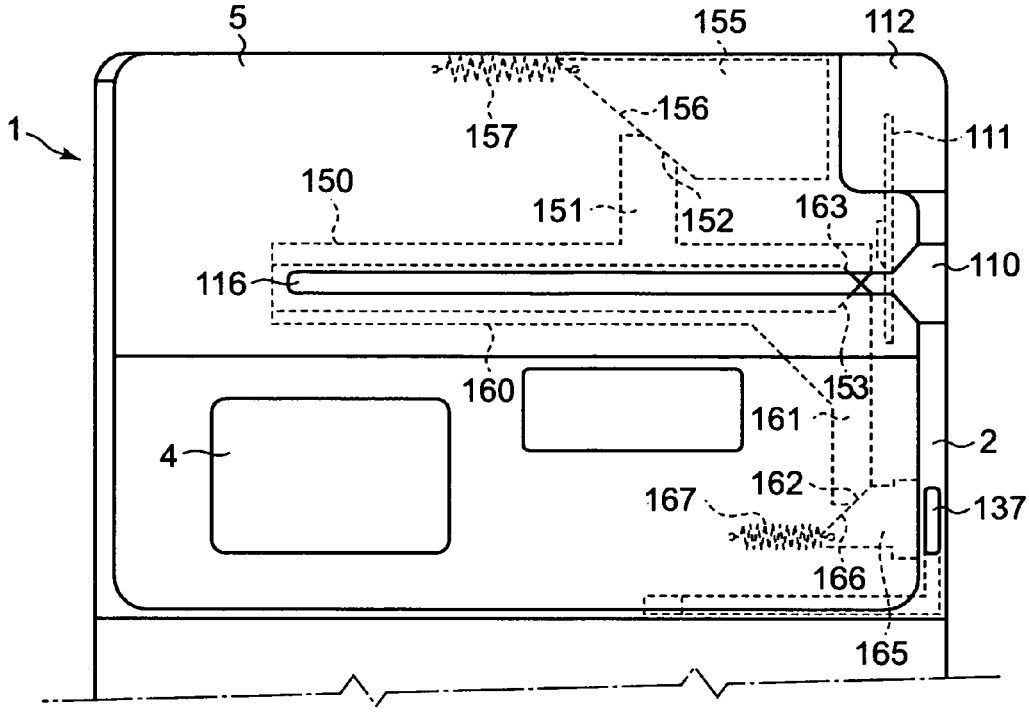
FIGS. 32A and 32B are plan views of an essential part of a printer according to an eleventh embodiment of the present invention in different operative states, respectively.
Figure 32B:
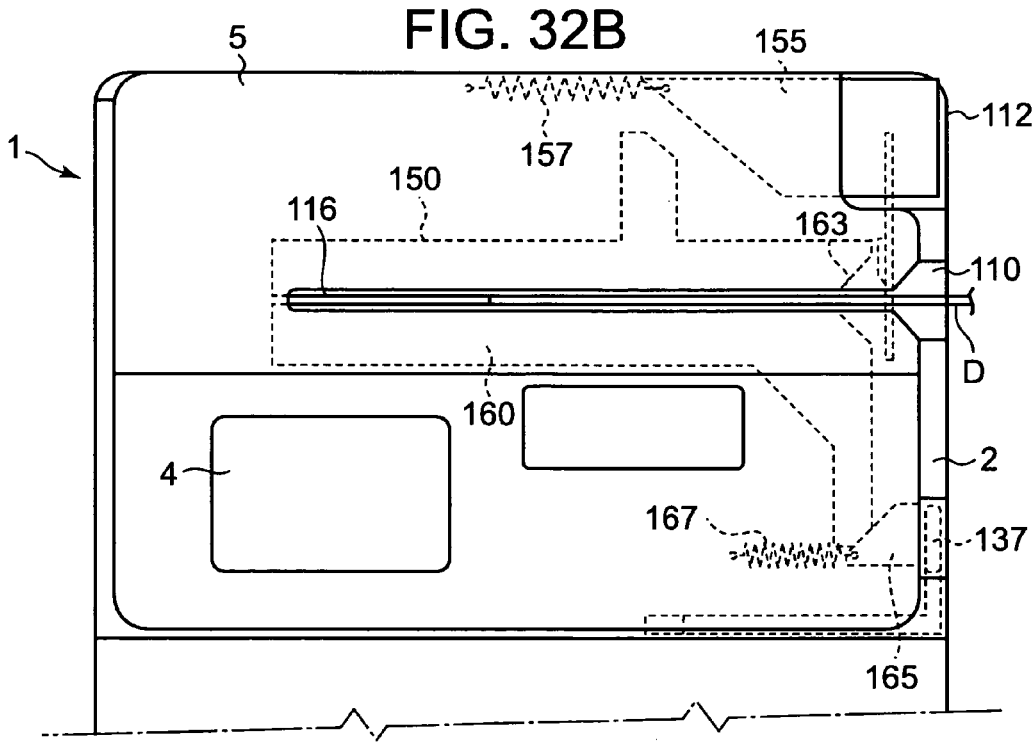

FIGS. 32A and 32B are different plan views of an essential part of a printer according to an eleventh embodiment in which no optical disk and an optical disk, respectively, are inserted into the printer body 1. In this printer 1, when an optical disk D is inserted into the printer body 1, means that covers the cutter button 112 and the disengaging button 137 provided exposed on the printer body 1 in conjunction with the insertion of the optical disk D disables these buttons. In FIGS. 32A and 32B, first and second inlet covers 150 and 160 are disposed overlapping below the cover 5 so as to be movable back and forth, respectively, on the printer body 1. The first inlet cover 150 has a rear protrusion 151 at its rear edge which has an inclined end edge 152 sidable on an inclined slide edge 156 of a first cover plate 155. The first cover plate 155 is biased by a tension spring 157 so as to be movable rightward and leftward on the cover 5, and hence so as to protrude somewhat rightward beyond the right-hand side of the cover 5. At this time, the first cover plate 155 covers the top of the cutter button 112. The right-hand end of the first inlet cover 150 in the vicinity of the open end 110 has an edge 153 inclined at an acute angle to the horizontal edge of the first inlet cover 150 as in the inlet cover 120 of FIG. 30.

The inlet cover 160 takes the form of an L whose shorter branch 161 extends forward from the right-hand end portion thereof and has an end with an inclined edge 162 slidable on an inclined edge 166 of a second cover plate 165. The second cover plate 165 is pulled by a tension spring 167 so as to be movable right and left on the cover 5, and hence so as to be protrudable outward somewhat beyond the right-hand side of the cover 5. When the second cover plate 165 protrudes outward somewhat, the second cover plate 165 covers the top of the disengaging button 137. The second L-shaped inlet cover 160 has an inclined edge 163 provided on the outer bend thereof in the vicinity of the open end 110 of the printer body 1, and inclined at an unobtuse angle to the horizontal edge of the longer branch of the L thereof.

When in this printer 1 an optical disk D is inserted from the open end 110 along the inlet 116 into the printer body 1, the optical disk D hits the inclined edges 153 and 163 of the first and second inlet covers 150 and 160 to move the same backward and forward, respectively, on the printer body 1, thereby moving the first and second cover plates 155 and 165 rightward and covering the tops of the cutter button 112 and the disengaging button 137. This disables these buttons. When the optical disk D is taken out of the printer body 1, the first and second inlet covers 150 and 160 are returned to their respective positions by the tension springs 157 and 167, respectively.

Thus, according to the printer of this eleventh embodiment, when the optical disk D is inserted into the conveyance path 15 in the printer body 1, the first and second cover plates 155 and 165 cover the tops of the cutter buttons 112 and the disengaging button 137, thereby disabling these buttons. Thus, troubles are eliminated, such as damage the optical disk D inserted into the printer body 1 with the actuated cutter 111 and/or open the cover 5 in a state in which the optical disk D is inserted into the inlet 116 in the cover 5, thereby causing the edge of the inlet 116 to hit the optical disk D and hence damaging the optical disk D.

Figure 33A:
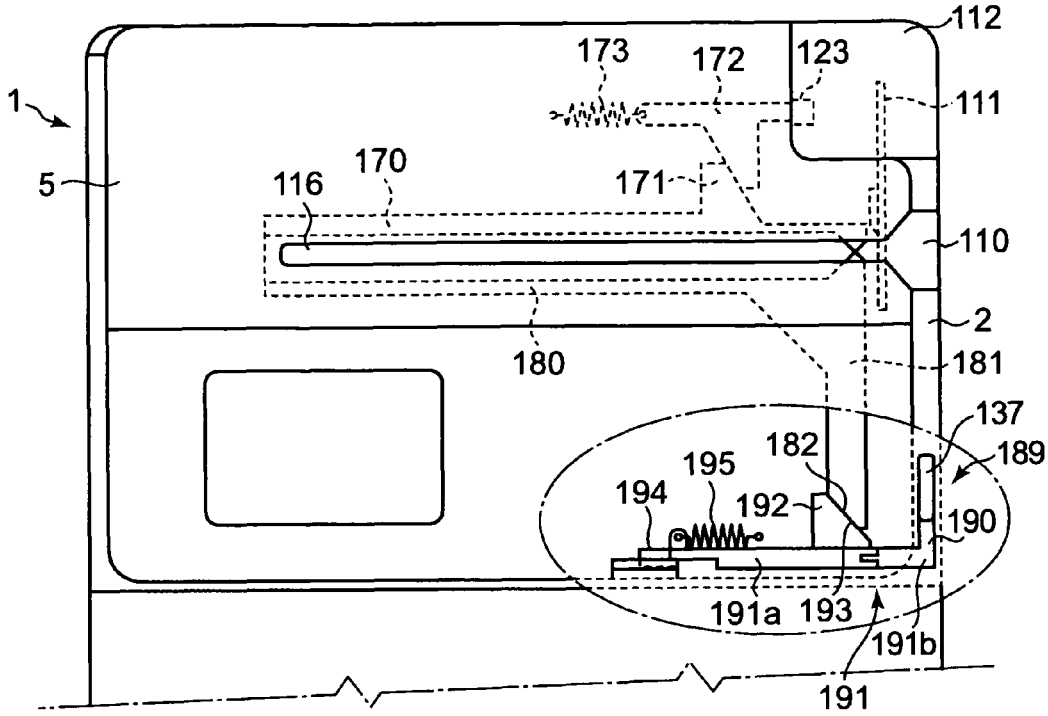
FIGS. 33A and 33B are cutaway plan views of a printer according to a twelfth embodiment of the present invention in different operative states, respectively.
Figure 33B:
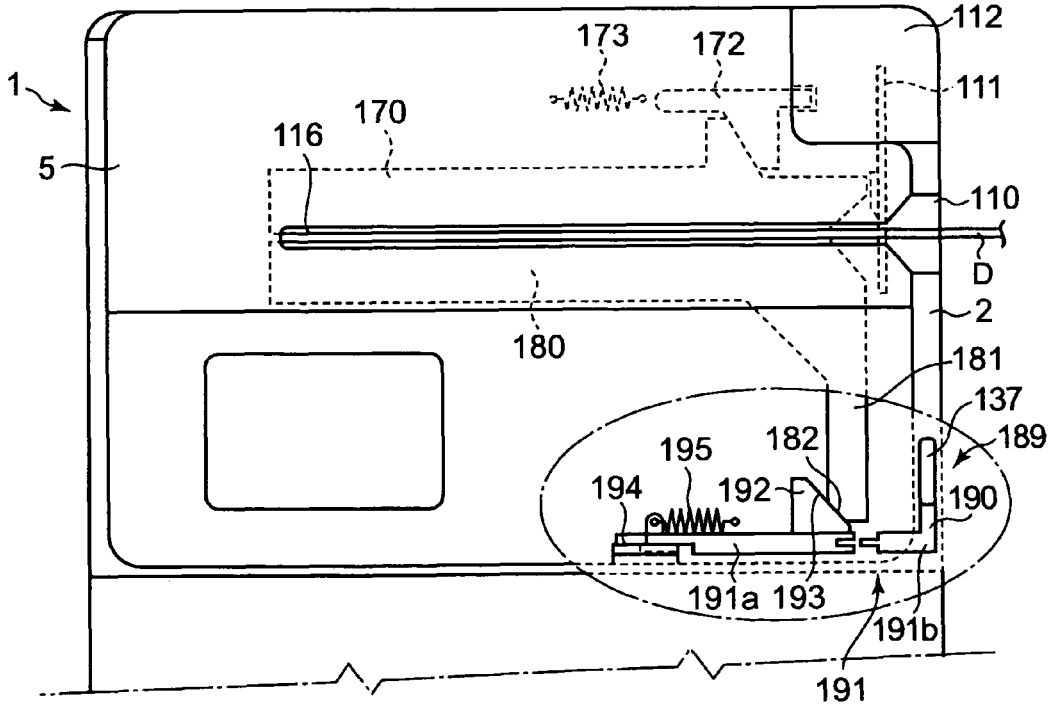

FIGS. 33A and 33B are views of a printer according to a twelfth embodiment and similar to FIGS. 32A and 32B, respectively. Like the eleventh embodiment of FIG. 32, the printer 1 of the twelfth embodiment comprises first and second inlet covers 170 and 180 provided below the cover 5, having edges inclined at different angles to the horizontal edges of the first and second covers 170 and 180 in the vicinity of the open end 110 of the printer body 1. When the optical disk D is inserted into the printer body 1, the first and second inlet covers 170 and 180 are moved backward and forward, respectively, on the printer body 1. The first inlet cover 170 has a backward protrusion 171 with an inclined sliding edge in the vicinity of the right-hand end thereof. The cutter lock member 172 also has an inclined edge slidable on the sliding edge of the protrusion 171 of the first inlet cover 170 and is movable right or left in accordance with a movement of the first inlet cover 170 under the resiliency of a tension spring 173 attached to a left end of the cutter lock member 172, which is the same structure as the eighth embodiment. The features of the twelfth embodiment are that when an optical disk D is inserted into the printer body 1, operation of the disengaging button 137 is not transmitted to the disengaging mechanism of the cover 5. As shown in FIGS. 33A and 33B, the second inlet cover 180 has a forward protrusion 181 with an inclined end edge 182 at the right-hand end thereof. The disengaging mechanism of the cover 5 has substantially the same structure as that of FIG. 27 with the exception that the disengaging mechanism operates in conjunction with the operation of the second inlet cover 180 and that a branch thereof similar to the other branch 139*b* of the connection lever 139 of the FIG. 27 disengaging mechanism is separable into subbranches. An L-shaped lever 189 provided at the right-hand lower corner of the cover 5 comprises one branch 190 and the other branch 191 that is separable into two subbranches 191*a* and 191*b* where one subbranch 191*a* is movable right and left relative to the printer body 1 and having a protrusion 192 in the vicinity of the right-hand end of the subbranch 191*a* that extends toward the second inlet cover 180 and receives a force from the same. The protrusion 192 has an inclined end edge 193 slidable on an complementarily inclined end edge 182 of the forward protrusion 181 of the second inlet cover 180. The one subbranch 191*a* is biased by a spring 195 so as to connect to the other subbranch 191*b*. A stop 194 corresponding to the stop 136 of FIG. 27 is provided in the vicinity of the left-hand end of one subbranch 191*a* for limiting a leftward movement of the other branch 191 beyond its limit.

When in the printer of this twelfth embodiment an optical disk D is inserted into the printer body 1, the first inlet cover 170 moves, thereby locking the cutter button 112, and the second inlet cover 180 moves from the state of FIG. 33A to the state of FIG. 33B, thereby separating the other branch 191 of the connection lever 189 into the subbranches 191*a* and 191*b*. Thus, in spite of the pushing operation of the disengaging button 137, the engaging member 194 cannot be turned clockwise and hence the cover 5 cannot be disengaged from the body case 2. When the optical disk D is taken out of the printer body 1, the two subbranches 191*a* and 191*b* of the other branch 190 of the connection lever 189 are reconnected by the resiliency of the springs 172 and 195, and hence the first and second inlet covers 170 and 180 return to their respective original positions.

Thus, according to the printer of the twelfth embodiment, when the optical disk D is inserted into the conveyance path 15 of the printer body 1, the cutter 111 is locked and the operation of the disengaging button 137 is not transmitted to the engaging element 197 of the disengaging mechanism. Thus, the cover 5 is left locked to the body case and hence cannot be opened. Thus, troubles are eliminated, such as damage the optical disk D inserted into the printer body 1 with the actuated cutter 111 and/or open the cover 5 in a state in which the optical disk D is inserted into the inlet 116 in the cover 5, thereby causing the edge of the inlet 116 to hit the optical disk D and hence damaging the optical disk D.

Figure 34A:
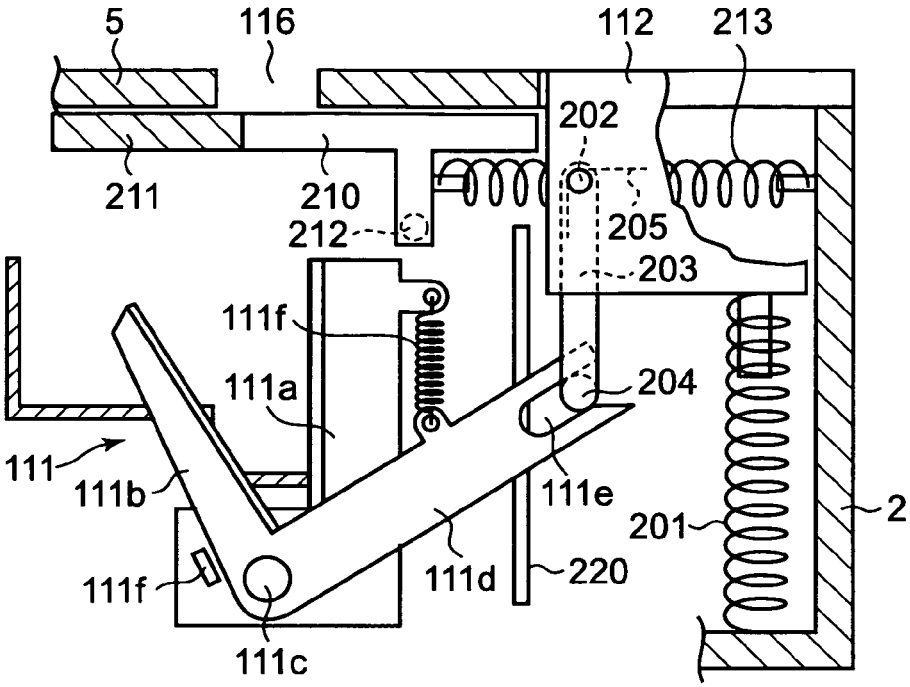
FIGS. 34A and 34B illustrate different operative states of a modification of the twelfth embodiment.

FIGS. 34 and 35 illustrate operation of a modification of the twelfth embodiment. This modification employs the same mechanism as prohibits disengagement of the inlet cover 5 in FIG. 33, and a mechanism that prevents the blades of the cutter 111 from being operated although the cutter button 112 is operable, instead of the lock mechanism of the cutter button 112. In FIG. 34, reference character 111*a* denotes a fixed blade and 111*b* an L-shaped movable blade. The movable blade 111*b* is pivoted at 111*c* in the vicinity of a corner of the L with a support branch 111*d* thereof having an elongate cut 111*e* at its end for connection to the cutter button 112. The movable blade 111*b* is biased by a tension spring 111*f* provided between the upper end portion of the fixed blade 111*a* on its opposite side from its blade edge and the midpoint of the upper edge of the arm part 111*d* of the movable blade 111*b* so as to move away from the fixed blade 111*a*. A stop 111*g* stops the movable blade 111*b* at its initial position. The cutter button 112 is biased upward by a return spring 201 provided between the cutter button 112 and the bottom of the printer body 1. A connecting member 203 is provided at an upper end thereof so as to be turnable through a predetermined angle around a pivot 202 attached to the cutter button 112 and has a connection pin 204 provided at a lower end thereof receivable within the cut 111*e* provided at the end of the arm part 111*d* of the movable blade 111*b*. The connection member 203 is biased clockwise around the pivot 202 by a spring 205. FIG. 34A shows a limit position of the clockwise turning of the connection member 203, which takes this vertical attitude usually under the resiliency of the spring 205. An inlet cover 210 is similar to the FIG. 33 first inlet cover 170 and provided under the cover 5 so as to open/close the inlet 116 in the cover 5. The inlet cover 210 has an inclined edge 211 such as shown by the inclined edge 24*c* of FIG. 1 at an end thereof at which the optical disk D is inserted into the printer body 1 and also has a pressing member 212 protruding downward from a lower end thereof. The inlet cover 210 is also biased forward in the printer body 1 by a spring 213 provided between the pressing member 212 and the right-hand wall of the printer body 1. A vertical plate 220 is biased forward so as to move upstanding in a predetermined range between the cutter 111 and the cutter button 112 in the body case 2.

Figure 34B:
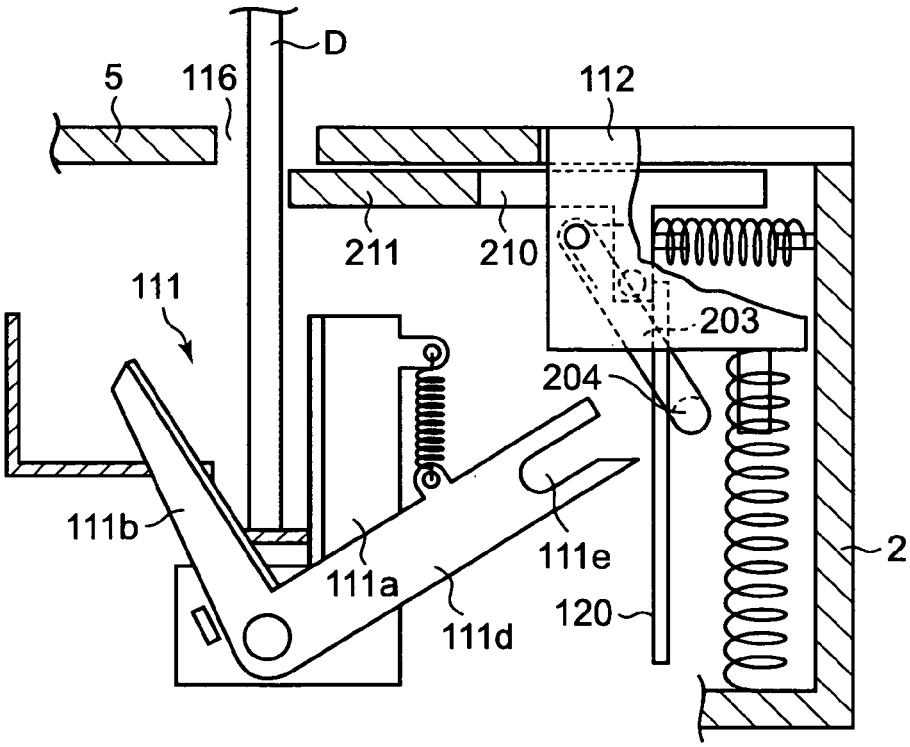
Figure 35A:
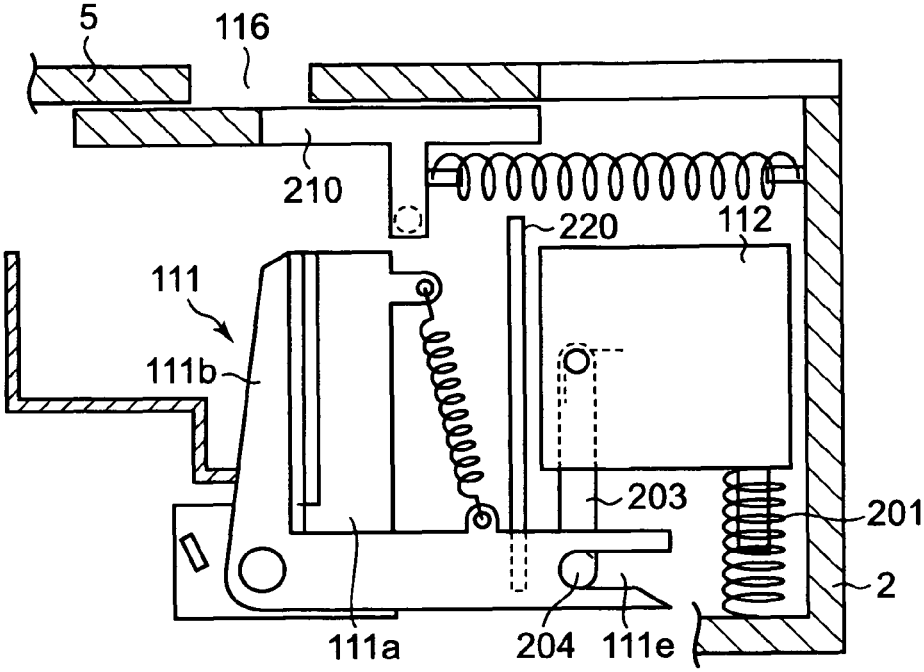
FIGS. 35A and 35B illustrate different operative states of a further modification of the twelfth embodiment.
Figure 35B:
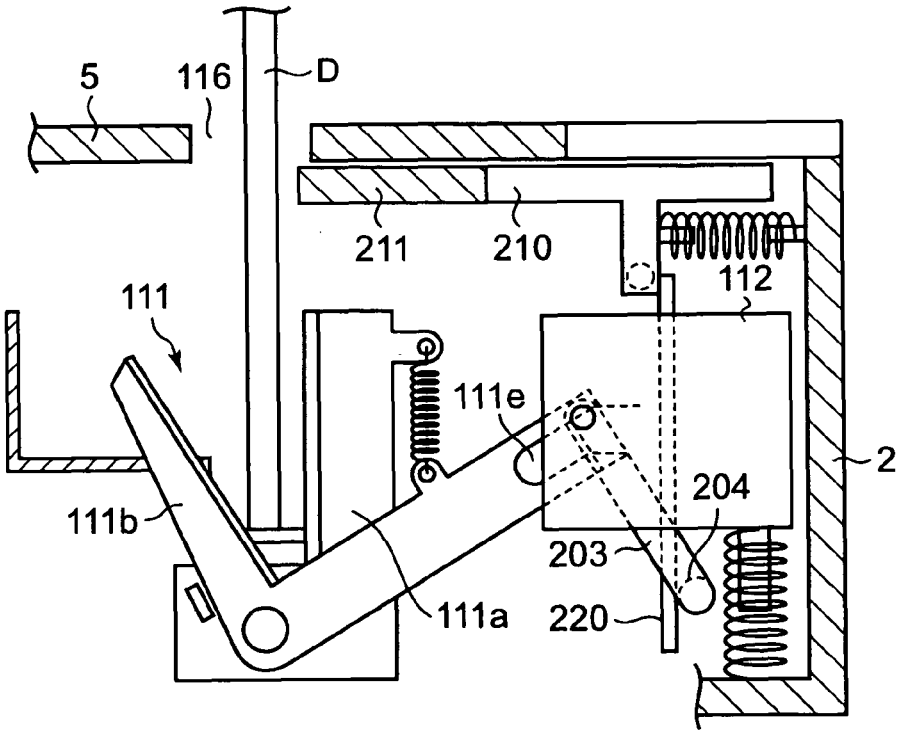

FIGS. 34A and 34B show the printer of this embodiment in which an optical disk D and no optical printer, respectively, are inserted into the conveyance path. FIGS. 35A and 35B show that the cutter button 112 is operated in the FIGS. 35A and 35B states, respectively. When no optical disk D is inserted, the connection member 203 provided on the cutter button 112 is upstanding vertical and the connection pin 204 provided on the lower end of the connection member 203 is received in the cut 111*e* provided in the end of the arm branch 111*d* of the movable blade 111*b*. Since in this state the cutter button 112 and the movable blade 111*b* are connected by the connection member 203, the movable blade 111*b* can be turned so as to approach the fixed blade 111*a* by pushing the cutter button 112 down, thereby cutting a printed part of the printing tape.

When the optical disk D is inserted into the conveyance path 15 in the printer body 1, the status changes from FIG. 34A to FIG. 34B. More specifically, the insertion of the optical disk D causes the inlet cover 210 to move backward on the printer body 1, which causes the downward pressing member 212 of the inlet cover 210 to translate the vertical plate 220 upstanding backward within the printer body 1. This causes the vertical plate 220 to push the connection pin 204 at the lower end of the connection member 203 provided on the cutter button 112 so as to move away the pin 204 out of the cut 111*e* in the support member 111*d*, thereby disconnecting the movable blade 111*b* from the cutter button 112, which is shown by FIG. 34B. Thus, even when the cutter button 112 is pushed down in the state in which the optical disk D is inserted into the printer body 1 as shown in FIG. 35B, the connection pin 204 at the lower end of the connection member 203 is only moved away from the cut 111*e* in the end of the support arm 111*d* of the movable blade and then moves downward along the vertical plate 220. Thus, since operation of the cutter button 112 is not transmitted to the movable blade 111*b* and hence the cutter 111 cannot be operated.

Thus, with the mechanism of FIGS. 34 and 35, even when the cutter button 112 is operated inadvertently in a state in which the optical disk D is inserted into the conveyance path 15 in the printer body 1, the optical disk D is neither damaged nor is the cutter blades 111*a* and 111*b* damaged. When the optical disk D is taken out of the printer body 1 in the state of FIG. 34B, the inlet cover 210 is returned forward on the printer body 1 by the resiliency of the spring 213 and the vertical plate 220 is also returned forwardly in the printer body 1 by the resiliency of the spring (not shown). Thus, the connection member 203 that is released from the vertical plate 220 is turned clockwise by the resiliency of the spring 205 and hence the connection pin 204 is moved into the cut 111*e* in the support arm 111*d* of the movable blade 111*b*, which returns the cutter button 112 and the movable blade 111*b* into their connected state, which is shown by FIG. 34A.

Figure 36:
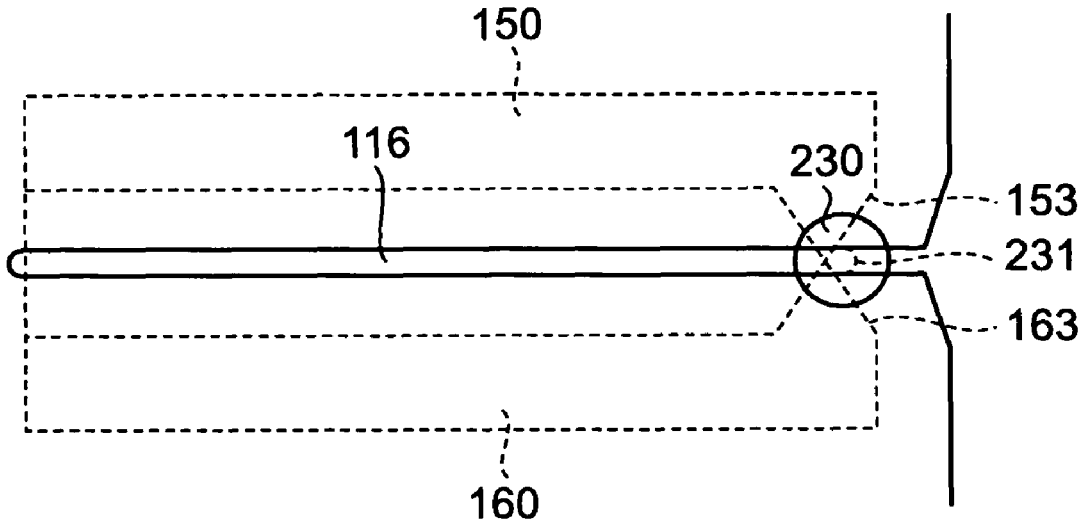
FIG. 36 illustrates a modification of the printer according to the eleventh embodiment.

FIG. 36 illustrates a modification of the FIG. 32 embodiment. While in the FIG. 32 printer the first and second inlet covers 150 and 160 are illustrated as pushed and moved by the optical disk D inserted, they may be moved manually in the respective backward and forward directions on the printer body 1. In FIG. 36, a manual operation knob 230 has a downward protrusion 231 formed on the lower end of the knob 230. By moving the manual operation knob 230 at its initial position as shown from the right-hand end of the inlet 116 in the cover 5 to its left-hand end along the inlet, the first and second inlet covers 150 and 160 may be moved in the respective backward and forward directions. This manual operation mechanism is applicable to the embodiment of FIG. 33 and its modification.

Figure 37:
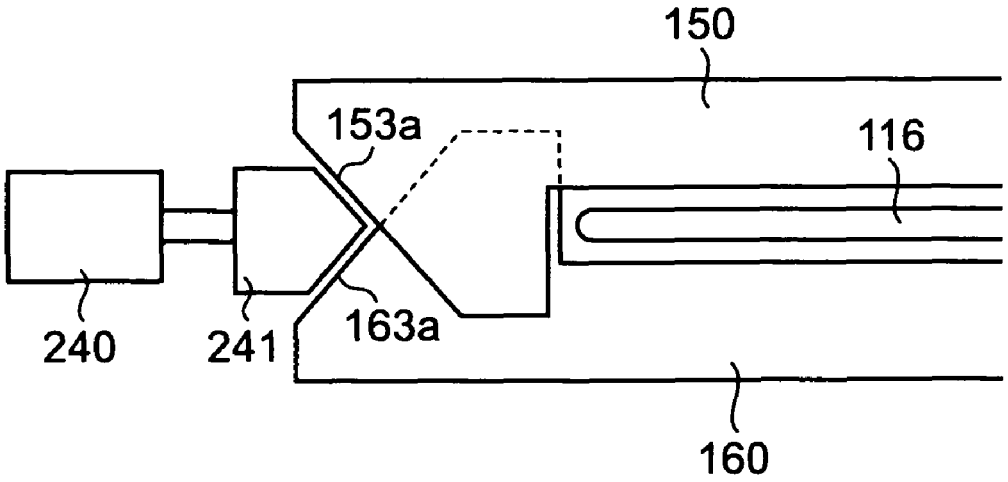
FIG. 37 illustrates a further modification of the printer according to the eleventh embodiment.

FIG. 37 illustrates a further modification of the FIG. 32 embodiment. In this modification, the first and second inlet covers 150 and 160 are moved by energizing a solenoid. The first and second inlet covers 150 and 160 have inclined edges 153*a* and 163*a* at the left-hand ends thereof which cooperate to form an angular recess therebetween against which an actuator 241 with an angular head complementary to the angular recess is arranged to be protruded rightward by energization the solenoid 240, thereby moving the first and second inlet covers 150 and 160 or backward and forward, respectively. The solenoid 240 is energized based on a signal from a sensor (not shown) that senses that the disk D is inserted into the printer body 1. This operating mechanism applies to the embodiment of FIG. 33 and its modification.

The present invention is not limited to the above-mentioned embodiments and modifications. For example, the various means for prohibiting the operation of the cutter 111 and the various means for prohibiting the opening of the cover 5 may be combined in use.

The rigid recording mediums used in the present printers may include plastic cards in addition to the optical disks. While the printers in which the printing head provided at the predetermined position prints on a printing tape or an optical disk under conveyance have been illustrated, printers may be used in which a carriage on which the printing head is mounted is moved onto a printing tape or an optical disk held at a predetermined position and then the printing head prints on the tape or disk. In this case, a printed part of the printing tape is moved to the position of the cutter and then cut by the cutter. While in the above embodiments the thermal transfer printing using an ink ribbon has been illustrated, the printing may be performed in an ink jet system.

The present invention has been described with reference to several exemplary embodiments and modifications. However, it will be readily apparent to those skilled in the art that it is possible to embody the invention in specific forms other than those of the exemplary embodiments and modifications described above. This may be done without departing from the spirit of the invention. These exemplary embodiments and modifications are merely illustrative and should not be considered restrictive in any way. The scope of the invention is given by the appended claims, rather than the preceding description, and all variations and equivalents which fall within the range of the claims are intended to be embraced therein.

This application is based on Japanese Patent Applications Nos. 2005-284793 and 2005-284795 both filed on Sep. 29, 2005 and each including specification, claims, drawings and summary. The disclosures of the above Japanese patent applications are incorporated herein by reference in their entireties.

What is claimed is:

1. A printer that prints information on a printing medium or rigid medium, the printer comprising:

a conveyance path along which the printing medium is conveyed;

printing means for printing the information either on the printing medium inserted into a printer body and conveyed along the conveyance path or on the rigid medium disposed in the conveyance path;

cutting means disposed over the conveyance path and connected to an operation member operable manually from outside the printer body for causing the cutting means to cut a part of the printing medium on which the information is printed by the printing means; and prohibiting means for prohibiting the cutting means from being manually operated via the operation member when the rigid medium is inserted into the conveyance path, wherein the prohibiting means comprises operation preventing means, responsive to the rigid medium being inserted into the conveyance path, for preventing the cutting means from being manually operable via the operation member.

2. The printer of claim 1, wherein the operation preventing means comprises lock means, responsive to the rigid medium being inserted into the conveyance path, for locking the cutting means so as not to be operable.

3. The printer of claim 1, wherein the operation preventing means comprises covering means, responsive to the rigid medium being inserted into the conveyance path, for covering the operation member so as not to be manually operable.

4. The printer of claim 1, wherein the operation preventing means comprises interrupting means, responsive to the rigid medium being inserted into the conveyance path, for interrupting transmission of the manual operation of the operation member to a cutting blade of the cutting means.

5. A printer that prints information on a printing medium or rigid medium, the printer comprising:

a conveyance path along which the printing medium is conveyed;

printing means for printing the information either on the printing medium inserted into a printer body and conveyed along the conveyance path or on the rigid medium disposed in the conveyance path;

cutting means disposed over the conveyance path and connected to an operation member operable manually from outside the printer body for causing the cutting means to cut a part of the printing medium on which the information is printed by the printing means; and prohibiting means for prohibiting the cutting means from being manually operated via the operation member when the rigid medium is inserted into the conveyance path, wherein:

the printer body has an inlet therein through which the rigid medium is inserted into the conveyance path therein, and further comprises:

an inlet cover provided on the printer body for covering the inlet in the printer body, the inlet cover being manually operable when the rigid medium is inserted into the conveyance path through the inlet in the printer body; and wherein:

the prohibiting means comprises operation preventing means, responsive to the inlet cover being opened, for preventing the operation member from being manually operable.

6. The printer of claim 5, wherein the operation preventing means comprises lock means, responsive to the inlet cover being opened, for locking the cutting means in an inoperable state.

7. The printer of claim 6, wherein the operation preventing means comprises covering means, responsive to the rigid medium being inserted into the conveyance path, for covering the operation member so as not to be manually operable.

8. The printer of claim 5, wherein the operation preventing means comprises interrupting means, responsive to the inlet cover being opened, for interrupting transmission of the manual operation of the operation member to a cutting blade of the cutting means.

9. A printer that prints information on a printing medium or rigid medium, the printer comprising:

a conveyance path along which the printing medium is conveyed;

printing means for printing the information either on the printing medium inserted into a printer body and conveyed along the conveyance path or on the rigid medium disposed in the conveyance path;

cutting means disposed over the conveyance path and connected to an operation member operable manually from outside the printer body for causing the cutting means to cut a part of the printing medium on which the information is printed by the printing means; and prohibiting means for prohibiting the cutting means from being manually operated via the operation member when the rigid medium is inserted into the conveyance path, wherein:

the prohibiting means comprises:

detecting means for detecting that the rigid medium is inserted into the conveyance path; and operation preventing means, responsive to the detecting means detecting that the rigid medium being inserted into the conveyance path, for being driven by a drive source to prevent the cutting means from being manually operated.

10. The printer of claim 9, wherein the operation preventing means comprises lock means driven by the drive source for locking the cutting means in an inoperable state.

11. The printer of claim 9, wherein the operation preventing means comprises covering means, driven by the drive source, for covering the operation member so as not to be operable.

12. The printer of claim 9, wherein the operation preventing means comprises interrupting means, driven by the drive source, for interrupting transmission of the manual operation of the operation member to a cutting blade of the cutting means.

13. A printer that prints information on either a printing medium or a rigid medium, the printer comprising:

a conveyance path along which the printing medium is conveyed;

printing means for printing the information either on the printing medium inserted into a printer body and conveyed along the conveyance path or on the rigid medium disposed in the conveyance path;

a cassette receiving section for receiving print expendables exchangeably;

a printer body cover provided openably over the printer body so as to cover the cassette receiving section, the printer body cover having an inlet therein through which the rigid medium is inserted into the printer body such that a part of the rigid medium appears outside the printer body;

cutting means disposed over the conveyance path and having an operation member operable manually from outside the printer body for causing the cutting means to cut a part of the printing medium on which the information is printed by the printing means; and prohibiting means for prohibiting the cutting means and the printer body cover from being manually operated and opened, respectively, when the rigid medium is inserted into the conveyance path.

14. The printer of claim 13, further comprising:

an inlet cover provided over the printer body for covering the inlet in the printer body cover, the inlet cover being manually openable when the rigid medium is inserted into the conveyance path; and wherein:

the prohibiting means comprises operation preventing means, responsive to the inlet cover being opened manually, for preventing the cutting means and the printer body cover from being manually operated and opened, respectively.

15. The printer of claim 14, wherein the operation preventing means comprises:

one of (i) means for locking the cutting means so as not to be operated, (ii) means for covering the operation member of the cutting means so as not to be operated, and (iii) means for interrupting transmission of the manual operation of the operation member of the cutting means to a cutter blade of the cutting means; and one of (i) means for locking the printer body cover to the printer body so as not to be operated, (ii) means for covering an operation member of disengaging means for disengaging the printer body cover from the printer body, and (iii) means for interrupting transmission of the manual operation of the operation member of the disengaging means to the disengaging means.

16. The printer of claim 13, wherein the prohibiting means comprises operation preventing means, responsive to the rigid medium being inserted into the conveyance path, for preventing the cutting means and the printer body cover from being manually operated and opened, respectively.

17. The printer of claim 16, wherein the operation preventing means comprises:

one of (i) means for locking the cutting means so as not to be operated, (ii) means for covering the operation member of the cutting means so as not to be operated, and (iii) means for interrupting transmission of the manual operation of the operation member of the cutting means to a cutter blade of the cutting means; and one of (i) means for locking the printer body cover to the printer body so as not to be operated, (ii) means for covering an operation member of disengaging means for disengaging the printer body cover from the printer body, (iii) and means for interrupting transmission of the manual operation of the operation member of the disengaging means to the disengaging means.

18. The printer of claim 13, wherein:

the prohibiting means comprises:

detecting means for detecting that the rigid medium is inserted into the conveyance path; and operation preventing means, responsive to the detecting means detecting that the rigid medium is inserted into the conveyance path, for being driven by a drive source to prevent the cutting means and the printer body cover from being manually operated and opened, respectively.

19. The printer of claim 18, wherein the operation preventing means comprises:

one of (i) means for locking the cutting means so as not to be operable, (ii) means for covering the operation member of the cutting means so as not to be operable, and (iii) means for interrupting transmission of the manual operation of the operation member of the cutting means to a cutter blade of the cutting means; and one of (i) means for locking the printer body cover to the printer body so as not to be operated, (ii) means for covering an operation member of disengaging means for disengaging the printer body cover from the printer body, and (iii) means for interrupting transmission of the manual operation of the operation member of the disengaging means to the disengaging means.

20. The printer of claim 13, wherein the printing medium comprises a printing tape and the rigid medium comprises a data recordable medium.

* * * * *